US006653033B1

(12) United States Patent
Kami et al.

(10) Patent No.: US 6,653,033 B1
(45) Date of Patent: Nov. 25, 2003

(54) ELECTROPHOTOGRAPHIC PHOTOCONDUCTOR, METHOD OF MANUFACTURING SAME AND IMAGE FORMING METHOD, IMAGE FORMING APPARATUS AND PROCESS CARTRIDGE USING SAME

(75) Inventors: Hidetoshi Kami, Numazu (JP); Tatsuya Niimi, Numazu (JP); Akihiko Matuyama, Isehara (JP); Nozomu Tamoto, Numazu (JP); Eiji Kurimoto, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/377,666

(22) Filed: Mar. 4, 2003

Related U.S. Application Data

(63) Continuation of application No. 09/985,375, filed on Nov. 2, 2001, now Pat. No. 6,573,016.

(30) Foreign Application Priority Data

Nov. 30, 2000 (JP) ..... 2000-365687
Sep. 21, 2001 (JP) ..... 2001-290162

(51) Int. Cl.[7] ..... G03G 15/02
(52) U.S. Cl. ..... 430/58.05
(58) Field of Search ..... 430/58.05, 59.1, 430/66

(56) References Cited

U.S. PATENT DOCUMENTS 5,096,795 A 3/1992 Yu
5,252,418 A * 10/1993 Ishikawa et al. ..... 430/67
5,547,790 A 8/1996 Umeda et al.
5,677,094 A 10/1997 Umeda et al.
5,723,243 A 3/1998 Sasaki et al.
5,747,204 A 5/1998 Anzai et al.
5,789,128 A 8/1998 Adachi et al.
5,804,343 A 9/1998 Umeda et al.
5,840,454 A 11/1998 Nagai et al.
5,846,680 A 12/1998 Adachi et al.
5,853,935 A 12/1998 Suzuki et al.
5,871,876 A 2/1999 Ikuno et al.
5,942,363 A 8/1999 Tanaka et al.
5,976,746 A 11/1999 Tamaka et al.
6,026,262 A 2/2000 Kinoshita et al.
6,027,846 A 2/2000 Shimada et al.
6,030,733 A 2/2000 Kami et al.
6,030,736 A 2/2000 Ikegami et al.
6,045,959 A 4/2000 Katayama et al.
6,066,428 A 5/2000 Katayama et al.
6,087,055 A 7/2000 Niimi
6,093,784 A 7/2000 Tamura et al.
6,132,911 A 10/2000 Niimi
6,136,483 A 10/2000 Suzuki et al.
6,187,492 B1 2/2001 Ri et al.
6,187,494 B1 2/2001 Kawamura et al.
6,210,848 B1 4/2001 Nagai et al.
6,218,533 B1 4/2001 Niimi
6,326,112 B1 * 12/2001 Tamura et al. ..... 430/126
6,444,387 B2 9/2002 Ri et al.

OTHER PUBLICATIONS

Derwent Abstract, JP 05–297608, Nov. 12, 1993.
Patent Abstracts of Japan, JP 2001–142241, May 25, 2001.
Patent Abstracts of Japan, JP 58–153939, Sep. 13, 1983.

* cited by examiner

*Primary Examiner*—John Goodrow
(74) *Attorney, Agent, or Firm*—Oblon, Spivak, McClelland, Maier & Neustadt, P.C.

(57) ABSTRACT

An electrophotographic photoconductor having an electroconductive support, and a photoconductive layer formed on the support and having an outwardly facing surface. The photoconductive layer includes a charge transporting material, a charge generating material and an inorganic filler including α-alumina, wherein the concentration of the inorganic filler in the photoconductive layer decreases stepwise or continuously in the direction from the outwardly facing surface thereof to the opposite surface thereof.

12 Claims, 7 Drawing Sheets

ELECTROPHOTOGRAPHIC PHOTOCONDUCTOR, METHOD OF MANUFACTURING SAME AND IMAGE FORMING METHOD, IMAGE FORMING APPARATUS AND PROCESS CARTRIDGE USING SAME

This application is continuation of application Ser. No. 09/985,375, pending filed on Nov. 2, 2001 U.S. Pat. No. 6, 573,016 which was published in English.

BACKGROUND OF THE INVENTION

1. Field of the Invention

This invention relates to an electrophotographic photoconductor having an inorganic filler-containing photoconductive layer, a method of manufacturing same and to an image forming apparatus using same. More specifically, the present invention is directed to an electrophotographic photoconductor having a long service life, to a method of manufacturing same and to an image forming method, an image forming apparatus and a process cartridge using same. The image forming apparatus and process cartridge are utilized in, for example, electrophotographic copying machines, facsimile apparatuses, laser printers and direct digital printing master making apparatuses.

2. Discussion of the Related Art

The electrophotographic process using an electrophotographic photoconductor includes at least the steps of conducting first charging for uniformly charging the surface of the photoconductor, exposing the charged surface of the photoconductor to light images to form latent electrostatic images thereon, developing the latent electrostatic images with toner to make visible toner images, transferring the toner images to a transfer sheet, fixing the toner images to the transfer sheet, and cleaning the surface of the photoconductor.

Electrophotographic photoconductors used in the above electrophotographic process are desired to have the following properties:

(1) good charging property so as to be charged to an appropriate electric potential in a dark place;

(2) good charge maintaining property such that the decrease of the electric potential is little in a dark place;

(3) good charge dissipating property such that the electric potential is rapidly dissipated by light irradiation;

(4) capability of being produced with relatively low costs;

(5) adaptability to minimize environmental pollution; and (6) capability of producing good images without image defects such as background fouling for a long time.

Conventional photoconductive layers for use in the photoconductors include selenium photoconductive layers of selenium or a selenium alloy supported on a conductive support; inorganic photoconductive layers containing a binder and an inorganic photoconductive material such as zinc oxide or cadmium sulfide dispersed in the binder; amorphous silicon photoconductive layers of an amorphous silicon material; and organic photoconductive layers containing an organic photoconductive material. In photoconductors for use with the electrophotographic method, organic photoconductive materials are now widely used because such organic photoconductors can be manufactured at low costs by mass production and will not cause environmental pollution.

Many kinds of organic photoconductors are conventionally proposed, for example, a photoconductor employing a photoconductive resin such as polyvinylcarbazole (PVK); a photoconductor comprising a charge transport complex of polyvinylcarbazole (PVK) and 2,4,7-trinitrofluorenone (TNF); a photoconductor of a pigment dispersed type in which a phthalocyanine pigment is dispersed in a binder resin; and a function-separating photoconductor comprising a charge generation material and a charge transport material. In particular, the function separating photoconductor has now attracted considerable attention.

The mechanism of formation of an electrostatic latent image using the function-separating photoconductor is considered to be as follows:

(1) upon irradiation of a charged organic photoconductor with light, the light passes through a transparent charge transporting layer and is absorbed by a charge generating material contained in a charge generating layer;

(2) the charge generating material which has absorbed the light generates a charge carrier;

(3) the charge carrier, which is injected to the charge transporting layer, moves through the charge transporting layer, which is caused by the electric field formed in the charged photoconductor; and (4) the charge carrier finally combines with the charge on the surface of the photoconductor, resulting in neutralization of the charge, and thereby an electrostatic latent image is formed.

Functionally separated photoconductors which include a combination of a charge transporting material which has absorbance mainly in an ultraviolet region and a charge generating material which has absorbance mainly in a visible region are well known and preferable. However, even in the functionally separated photoconductors, the durability is not necessarily satisfactory.

Among various image forming machines, electrophotographic apparatuses are now widely distributed for use in offices as well as for domestic, personal use because of their high speed recording. In line with such a trend, there are increasing demands for small-sized machines and running trouble-free machines. In particular, there are increasing demands for machines which can reduce running costs, which permit high-speed printing and which are capable of producing color images. In connection with color printing, production of high grade images of natural and clean figure and landscape are strongly desired.

To respond to such demands, charge rollers are increasingly used in lieu of a scolotron chargers so as to reduce electric power consumption and generation ozone. Further, many attempts are made to use chargers with means for superimposing AC components for the purpose of stabilizing the image quality. Improvement of image quality by using small particle size developer is also proposed in both monochromatic and color printing or copying machines. In view of the fact that a dye or pigment for printing ink has a size of sub-micron order, there still remains an objective problem to develop a toner having a much reduced size. In terms of small-sized and high speed printing and copying machines, electrophotographic photoconductor must be used at high speed. Such machines pose increased hazard to electrophotographic photoconductors. Thus, it is one of the greatest problems to develop an electrophotographic photoconductor having excellent durability.

In order to always obtain stable output images throughout a large number of printing operations, development of techniques for preventing image defects, reduction of image density and reduction of resolution is essential. Such image defects are known to result from scars or scraping of a surface top layer of the photoconductor. Thus, in order to prevent occurrence of image defects during a large number of printing operations, it is necessary that the organic type electrophotographic photoconductors should have high mechanical strengths and excellent abrasion resistance, while ensuring suitable electrostatic characteristics.

Various proposals have been made to improve the abrasion resistance of the surface of the photoconductors are as follows:

(1) Improving Mechanical Strength of Charge Transporting Layer:

For example, Japanese Laid-Open Patent Publications Nos. 10-288846 and 10-239870 disclose photoconductors in which the abrasion resistance thereof is improved by using a polyacrylate resin as a binder resin. Japanese Laid-Open Patent Publications Nos. 9-160264 and 10-239871 disclose photoconductors in which the abrasion resistance thereof is improved by using a polycarbonate resin as a binder resin. Japanese Laid-Open Patent Publications Nos. 10-186688, 10-186687, and 5-040358 disclose photoconductors in which the abrasion resistance thereof is improved by using a polyester resin having a terphenyl skeleton, a polyester resin having a triphenyl methane skeleton, or a polyester resin having a fluorene skeleton as a binder resin. Japanese Laid-Open Patent Publications Nos. 9-12637 and 9-235442 disclose the use of a polymer blend containing a styrene elastomer as a binder for a charge transporting layer.

With the photoconductor mentioned above, however, it is necessary to use a large amount of a charge transporting material having low molecular weight in the photoconductive layer in order to obtain good light decaying property, i.e., good photosensitivity. To use a large amount of a charge transporting material having low molecular weight seriously deteriorates the strength of the photoconductive layer, and the more the amount of the charge transporting material in the photoconductive layer, the worse becomes the abrasion resistance of the photoconductive layer. Therefore the photoconductive layers of the above photoconductors easily abrade due to the charge transporting material having low molecular weight. Accordingly the use of a specific binder for a charge transporting layer is not effective for the improvement of abrasion resistance of photoconductors.

(2) Using Charge Transporting Polymer Material:

Japanese Laid-Open Patent Publication No. 7-325409 discloses a photoconductor which includes a charge transporting polymer material instead of charge transporting materials having low molecular weight. It is supposed that the photoconductor has good abrasion resistance because the content of resins in the photoconductive layer is relatively high.

However, a mere use of a charge transporting polymer material in place of a low molecular weight charge transporting material is not always sufficient to impart satisfactory printing resistance to the photoconductor. One possible reason is that abrasion of the photoconductor is not only attributed to mechanical load applied thereto but also ascribed to deterioration of surfaces thereof due to electric shock or chemical attack by oxidizing substances such as ozone. For example, when AC superposition charging is adopted to obtain uniform charging, surfaces of the photoconductor are subjected to repeated bombardment of charges corresponding to the frequency of the AC voltage, which would cause a reduction of printing resistance thereof. Additionally, because it is not easy to obtain a highly pure charge transporting polymer material, impurities are apt to be contained therein, which is likely to cause accumulation of residual potential.

(3) Decreasing Friction Coefficient of Charge Transporting Layer:

For example, Japanese Laid-Open Patent Publications Nos. 10-246978 and 10-20534 disclose photoconductors which have a relatively low friction coefficient by including a lubricant such as siloxane. Japanese Laid-Open Patent Publications Nos. 5-265241 and 8-328286 disclose photoconductors which have a relatively low friction coefficient by including a particulate fluorine containing resin. A reduction of the friction coefficient of a photoconductor may reduce a contact pressure between the photoconductor and a transfer medium, etc., so that the durability of the photoconductor will be improved. However, the lubricant generally is not compatible with a binder of the charge transporting layer and is apt to appear on the surface of the layer. As a result, the lubricant is gradually lost during use to cause the lowering of the abrasion resistance. A lubricant having good compatibility with the binder, on the other hand, is generally small in friction coefficient.

(4) Providing Protective Layer

For example, Japanese Laid-Open Patent Publications Nos. 57-30846, 58-121044, 59-2234443 and 59-223445 disclose a photoconductor having a protective layer containing antimony oxide or tin oxide having specific particle size and particle size distribution. While the use of such a protective layer can improve the mechanical strengths of the photoconductor and durability thereof, the resolution of the photoconductor tend to be lowered.

In particular, such a reduction of the resolution occurs when ions generated by a charging device deposit on the surface of the photoconductor. Probably, the deposition of ions causes leakage of charges in the direction parallel with the surface of the photoconductor, which in turn results in the lowering of the resolution. In the case of a photoconductor which can completely resist against surface wearing, fouling substances are apt to accumulated thereon upon repeated use, so that the electric resistance of the surface of the photoconductor gradually decreases. Such a phenomenon often occurs with photoconductors having a surface protective layer.

It is not easy to control the rate of wear of a surface protective layer. Further, the thickness of the protective layer should be thin since otherwise the residual potential increases. In addition, a small size photoconductor drum for use in a small size electrophotoconductive machine is apt to cause delamination of its protective layer having a small radius of curvature. Thus, the use of a surface protective layer poses a number of problems and, therefore, is not practically applicable.

(5) Modifying Charge Transporting Layer:

For example, Japanese Laid-Open Patent Publications Nos. 46-782 and 52-2531 disclose photoconductors in which a lubricating filler is incorporated in a surface layer thereof to improve the service life thereof. Japanese Laid-Open Patent Publications Nos. 54-44526 and 60-57346 disclose photoconductors in which a filler is incorporated in an insulating layer of an image-holding member or a photoconductive layer to improve the mechanical strengths thereof. Japanese Laid-Open Patent Publications Nos. 1-205171 and 7-261417 disclose photoconductors in which a filler is incorporated in a charge transporting layer or a surface layer thereof to enhance the hardness thereof and to impart slipping properties thereto. Japanese Laid-Open Patent Publication No. 61-251860 discloses a photoconductors in which 1–30 parts by weight of hydrophobic titanium oxide powder is used per 100 parts of a charge transporting medium to improve the mechanical strengths thereof.

These methods, however, cause accumulation of residual potential and deterioration of sensitivity. Namely, known photoconductors having a filler-containing photoconductive layer cause considerable increase of the residual potential when the thickness thereof increases.

In the case of a photoconductor whose surface wearing is suppressed by improvement of the mechanical strengths and durability thereof and of the electrostatic characteristics thereof, a serious problem arises with respect to the formation of abnormal images. Abnormal images are often formed when moistened printing or copying paper is used. Such paper will cause deterioration of a resin of the photoconductor by oxidation and deposition of fouling matters on surfaces thereof. As a result, the electric resistance of the surfaces thereof decreases to cause deformation of images.

To cope with the above problem, the following techniques have been proposed.

(1) Japanese Laid-Open Patent Publications Nos. 11-311876 and 2000-131855 disclose a photoconductor having a surface layer formed of a mixed resin containing high and low molecular weight polymers as a binder. While surface fouling matters may be removed by abrasion of the low molecular weight resin, the durability of the photoconductor is not satisfactory.

(2) Japanese Laid-Open Patent Publications Nos. 5-119488, 8-95278 and 2000-214618 disclose a photoconductor in which an anti-oxidizing agent or a plasticizer is incorporated into a photoconductive layer or a surface layer thereof. Japanese Laid-Open Patent Publications Nos. 10-301303 and 1000-10323 disclose the addition of a hindered amine or hindered phenol in a photoconductive layer. While these method can improve the reduction of formation of abnormal images, another problem such as reduction of mechanical strengths or accumulation of residual potential arises.

(3) Japanese Laid-Open Patent Publication No. 11-249333 proposes the use of a charge transporting material having specific ionization potential for the purpose of preventing formation of abnormal images and occurrence of toner filming. Japanese Laid-Open Patent Publications Nos. 7-295278 and 8-184976 disclose a photoconductor having a surface with improved slippage. Japanese Laid-Open Patent Publication No. 6-75386 discloses incorporation of a silicone resin or a fluorine resin to improve slippage of a photoconductor surface. The use of a lubricating agent is, however, not advantageous from the standpoint of residual potential. Further, a slipping property improving agent is generally not compatible with a binder and, therefore, causes a reduction of mechanical strengths of the layer.

Thus, it is difficult to attain both prevention of the formation of abnormal images and the improvement of durability. Japanese Laid-Open Patent Publication No. 11-202525 discloses an image forming process using a specific charging method and a heating method. Japanese Laid-Open Patent Publication No. 11-19087 discloses an image forming process in which a lubricant is fed to a surface of a photoconductor. These methods, however, require additional devices and are disadvantageous with respect to costs and small-size design and, hence, do not meet with the recent needs.

As having been described in the foregoing, the conventional technology for improving durability of photoconductors can be said either to improve the resistance to wearing or to prevent fouling of the photoconductor surface. Namely, the conventional techniques may attain only specific characteristics of the photoconductors but cannot of and by themselves improve service life thereof. In actual, the currently used electrophotographic photoconductors are regarded as consumption type expendable parts.

SUMMARY OF THE INVENTION

It is, therefore, an object of the present invention to provide an electrophotographic photoconductor having excellent durability and affording high grade images without abnormal images in a stable manner even when repeatedly used for a long period of time.

Another object of the present invention is to provide an electrophotographic photoconductor which can retain good electrostatic characteristics, which has improved mechanical strengths, which can withstand severe, charge loaded conditions, which can produce images with high resolution and which can prevent formation of abnormal images without using a heater.

It is a further object of the present invention to provide a method of producing the above photoconductor.

It is yet a further object of the present invention to provide an image forming process, an image forming apparatus and a process cartridge for an image forming apparatus which do not require replacement of a photoconductor for a long period of time, which permit the use of a small-sized photoconductor and the high speed printing and which can produce high grade images even in high volume printing.

In accordance with the present invention, there is provided an electrophotographic photoconductor comprising an electroconductive support, and a photoconductive layer formed on said support and having an outwardly facing surface, said photoconductive layer including a charge transporting material, a charge generating material and an inorganic filler comprising $\alpha$-alumina, wherein the concentration of the inorganic filler in the photoconductive layer decreases from the outwardly facing surface thereof to the opposite surface thereof In an electrophotographic process, abrasion of a photoconductor is considered to occur or to be accelerated during the following stages:

(1) Abrasion during cleaning stage:

In an electrophotographic process, toner remaining on a photoconductor surface is generally removed by cleaning with a brush or a blade. In the case of the cleaning blade method, an edge of the blade is brought into pressure contact with the surface of the rotating photoconductor to remove the residual toner therefrom. Such a sliding contact causes abrasion or injury of the photoconductor surface. This sort of abrasion is predominantly mechanical abrasion.

(2) Influence during charging stage:

As described in Japanese Laid-Open Patent Publication No. 10-10767, a photoconductor may undergo discharge dielectric breakdown at a defective portion thereof during charging even when the defect is slight. Such dielectric breakdown is significant when the photoconductor is an organic type which has low withstand voltage. Additionally, discharge may cause deterioration of the resin constituting a surface layer of the photoconductor, resulting in a reduction of abrasion resistance. Thus, upon repeated use, the abrasion increases so that the service life is reduced. Since the discharge occurs more strongly at a region of the surface layer having a small thickness, abraded or injured portions caused by repeated use are apt to be deteriorated and, hence, surface undulation is enhanced. As a consequence, adhesive wear or fatigue wear is accelerated.

(3) Abrasion during developing stage:

In the case of a developing method using a two-component developer composed of a toner and a carrier, a photoconductor is subjected to grinding conditions with the carrier and causes abrasion. Further, additives such as a fluidizing agent contained in the toner are generally hard substances and serve as abrasive for the photoconductor. Additionally, the present inventors have found that part of the toner and carrier are retained on a photoconductor surface even after the cleaning treatment with a cleaning blade and causes abrasion.

Abrasion of the photoconductor due to the developer proceeds continually as if it is always filed or polished. Such abrasion poses serious problems especially when the toner used contains a large amount of hard particles such as silica or is easy to stick on a photoconductor surface.

A toner, inclusive of one-component developer, undergoes repeated deposition on a photoconductor surface and separation therefrom. Adhesion between the toner and the photoconductor surface is not ignorable but may cause abrasion when the toner attached to the photoconductor surface is forced to be separated therefrom.

Thus, in order to improve resistance to abrasion of an electrophotographic photoconductor, it is necessary to consider a countermeasure for the above points (1)–(3). The present inventors have made a study with a view toward improvement of the durability of photoconductors and have arrived at a conclusion that the use of an inorganic filler is most effective. Although not wishing to be bound by the theory, a mechanism of contribution of an inorganic filler to improve the durability of a photoconductor would be as follows.

A mere improvement of mechanical strengths (for example a strength expressed by a multiple of a tensile strength by a strain) is not sufficient to improve abrasion resistance of a photoconductor while maintaining desired electrostatic characteristics thereof. One reason for this would be that a step of charging the photoconductor causes a certain change of the photoconductor surface which accelerates abrasion thereof. When the photoconductor surface is formed only of an organic material, there is a limitation in improving ability to withstand voltage so that deterioration of the photoconductor surface by charging is unavoidable. Accordingly, there is a limitation in improving abrasion resistance. The incorporation of an inorganic filler into the photoconductor is thus considered to contribute to the prevention of deterioration by charging.

The present inventors have found that a charge voltage has a great influence upon abrasion rate of a photoconductor. It has been also found that a mode of charging has an influence upon the degree of damage on the photoconductor. It is thus likely that deterioration of the photoconductor surface by charging may accelerate the abrasion thereof by mechanical stress.

When an inorganic filler is incorporated into the photoconductor, the area of the polymer film exposed on the outwardly facing surface thereof decreased in an amount corresponding to the area of the inorgahic filler exposed on the surface. Accordingly, the degree of deterioration of the polymer film is reduced so that the abrasion rate is lowered.

The inorganic filler in the photoconductor also undergoes abrasion and liberation therefrom during electrophotographic processes. Thus, the abrasion resistance of the filler per se and the compatibility and packing characteristics of the filler with the polymer film are also considered to have an influence upon the abrasion resistance of the photoconductor.

Abrasion of a photoconductor during electrophotographic processes proceeds most significantly in the development stage. When the photoconductor surface is formed only of organic materials, the surface hardness thereof is much lower than that of the materials contained in a developer. Thus, incorporation of an inorganic filler, which has a hardness comparable to the materials contained in the developer, into the photoconductor surface will prevent the abrasion thereof by the developer. In addition, the inorganic toner can prevent the polymer on the photoconductor surface from catching the toner and can, thus, contribute to the prevention of abrasion by deposition of toner.

The present inventors have thus found that the prevention of deterioration of a photoconductor surface by charging can improve the abrasion resistance thereof and have investigated various formulation of photoconductor surfaces applicable to various charging modes. As a result, the following findings have been obtained.

(1) Among various inorganic fillers, α-alumina exhibits high abrasion resistance and can improve the abrasion resistance of a photoconductor;

(2) Higher the filler content, the better becomes durability of the photoconductor. A filler content of at least 10% by weight based on a total weight of the photoconductive layer gives satisfactory abrasion resistance;

(3) The use of a binder having a weight average molecular weight of $4.0\times10^4$ or more in the filler-containing layer is effective to immobilize the filler and to improve abrasion resistance thereof;

(4) The large the thickness of a filler-containing protective layer, the better becomes durability of the photoconductor.

With regard to the electrostatic characteristics of photoconductors, the conventional proposals to incorporate an inorganic filler thereinto are not fully satisfactory. In particular, the conventional photoconductors cause a reduction of image contrast due to an increase of electric potential in a light-exposed surface. The present inventors have obtained the following findings as a result of studies with a view toward reducing the electric potential of light-exposed surfaces of photoconductors.

(1) When a filler contained in a photoconductor surface can impart light transmissivity thereto, an increase of the electric potential thereof upon being exposed to light is small. α-Alumina which has high abrasion resistance can improve the light transmissivity and is very effective;

(2) When a filler-containing layer further contains a charge transporting material or a charge generating material in a high concentration, an increase of the electric potential when exposed to light can be made small;

(3) An increase of the electric potential when exposed to light can be generally made smaller by incorporating a filler in a protective layer provided over a photoconductive layer as compared with by incorporating a filler uniformly in the photoconductive layer;

(4) When a filler-free photoconductive layer or charge transporting layer is overlaid with a filler-containing photoconductive layer or charge transporting layer, an increase of the electric potential when exposed to light can be made small. Such functional separation of the photoconductive layer or charge transporting layer can permit an increase of the filler content and of the thickness thereof;

(5) The ratio L/M of the thickness (L) of a filler-containing photoconductive layer to the thickness (M) of a filler-free photoconductive layer is desirably 0.0125–1 for reasons of ensuring good electrostatic characteristics. When the L/M ratio exceeds 1, accumulation of residual potential is generally not ignorable. Too small a L/M ratio of less than 0.0125 generally tends to cause a case where effect of improving durability is not significant. Similarly, the ratio N/P of the thickness (N) of a filler-containing charge transporting layer to the thickness (N) of a filler-free charge transporting layer is desirably 0.0125–0.67 for reasons of ensuring good electrostatic characteristics;

(6) Addition of an electric resistance reducing agent to a filler-containing layer can suppress an increase of the electric potential at a time of light exposure;

(7) A treatment of a filler to impart hydrophobicity can reduce the electric potential at a time of light exposure;

(8) Use of two or more charge transporting materials in combination may reduce the electric potential at a time of light exposure. In addition to improvement of the electrostatic characteristics, gas resistance, mechanical strengths and anti-cracking property may be improved by such a use;

(9) When two or more charge transporting materials are incorporated into a filler-containing or filler-free charge transporting layer and when a difference in ionization potential between them is 0.15 eV or less, an increase of the electric potential when exposed to light can be generally made small. When the difference is greater than 0.15 eV, the residual potential generally increases;

(10) When a difference in ionization potential between a charge transporting material contained in a filler-containing charge transporting layer and a charge transporting material contained in a filler-free charge transporting layer is 0.15 eV or less, an increase of the electric potential when exposed to light can be generally made small. When the difference is greater than 0.15 eV, the residual potential generally increases.

When a photoconductor surface has no light transmissivity, the surface can block light used for writing an image so that the charge generation may be insufficient. In such a case, the electric potential in the electrophotographic apparatus (e.g. electric potential at exposing section and residual electric potential) increases and, therefore, the thickness of the surface layer cannot be increased. In particular, when the light transmittance of the surface layer is less than 15% with respect to the light used for recording, the electric potential in the electrophotographic apparatus tends to increase.

When a filler is incorporated into a protective layer or a photoconductive layer, reflection, refraction and diffusion of incident light occur. Thus, it is desirable that the filler used be small in reflection and refraction. The use of α-alumina is advantageous in this regard, too.

When a charge transporting material and/or a charge generating material are contained in a surface protective layer in a large amount, the protective layer serves to act as a functioning layer showing photoconducting characteristics and can reduce electric potential when exposed to light. By imparting photoconductivity comparable to the conventional photoconductive layer to the surface protective layer, the thickness of the surface layer can be increased. Since the larger the amount of a filler contained in a photoconductive layer, the better becomes the abrasion resistance, it is possible to control the abrasion rate of the photoconductive layer to a desired level by control the thickness thereof and the amount of the filler contained therein. As a consequence, it becomes possible to prevent the occurrence of abnormal images by control of the abrasion rate.

When an electric resistance reducing agent is added to a filler-containing photoconductive layer to accelerate non-trapping of charge carriers or when a surface-modified filler is incorporated into a photoconductive layer to prevent trapping, it is possible to reduce electric potential thereof at a time of light exposure. The charge transporting material to be incorporated into a filler-containing photoconductive layer is desired to show high degree of charge mobility, particularly even in a low electric field region.

It is preferred that a difference in ionization potential between a charge transporting material contained in a filler-containing charge transporting layer and a charge transporting material contained in a filler-free charge transporting layer be small. When the difference in electric potential is large, the electric potential at the time of light exposure tends to increase. Probably, the charge transporting materials in the filler-containing and filler-free charge transporting layers diffuse into respective layers so that the charges are trapped thereby. For the same reason, it is preferred that a difference in ionization potential between two charge transporting materials incorporated into a filler-containing or filler-free charge transporting layer be small.

Next, prevention of a reduction of image resolution will be briefly described.

Abnormal images tend to appear when moistened paper is used. Such paper will cause deterioration of a resin of the photoconductor by oxidation and deposition of fouling matters on surfaces thereof. As a result, the electric resistance of the surfaces thereof decreases to cause deformation of images. It has been found that the use of α-alumina in a photoconductive layer can solve the formation of such abnormal images. Probably, α-alumina is low in degree of absorption of moisture contained in receiving papers.

BRIEF DESCRIPTION OF THE DRAWINGS

Other objects, features and advantages of the present invention will become apparent from the detailed description of the preferred embodiments of the invention which follows, when considered in light of the accompanying drawings, in which.

DETAILED DESCRIPTION OF THE PREFERRED EMBODIMENTS OF THE INVENTION

Figure 1:
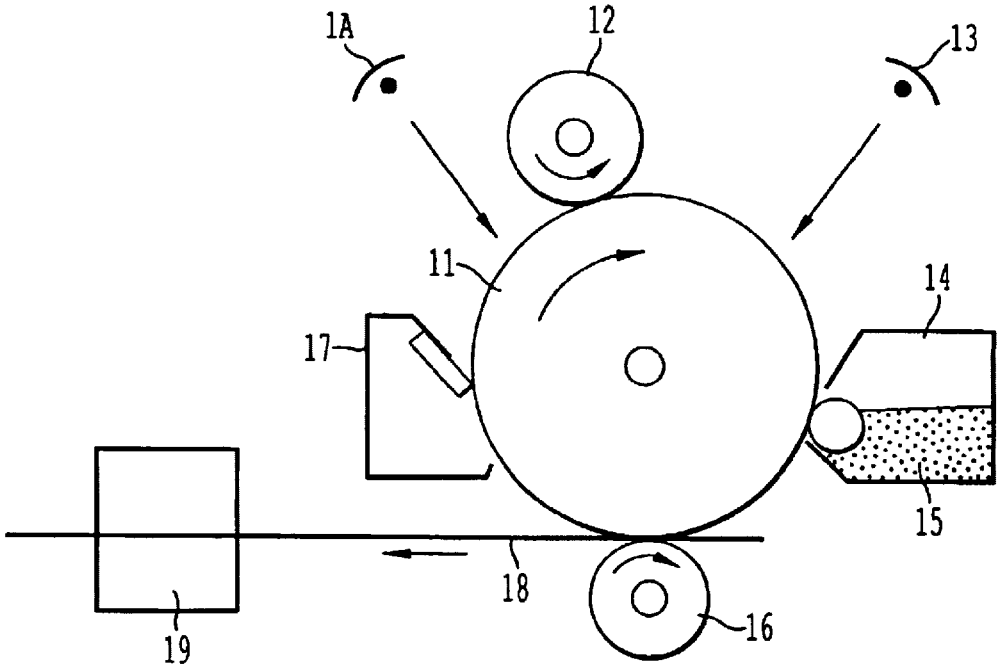
FIG. 1 is a sectional view diagrammatically illustrating one embodiment of an electrophotographic apparatus according to the present invention.

An electrophotographic photoconductor according to the present invention comprises an electroconductive support, and a photoconductive layer formed directly or through an undercoat layer on the support. The photoconductive layer comprises one or more charge transporting materials, one or more charge generating materials and an inorganic filler including α-alumina. It is important that the photoconductive layer have an outwardly facing surface and that the content of the inorganic filler in the photoconductive layer should decrease in the direction from the outwardly facing surface thereof to the opposite surface thereof.

The photoconductive layer can have various structures depending upon combinations of respective ingredients and amount thereof. Examples of photoconductors having typical layer constructions are shown in FIGS. 6–13 in which the same reference numerals designate similar component parts.

Figure 6:
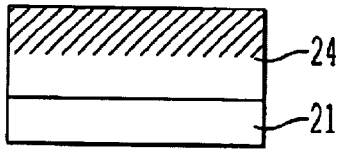
FIG. 6 is sectional view schematically illustrating an embodiment of a photoconductor according to the present invention.
Figure 7:
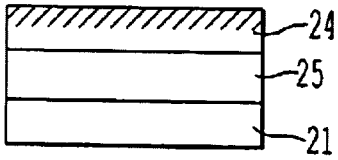
FIGS. 7–13 are sectional views schematically illustrating further embodiments of photoconductors according to the present invention.

Referring first to FIGS. 6 and 7, an electrophotographic photoconductor according to the present invention comprises an electroconductive support 21, and a photoconductive layer 24 formed directly (FIG. 6) or through an undercoat layer 25 (FIG. 7) on the support 21. The photoconductive layer 24 comprises one or more charge transporting materials, one or more charge generating materials and an inorganic filler including α-alumina. The content of the inorganic filler in the photoconductive layer 24 gradually continuously decreases from its outwardly facing surface to the opposite surface thereof as schematically illustrated by the shade change in FIGS. 6 and 7.

Figure 8:
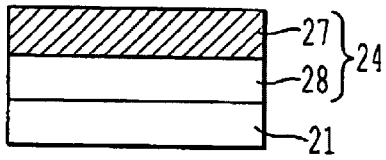

In the embodiment of FIG. 8, the photoconductive layer 24 is composed of an upper region 27 containing a charge transporting material, a charge generating material and an inorganic filler and a lower region 28 containing a charge transporting material and a charge generating material but having substantially no inorganic filler. The upper region 27 has a top surface which represents the outwardly facing surface of the photoconductive layer 24. The lower region 28 is contiguous with the upper region 27. The content of the inorganic filler in the photoconductive layer 24 thus decreases stepwise from its outwardly facing surface to the opposite surface thereof.

Figure 9:
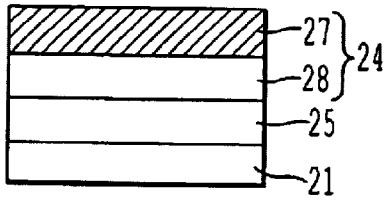

The embodiment of FIG. 9 differs from that of FIG. 8 in that an undercoat layer 25 is interposed between the photoconductive layer 24 and the conductive support 21 of FIG. 8.

Figure 10:
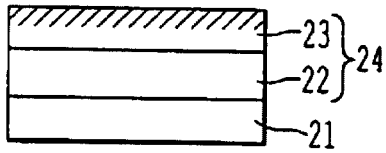

In the embodiment of FIG. 10, the photoconductive layer 24 is composed of a charge transporting layer 23 and a charge generating layer 22. The charge transporting layer 23 contains a charge transporting material and has an inorganic filler, while the charge generating layer 22 contains a charge generating material and has substantially no inorganic filler. The charge transporting layer 23 has a top surface which represents the outwardly facing surface of the photoconductive layer 24. The content of the inorganic filler in the photoconductive layer 24 gradually continuously decreases from its outwardly facing surface to the opposite surface thereof as schematically illustrated by the shade change in FIG. 10.

Figure 11:
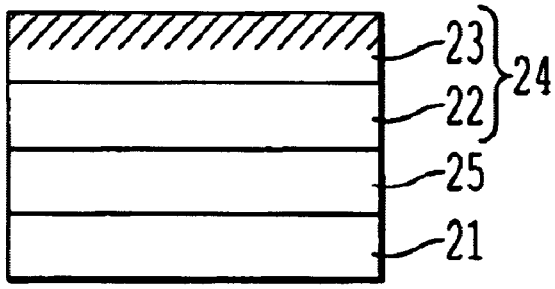

The embodiment of FIG. 11 differs from that of FIG. 10 in that an undercoat layer 25 is interposed between the photoconductive layer 24 and the conductive support 21 of FIG. 10.

Figure 12:
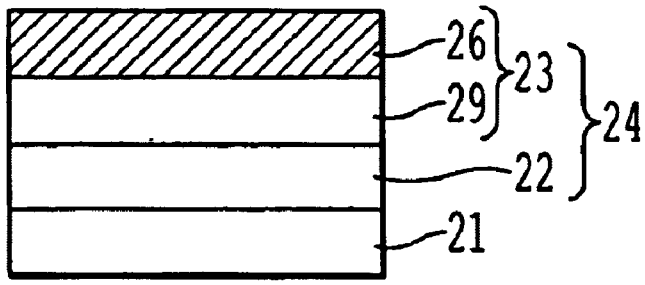

In the embodiment of FIG. 12, the photoconductive layer 24 includes a charge transporting layer 23 having a top surface representing the outwardly facing surface of the photoconductive layer 24, and a charge generating layer 22 contiguous with the charge transporting layer 23. The charge generating layer 22 contains a charge generating material and has substantially no inorganic filler. The charge transporting layer 23 comprises an upper region 26 including the outwardly facing surface and containing a charge transporting material and an inorganic filler, and a lower region 29 contiguous with the upper region 26. The lower region contains a charge transporting material but has substantially no inorganic filler. The content of the inorganic filler in the photoconductive layer 24 thus decreases stepwise from its outwardly facing surface to the opposite surface thereof.

Figure 13:
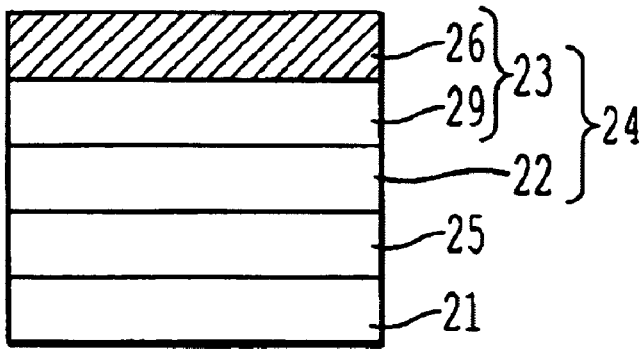

The embodiment of FIG. 13 differs from that of FIG. 12 in that an undercoat layer 25 is interposed between the photoconductive layer 24 and the conductive support 21 of FIG. 12.

As the electroconductive substrate 21 a material having a volume resistivity not greater than $10^{10}$ Ω. cm is suitably used. Specific examples of such materials include plastics or paper, which are sheet-shaped, drum-shaped and the like and which are coated with a metal such as aluminum, nickel, chromium, nichrome, copper, silver, gold, platinum and iron, or an oxide such as tin oxide and indium oxide, by an evaporation method or a sputtering method; a plate of a metal such as aluminum, aluminum alloys, nickel and stainless steel; and a drum of such a metal in which a primary drum is made by a method such as a Drawing Ironing method, an Impact Ironing method, an Extruded Ironing method, an Extruded Drawing method or a cutting method, and then the primary drum is subjected to surface treatment by cutting, super finishing, polishing or the like.

The photoconductive layer 24 may be a mix type photoconductive layer in which a charge generating material and a charge transporting material are homogeneously dispersed (as shown in FIGS. 6–9), or a lamination type photoconductive layer in which a charge generating material-containing layer and a charge transporting material-containing layer are superimposed one over the other (as shown in FIGS. 10–13).

Description will be first made of the lamination type photoconductive layer.

The charge generating layer 22, which is adapted to generate charges upon being exposed to light, contains a charge generating material as an essential ingredient and, if necessary, a binder resin. Suitable charge generating materials include inorganic materials and organic materials. Specific examples of inorganic charge generating materials include crystalline selenium, amorphous selenium, selenium-tellurium, selenium tellurium-halogen, selenium-arsenic compounds, amorphous silicon and the like. Amorphous silicon may one which has dangling bonds terminated with a hydrogen atom or a halogen atom, or which is doped with a boron atom or a phosphorus atom.

Specific examples of the organic charge generating materials include phthalocyanine pigments such as metal phthalocyanine and metal-free phthalocyanine, azulenium pigments, squaric acid methine pigments, azo pigments including a carbazole skeleton, azo pigments including a triphenylamine skeleton, azo pigments including a diphenylamine skeleton, azo pigments including a dibenzothiophene skeleton, azo pigments ncluding a fluorenone skeleton, azo pigments including an oxadiazole skeleton, azo pigments including a bisstilbene skeleton, azo pigments including a distyryloxadiazole skeleton, azo pigments including a distyrylcarbazole skeleton, perylene pigments, anthraquinone pigments, polycyclic quinone pigments, quinoneimine pigments, diphenyl methane pigments, triphenyl methane pigments, benzoquinone pigments, naphthoquinone pigments, cyanine pigments, azomethine pigments, indigoid pigments and bisbenzimidazole. These charge transporting materials can be used alone or in combination.

Suitable binder resins, which are optionally used in the charge generating layer 22, include polyamide resins, poly urethane resins, epoxy resins, polyketone resins, polycarbonate resins, polyarylate resins, silicone resins, acrylic resins, polyvinyl butyral resins, polyvinyl formal resins, polyvinyl ketone resins, polystyrene resins, poly-N-vinylcarbazole resins and polyacrylamide resins. The charge transporting polymer materials mentioned above can also be used as a binder resin in the charge generating layer 22. If desired, a low molecular weight charge transporting material can also be added in the charge generating layer 22.

The charge transporting materials for use in the charge generating layer 22 include positive hole transporting materials and electron transporting materials. Also, the charge transporting materials may be classified into low molecular weight type charge transporting materials and high molecular weight type charge transporting materials (charge transporting polymer materials).

Suitable low molecular weight charge transporting materials for use in the charge generating layer 22 include positive hole transporting materials and electron transporting materials. Specific examples of such electron transporting materials include electron accepting materials such as chloranil, bromanil, tetracyanoethylene, tetracyanoquinodimethane, 2,4,7-trinitro-9-fluorenone, 2,4,5,7-tetranitro-9-fluorenone, 2,4,5,7-tetranitro-xanthone, 2,4,8-trinitrothioxanthone, 2,6,8-trinitro-4H-indeno[1,2-]thiophene-4-one and 1,3,7- trinitrobenzothiophene-5,5-dioxide. These electron transporting materials can be used alone or in combination.

Specific examples of positive hole transporting materials include electron donating materials such as oxazole derivatives, oxadiazole derivatives, imidazole derivatives, triphenylamine derivatives, 9-(p-diethylaminostyrylanthracene), 1,1-bis(4-dibenzylaminophenyl) propane, styrylanthracene, styrylpyrazoline, phenylhydrazone compounds, α-phenylstilbene derivatives, thiazole derivatives, triazole derivatives, phenazine derivatives, acridine derivatives, benzofuran derivatives, benzimidazole derivatives and thiophene derivatives. These positive hole transporting materials can be used alone or in combination.

The following known polymers can be used as a charge transporting polymer material:

(a) polymers having a carbazole ring such as poly-N-vinyl carbazole, polymers having a hydrazone structure as disclosed in Japanese Laid-Open Patent Publication No. 57-78402, (c) polysilylene compounds as disclosed in Japanese Laid-Open Patent Publications Nos. 63-285552, and (d) aromatic polycarbonates as disclosed in Japanese Laid-Open Patent Publications Nos. 8-269183, 9-151248, 9-71642, 9-104746, 9-328539, 9-272735, 9-241369, 11-29634, 11-5836, 11-71453, 9-221544, 9-227669, 9-157378, 9-302084, 9-302085, 9-268226, 9-235367, 9-87376, 9-110976 and 2000-38442.

These charge transporting polymer materials may be used alone or in combination.

The charge generating layer 22 may be prepared by a thin film forming method in a vacuum and a casting method using a solution or dispersion. Specific examples of such thin film forming methods in a vacuum include vacuum evaporation methods, glow discharge decomposition methods, ion plating methods, sputtering methods, reaction sputtering methods and CVD (chemical vapor deposition) methods. Both inorganic and organic charge generation materials may be used as raw materials.

The coating method may include mixing one or more inorganic or organic charge generating materials mentioned above with a solvent such as tetrahydrofuran, cyclohexanone, dioxane, dichloroethane or butanone, and if necessary, together with a binder resin and an additives with a ball mill, an attritor or a sand mill to obtain a dispersion. The dispersion is diluted and applied to a surface to be coated by a dip coating method, a spray coating method, a bead coating method or a ring coating method, followed by drying, thereby to form a charge generating layer.

The thickness of the charge generating layer 22 is preferably from about 0.01 to about 5 μm, more preferably from about 0.05 to about 2 μm.

Next, the charge transporting layer 23 is explained. The charge transporting layer 23, which is adapted to receive charge carriers injected from the charge generating layer and to transport the charge carriers for neutralization of charges on the surface of the photoconductor, is a layer containing a charge transporting material, an inorganic filler comprising α-alumina and a binder resin.

The charge transporting layer 23 may be of a single layer structure as shown in FIGS. 10 and 11 or a multi-layer structure as shown in FIGS. 12 and 13. The former, single layer-type charge transporting layer 23 will be first described next.

The single layer-type charge transporting layer 23 as shown in FIG. 10 contains a charge transporting polymer material, an inorganic filler including α-alumina and a binder resin.

The binder resin may be a thermoplastic resin or a thermosetting resin. Specific examples of such binder resins include polystyrene resins, styrene-acrylonitrile copolymers, styrene-butadiene copolymers, styrene-maleic anhydride copolymers, polyester resins, polyvinyl chloride resins, vinyl chloride-vinyl acetate copolymers, polyvinyl acetate resins, polyvinylidene chloride resins, polyarylate resins, polycarbonate resins, cellulose acetate resins, ethylcellulose resins, polyvinyl butyral resins, polyvinyl formal resins, polyvinyl toluene resins, acrylic resins, silicone resins, fluorine-containing resins, epoxy resins, melamine resins, urethane resins, phenolic resins and alkyd resins, but are not limited thereto. These polymers may be used alone or in combination of two or more thereof as a mixture. Further, the binder resin may be copolymerized with a charge transporting compound. For reasons of excellent transparency, filler-binding properties and mechanical strengths, the use of polycarbonate resins, polyester resins polyarylate resins and polyester resins is preferred.

The charge transporting materials for use in the charge transporting layer 23 include positive hole transporting materials and electron transporting materials. Also, the charge transporting materials may be classified into low molecular weight type charge transporting materials and high molecular weight type charge transporting materials (charge transporting polymer materials).

Suitable low molecular weight charge transporting materials for use in the charge generating layer 23 include positive hole transporting materials and electron transporting materials. Specific examples of such electron transporting materials include electron accepting materials such as chloranil, bromanil, tetracyanoethylene, tetracyanoquinodimethane, 2,4,7-trinitro-9-fluorenone, 2,4,5,7-tetranitro-9-fluorenone, 2,4,5,7-tetranitro-xanthone, 2,4,8-trinitrothioxanthone, 2,6,8-trinitro-4H-indeno [1,2-b ]thiophene-4-one and 1,3,7-trinitrobenzothiophene-5,5-dioxide. These electron transporting materials can be used alone or in combination.

Specific examples of positive hole transporting materials include electron donating materials such as oxazole derivatives, oxadiazole derivatives, imidazole derivatives, triphenylamine derivatives, 9-(p-diethylaminostyrylanthracene), 1,1-bis(4-dibenzylaminophenyl)propane, styrylanthracene, styrylpyrazoline, phenylhydrazone compounds, α-phenylstilbene derivatives, thiazole derivatives, triazole derivatives, phenazine derivatives, acridine derivatives, benzofuran derivatives, benzimidazole derivatives and thiophene derivatives. These positive hole transporting materials can be used alone or in combination.

The following known polymers can be used as a charge transporting polymer material:

(a) polymers having a carbazole ring such as poly-N-vinyl carbazole, polymers having a hydrazone structure as disclosed in Japanese Laid-Open Patent Publication No. 57-78402, (c) polysilylene compounds as disclosed in Japanese Laid-Open Patent Publications Nos. 63-285552, and (d) aromatic polycarbonates as disclosed in Japanese Laid-Open Patent Publications Nos. 8-269183, 9-151248, 9-71642, 9-104746, 9-328539, 9-272735, 9-241369, 11-29634, 11-5836, 11-71453, 9-221544, 9-227669, 9-157378, 9-302084, 9-302085, 9-268226, 9-235367, 9-87376, 9-110976 and 2000-38442.

These charge transporting polymer materials may be used alone or in combination.

When two or more charge transporting materials are incorporated into the filler-containing charge transporting layer 23, it is preferred that a difference in ionization potential between them be 0.15 eV or less for reasons that one of them would not act as a charge trap material for the other.

It is also preferred that the charge transporting layer 23 show a high charge mobility and that the charge mobility be high even in a low electric field for reasons of high sensitivity. In particular, it is desired that the charge transporting layer provide charge mobility of at least $1.2\times10^{-5}$ $cm^2/V\cdot sec$ at an electric field of $4\times10^5$ V/cm and have electric field dependency β of $1.6\times10^{-3}$ or less. The electric field dependency β is defined by the following formula:

$$\beta=\log(\mu)/E^{1/2}$$

where $\mu$ represents charge mobility in $cm^2/V\cdot sec$ of the transporting layer at an electric field E in V/cm.

Figure 15:
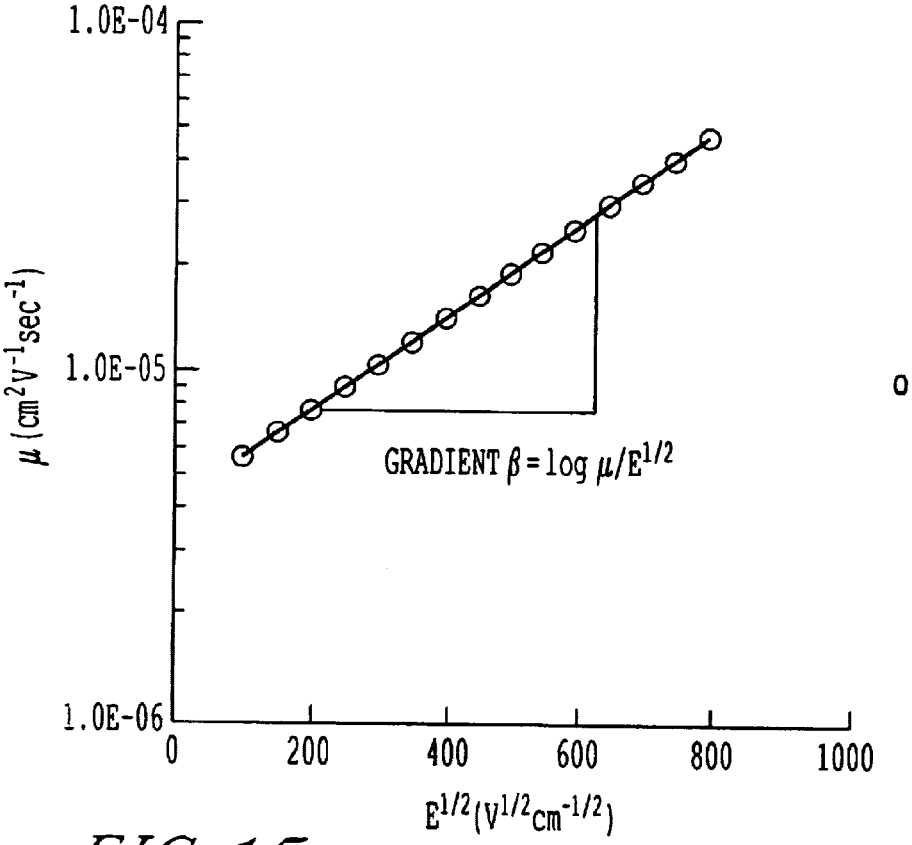
FIG. 15 is a graph showing electric filed dependency of a charge transferring layer upon charge mobility.

The electric field dependency β may be measured as follows. Charge mobility $\mu$ ($cm^2/V\cdot sec$) is measured at various electric field intensities E (V/cm). The measured values are plotted as shown in FIG. 15 in which the abscissa stands for $E^{1/2}$ and the ordinate for log $\mu$. An approximation line is drawn on the plots. The slope of the approximation line represents the electric field dependency β. When the electric field dependency β is great, the charge mobility becomes low at a low electric field region to cause an increase of the residual potential and a reduction of responsibility at a low charging mode.

For reasons of obtaining high responsibility, it is desirable that the charge transporting material be used in an amount of at least 70 parts by weight per 100 parts by weight of the binder resin.

The inorganic filler must contain α-alumina and the amount α-alumina is preferably at least 50% by weight based on the weight of the inorganic filler. The inorganic filler other than α-alumina may be, for example, inorganic crystals having a hexagonal close-packed lattice crystal structure similar to that of α-alumina. Illustrative of such inorganic fillers are beryllium oxide, high temperature quartz, zinc oxide and w-boron nitride. Other inorganic fillers such as titanium oxide (monoclinic system, tetragonal system, orthorhombic system, triclinic system), γ-alumina (cubic system), η-alumina (cubic system), δ-alumina (orthorhombic system), χ-alumina (tesseral system), κ-alumina (orthorhombic system), θ-alumina (monoclinic system), silica (triclinic system, orthorhombic system, tetragonal system, cubic system, monoclinic system), zirconium oxide (monoclinic system, tetragonal system), tin oxide (tetragonal system, orthorhombic system, cubic system), indium oxide (cubic system), antimony oxide (orthorhombic system, cubic system), magnesium oxide (cubic system), c-boron nitride (cubic system), calcium oxide (cubic system) and barium sulfate (orthbrhombic system).

One of the features of the present invention resides in the use of α-alumina as an inorganic filler. α-Alumina which has a high Moh' hardness can impart improved abrasion resistance to the charge transporting layer 23. α-Alumina which has high transparency provides good electrostatic characteristics and permits an increase of the amount of the filler and/or an increase of the thickness of the charge transporting layer 23, thereby improving the abrasion resistance thereof. Additionally, α-alumina is stable against a change of temperature and humidity so that the resulting photoconductor can prevent occurrence of abnormal images attributed to a humidity increase. Therefore, the electrophotographic apparatus using the photoconductor according to the present invention does not require heating means such as a drum heater and can be designed as a compact machine and can contribute to cost down.

It is particularly preferred that the α-alumina be in the form of particles having (a) a polyhedral shape (generally octahedral or higher), (b) a hexagonal close-packed lattice crystal structure and (c) a D/H ratio of from 0.5–5.0 wherein D represents a maximum particle diameter parallel to a hexagonal lattice plane of said hexagonal close-packed lattice and H represents a diameter perpendicular to said hexagonal lattice plane. The α-alumina particles preferably have substantially no cracked surfaces.

Figure 14:
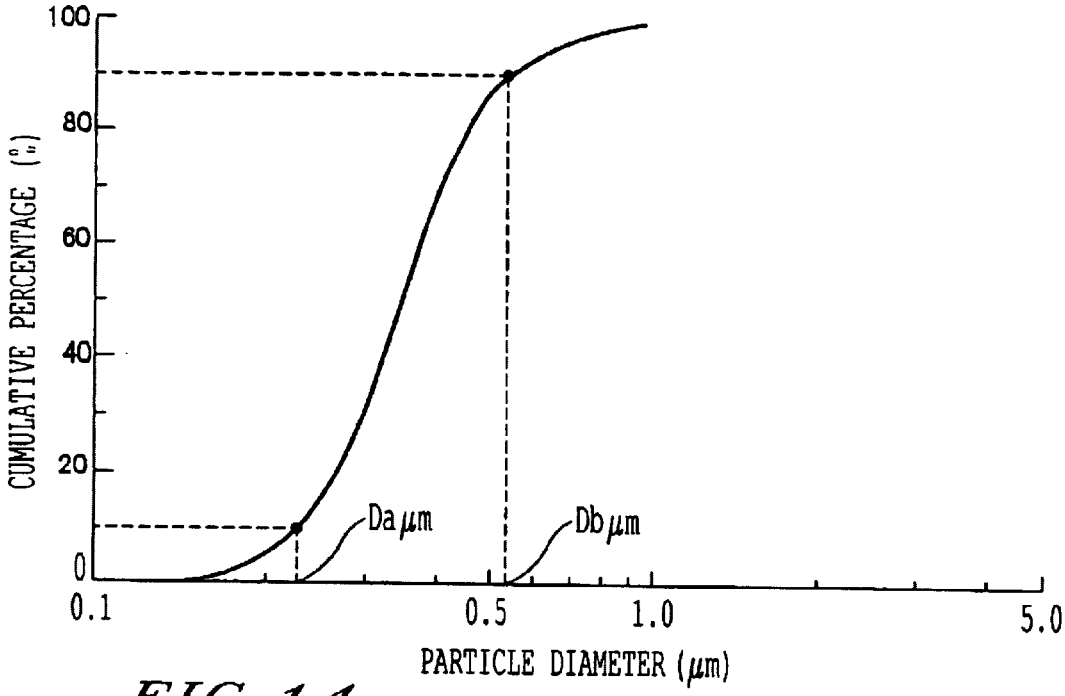
FIG. 14 is a graph showing a particle size distribution of a filler.

It is further preferred that the above α-alumina particles have a volume average particle diameter of at least 0.1 μm but less than 0.7 μm and a Db/Da ratio of 5 or less wherein Da and Db represent a cumulative 10% diameter and a cumulative 90% diameter, respectively, of a cumulative distribution depicted from the small diameter side. As shown in FIG. 14, the cumulative 10% diameter Da represents such a particle diameter that 10% by weight of the particles have a particle diameter of not greater than Da and the cumulative 90% diameter Db represents such a particle diameter that 90% by weight of the particles have a particle diameter of not greater than Db.

Since cracked surfaces of α-alumina may trap charges, the use of α-alumina having a large area of cracked surfaces may increase chances of charge trapping. Too large a D/H ratio results in distortion of the shape of α-alumina and, therefore, when such α-alumina is used in a large amount, part of the α-alumina particles may protrude from the surface of the charge transporting layer 23 so that highly smooth surface may not be obtained. When Db/Da ratio is outside the above described range, the particle diameter distribution becomes broad and a difficulty may be experienced in obtaining a smooth surface photoconductor.

The α-alumina which satisfy the above conditions can be prepared by, for example, a method disclosed in Japanese Laid-Open Patent Publications 6-191833 and 6-191836. For example, the α-alumina may be suitably prepared from transition alumina or a raw material capable of being converted to transition alumina by calcination in an atmosphere containing hydrogen chloride gas. This process can produce α-alumina having high purity of 99.99 or more. On the other hand, α-alumina obtained by Bayer process is apt to be cracked during grinding and is less preferred.

The inorganic filler used in the present invention may be modified with a surface treating agent for improving dispersion thereof in a coating liquid or in a coated layer. Illustrative of suitable surface treating agents are silane coupling agents, silazane, titanate coupling agents, aluminum coupling agents, zircoaluminum coupling agents, organozirconium compounds and fatty acids. Surface treatment with an inorganic substance such as alumina, zirconia, tin oxide or silica may also be adopted. Above all, treatment with a fatty acid or a silane coupling agent is preferable for reasons of contribution to a reduction of residual potential as well as improved dispersing properties. Methods of surface treating the inorganic filler include modification by coating, modification by mechanochemical procedures, modification utilizing a topochemical method, modification using a capsulation method, modification utilizing high energy and modification by precipitation.

The inorganic filler may be used in conjunction with an electric resistance reducing agent for the purpose of further reducing residual potential or electric potential at light-exposed surfaces. Examples of the electric resistance reducing agents include polyhydric alcohols partially esterified with a fatty acid (e.g. sorbitan monofatty acid ester and pentaerythritol fatty acid ester), ethylene oxide adducts of fatty alcohols, ethylene oxide adducts of fatty acids, ethylene oxide adducts of alkylphenols, ethylene oxide adducts of polyhydric alcohols partially esterified with a fatty acid and carboxylic acid derivatives. These compounds may be used alone or in combination of two or more. The electric resistance reducing agent is suitably used in an amount of 0.5–10 parts by weight per 100 parts by weight of the inorganic filler. An amount of the electric resistance reducing agent below 0.5 part by weight is insufficient to obtain the effect of the addition thereof.

The inorganic filler may be ground or dispersed using, for example, a ball mill, a sand mill, a KD mill, a three-roll mill, a pressure-type homogenizer or ultrasonic dispersion. When the inorganic filler particles contain a large amount of large particles, part of such a large particle may protrude from the surface of the charge transporting layer 23 to cause injury of a cleaning means. Thus, it is preferred that the pulverization be performed so that the ground filler has a volume average particle diameter of less than 0.7 μm. However, when the filler is excessively ground, the ground filler particles are apt to aggregate to form large particles. Thus, the average particle diameter of the filler is preferably 0.1 μm or more.

The amount of the inorganic filler in the charge transporting layer 23 is preferably at least 10% by weight based on the weight of the charge transporting layer for reasons of improved abrasion resistance. The upper limit of the amount of the inorganic filler is preferably 50% by weight for reasons of smoothness of the surface of the charge transporting layer 23.

Hitherto, when an inorganic filler is present in an amount of over 10% by weight in a photoconductive layer, the photoconductor generally fails to work well because the sensitivity thereof considerably reduces and residual potential becomes high. In contrast, in the case of the present invention in which the concentration of the inorganic filler is high in an outer surface region but is low in a region on the conductive support side, high abrasion resistance of the photoconductive layer may be attained without causing deterioration of the electrostatic characteristics thereof.

It is preferred that the thickness (depth) of that region of the charge transporting layer 23 which has an outwardly facing surface of the photoconductive layer 24 and which contains the inorganic filler be 0.5 μm or more for reasons of improved durability. When the thickness of the upper region is 2 μm or more, the durability of the photoconductor is fully satisfactory and, therefore, a thickness of the filler-containing region of 2 μm or more is more preferred. Since no additional advantage is obtainable when the thickness of the filler-containing upper region is over 10 μm, this amount represents the preferred upper limit from the standpoint of costs. It is also preferred that the ratio N/P of the thickness (N) of the filler-containing upper region to the thickness (P) of the remainder lower region containing substantially no inorganic filler of the charge transporting layer 23 be in the range of 0.125–0.67 for reasons of high abrasion resistance and satisfactory electrostatic characteristics.

If desired, the charge transporting layer 23 may contain one or more low molecular weight additives such as an anti-oxidation agent, a plasticizer, a lubricant and a UV absorbing agent. A leveling agent may also be incorporated into the charge transporting layer 23. The amount of the low molecular weight additives is generally 0.1–50 parts by weight per 100 parts by weight of the polymeric substances (binder resin and/or charge transporting polymer material) contained in the charge transporting layer 23, while the amount of the leveling agent is generally 0.001–5 parts by weight per 100 parts by weight of the polymeric substances contained in the charge transporting layer 23.

The charge transporting layer 23 as shown in FIG. 10 may be prepared by, for example, a method disclosed in Yasuyuki KAMITOSHI, Masayuki SHIMADA, Tomohiro KOGA, Yoshitsumi KAWASAKI, Polymer Preprints, Japan, 46, No. 11, p2689, 1997. In this method, a first coating liquid containing no inorganic filler is applied to a surface to e coated, such as a charge generation layer to form a first coating. Then, a second coating liquid containing an inorganic filler is applied to the first coating while maintaining the first coating at a temperature higher than the boiling point of the solvent used as a dispersing medium to form a second coating. The thus obtained coated layer has a high filler concentration at an upper region and has not a clear interface between the first and second coatings such that there is a gradient in the filler concentration in the thickness direction of the coated layer.

A coating liquid for the formation of the charge generating layer 23 may be applied using, for example, an immersion method, a spray coating method, a ring coating method, a roll coating method, a gravure coating method, a nozzle coating method or a screen coating method. A spray coating method is preferably adopted since the aggregation of fillers during coating may be easily prevented.

Solvents or dispersion media for forming the coating liquid may be, for example, ketones such as methyl ethyl ketone, acetone, methyl isobutyl ketone and cyclohexanone; ethers such as adioxane, tetrahydrofuran and ethyl cellosolve; aromatic solvents such as toluene and xylene; halogenated hydrocarbons such as chlorobenzene and dichloromethane; and esters such as ethyl acetate and butyl acetate. These solvents may be used alone or in combination.

The thickness of the charge transporting layer 23 is suitably 15–40 μm, more preferably 15–30 μm. High resolution is obtainable when the thickness of the charge transporting layer is 25 μm or less.

While, in the foregoing description, the photoconductive layer 23 shown in FIG. 10 in which the concentration of the inorganic filler gradually decreases continuously from the outer surface thereof to the opposite surface thereof is referred to as being of a single layer-type, such a layer may also be said to be a laminate of a large number of layers having inorganic filler concentrations decreasing from the top to the bottom.

Description will be next made of the charge transporting layer 23 of a two-layer structure as shown in FIGS. 12 and 13.

The charge transporting layer 23 of FIG. 12 includes an upper region or layer 26 having a top surface which represents the outwardly facing surface of the photoconductive layer 24 and containing a charge transporting material and an inorganic filler including α-alumina, and a lower region or layer 29 contiguous with the upper region or layer 26 and having substantially no inorganic filler.

The term "region or layer having substantially no inorganic filler" as used in the present specification and claims is typically intended to refer a layer having a content of an inorganic filler of less than 10% by weight based on the weight of the layer. However, depending upon the method of fabrication, the inorganic filler may be present therein in an amount of 10% or more, although not intentionally. Thus, a charge transporting layer 23 which comprises a lower region or layer 29, and an upper region or layer 26 contiguous with the lower region or layer 29 and in which the content (in weight %) of an inorganic filler in the upper region or layer 26 is higher than that in the lower region or layer 29 is to be understood as being within the scope of the present invention.

The lower layer 29 may be prepared by applying a coating liquid containing a charge transporting layer and a binder resin over a surface to be coated, such as a charge generating layer 22, using, for example, an immersion method, a spray coating method, a ring coating method, a roll coating method, a gravure coating method, a nozzle coating method or a screen coating method. Solvents or dispersion media for forming the coating liquid may be those described above with reference to the coating liquid for the formation of the charge transporting layer 23, such as ketones, ethers, aromatic hydrocarbons, halogenated hydrocarbons and esters. These solvents may be used alone or in combination.

The thickness of the lower layer 29 is suitably 15–40 μm, more preferably 15–30 μm. High resolution is obtainable when the thickness of the charge transporting. layer is 25 μm or less. Since the lower layer 29 is overlaid with the upper layer 26, it is possible to reduce the thickness of the lower layer 29, if desired.

The binder resin used in the lower layer 29 may be selected from those described above with reference to the charge transporting layer 23. A mixture of two or more of resins or a copolymer of a resin with a copolymerizable charge transporting compound may be used. For reasons of transparency, the use of polycarbonate, polyester or polyarylate is preferred. Since the lower layer 29 is overlaid with the upper layer 26, it is possible to use such a resin as polystyrene which has high transparency but is low in mechanical strengths and which has thus not been employed hitherto.

The charge transporting material used in the lower layer 29 may be selected from those described above with reference to the charge transporting layer 23. Thus, a low molecular weight electron transporting substance or a positive hole transporting substance, or a charge transporting polymer material may be suitably used. The low molecular weight charge transporting material is generally used in an amount of 40–200 parts by weight, preferably 50–100 parts by weight, per 100 parts by weight of the binder. The charge transporting polymer material is suitably a copolymer in which a resin is copolymerized with a charge transporting compound in an amount of 0–200 parts by weight, preferably 80–150 parts by weight, per 100 parts by weight of the charge transporting compound.

When the charge transporting material contained in the lower layer 29 differs from that in the upper layer 26, it is desirable that the difference in ionization potential therebetween be small, in particular 0.15 eV or less. Further, when two or more different charge transporting materials are used in the lower layer 29, it is desirable that the difference in ionization potential therebetween be small, in particular 0.15 eV or less.

It is also preferred that the lower layer 29 show a high charge mobility and that the charge mobility be high even in a low electric field for reasons of high sensitivity for reasons of high responsibility. In particular, it is desired that the charge transporting layer provide charge mobility of at least $1.2\times10^{-5}$ $cm^2/V\cdot sec$ at an electric field of $4\times10^5$ V/cm and have electric field dependency β of $1.6\times10^{-3}$ or less. The electric field dependency β is as defined above. The charge transporting material is preferably used in an amount of at least 60 parts by weight per 100 parts by weight of the binder for this purpose.

If desired, the lower layer 29 may contain one or more low molecular weight additives such as an anti-oxidation agent, a plasticizer, a lubricant and a UV absorbing agent. A leveling agent may also be incorporated into the lower layer 29. The amount of the low molecular weight additives is generally 0.1–50 parts by weight, preferably 0.1–20 parts by weight, per 100 parts by weight of the polymeric substances (binder resin and/or charge transporting polymer material) contained in the lower layer 29, while the amount of the leveling agent is generally 0.001×5 parts by weight per 100 parts by weight of the polymeric substances contained in the lower layer 29.

The upper layer 26, which constitutes part of the charge transporting layer 23, includes a charge transporting material, an inorganic filler and a binder resin. Because of its charge transporting property comparable to the conventional charge transporting layer, the upper layer 26 is distinguished from a protecting layer provided on a charge transporting layer. Further, because of its high abrasion resistance, the upper layer 26 is distinguished from the conventional charge transporting layer in which a filler is uniformly dispersed.

It is preferred that the thickness of the upper layer 26 be 0.5 μm or more for reasons of improved durability. When the thickness of the upper region is 2 μm or more, the durability of the photoconductor is fully satisfactory and, therefore, a thickness of the filler-containing region of 2 μm or more is more preferred. Since no additional advantage is obtainable when the thickness of the filler-containing upper region is over 10 μm, this amount represents the preferred upper limit from the standpoint of costs. It is also preferred that the ratio N/P of the thickness (N) of the filler-containing upper layer 26 to the thickness (P) of the lower layer containing substantially no inorganic filler be in the range of 0.125–0.67 for reasons of high abrasion resistance and satisfactory electrostatic characteristics.

Although the filler-containing upper layer 26 has such a large thickness as above, neither a reduction of the sensitivity nor an increase of the residual potential occurs because of the presence of the lower layer 29.

The upper layer 26 may be prepared by applying a coating liquid containing a charge transporting layer, an inorganic filler and a binder resin over the lower layer 29, using, for example, an immersion method, a spray coating method, a ring coating method, a roll coating method, a gravure coating method, a nozzle coating method or a screen coating method. Spray coating and nozzle coating are preferably adopted for reasons of easiness in obtaining stability in quality of the layer. Dispersion media for forming the coating liquid may be those described above with reference to the coating liquid for the formation of the charge transporting layer 23, such as ketones, ethers, aromatic hydrocarbons, halogenated hydrocarbons and esters. These solvents may be used alone or in combination.

The binder resin used in the upper layer 26 may be selected from those described above with reference to the charge transporting layer 23. A mixture of two or more of resins or a copolymer of a resin with a copolymerizable charge transporting compound may be used. For reasons of transparency, high mechanical strengths and good binding performance for an inorganic filler, the use of polycarbonate, polyester or polyarylate is preferred.

The inorganic filler described above with reference to the charge transporting layer 23 may be used in the upper layer 26. Thus, it is important that the inorganic filler should comprise $\alpha$-alumina.

The inorganic filler used in the present invention may be modified with a surface treating agent for improving dispersion thereof in a coating liquid or in a coated layer, as described previously.

Also, the inorganic filler may be used in conjunction with one or more electric resistance reducing agents for the purpose of further reducing residual potential or electric potential at light-exposed surfaces, as described previously. The electric resistance reducing agent is suitably used in an amount of 0.5–10 parts by weight per 100 parts by weight of the inorganic filler. An amount of the electric resistance reducing agent below 0.5 part by weight is insufficient to obtain the effect of the addition thereof.

The inorganic filler may be ground or dispersed using, for example, a ball mill, a sand mill, a KD mill, a three-roll mill, a pressure-type homogenizer or ultrasonic dispersion. When the inorganic filler particles contain a large amount of large particles, part of such a large particle may protrude from the surface of the upper layer 26 to cause injury of a cleaning means. Thus, it is preferred that the pulverization be performed so that the ground filler has a volume average particle diameter of less than 0.7 $\mu$m. However, when the filler is excessively ground, the ground filler particles are apt to aggregate to form large particles. Thus, the volume average particle diameter of the filler is preferably 0.1 $\mu$m or more.

The average particle diameter and particle size distribution of the inorganic filler used in the upper layer 26 may be as described previously with reference to the charge transporting layer 23.

The amount of the inorganic filler in the upper layer 26 is preferably at least 10% by weight based on the weight of the upper layer for reasons of improved abrasion resistance. The upper limit of the amount of the inorganic filler is preferably 50% by weight for reasons of smoothness of the surface of the charge transporting layer 23. Hitherto, when an inorganic filler is present in an amount of over 10% by weight in a photoconductive layer, the photoconductor generally fails to work well because the sensitivity thereof considerably reduces and residual potential becomes high. In contrast, in the case of the present invention in which the concentration of the inorganic filler is high in an upper surface region but is low in a region on the conductive support side, high abrasion resistance of the photoconductive layer may be attained without causing deterioration of the electrostatic characteristics thereof.

The kind and amount of the charge transporting material used in the upper layer may be the same as those described previously with reference to the charge transporting layer 23.

When the charge transporting material contained in the upper layer 26 differs from that in the lower layer 29, it is desirable that the difference in ionization potential therebetween be small, in particular 0.15 eV or less. Further, when two or more different charge transporting materials are used in the upper layer 26, it is desirable that the difference in ionization potential therebetween be small, in particular 0.15 eV or less.

It is also preferred that the upper layer 26 show a high charge mobility and that the charge mobility be high even in a low electric field for reasons of high sensitivity for reasons of high responsibility. The upper layer 26 preferably has charge mobility of at least $1.2\times10^{-5}$ $cm^2/V\cdot sec$ at an electric field of $4\times10^5$ V/cm and an electric field dependency $\beta$ of $1.6\times10^{-3}$ or less.

If desired, the upper layer 26 may contain one or more low molecular weight additives such as an anti-oxidation agent, a plasticizer, a lubricant and a UV absorbing agent. A leveling agent may also be incorporated into the upper layer 26. The amount of the low molecular weight additives is generally 0.1–50 parts by weight, preferably 0.1–20 parts by weight, per 100 parts by weight of the polymeric substances (binder resin and/or charge transporting polymer material) contained in the upper layer 26, while the amount of the leveling agent is generally 0.001–5 parts by weight per 100 parts by eight of the polymeric substances contained in the upper layer 26.

In actual, the interface between the upper layer 26 and the lower layer 29 is not clear microscopically. Absence of a clear interface is rather preferred, since the interlayer bonding strength therebetween is improved. An improvement of the interlayer bonding strength is especially important when the photoconductor is in the form of a drum having a reduced diameter, namely, when a compact electrophotoconductive apparatus is designed. Such an absence of a clear interface between the upper and lower layers is also desirable for reasons of absence of electric barrier and, thus, prevention of an increase in the electric potential at the time of light exposure. The thickness of the upper layer 26 when a clear interface is not present is a depth of the filler containing region.

The depth or thickness of the filler-containing region or layer from the upper surface thereof is measured by scanning electron micrograph (SEM) analysis. The thickness is measured at 20 different locations spaced equidistant from each other with an equidistance spacing of 5 $\mu$m on a SEM photograph of a cross-section of the photoconductive layer. The average thickness represents the depth or thickness of the upper layer. It is preferred that the depth of the filler-containing region be not significantly varied throughout the area thereof. In particular, it is preferred that the standard deviation of measured thickness values be not greater than 0.4, more preferably not greater than 0.25, of an average of the measured thickness values.

One preferred method of forming the upper layer 26 is to use a coating liquid therefor that meets with the following two conditions:

(1) the binder resin of the upper layer is highly soluble in the solvent (dispersing medium) used in the coating liquid;

(2) the weight W1 of a coating of the coating liquid 1 hour after completion of the coating and the weight Wd of the coating after being completely dried with heating satisfy the following relationship:

$1.2<W1/Wd<2.0$.

Description will now be made of the mix type photoconductive layer in which a charge generating material and a charge transporting material are homogeneously dispersed (as shown in FIGS. 6–9). The mix type photoconductive layer 24 may be of a single layer structure as shown in FIGS. 6 and 7 or a multi-layer structure as shown in FIGS. 8 and 9. The thickness of the photoconductive layer 24 is generally 10–50 μm, preferably 10–40 μm.

The single layer-type photoconductive layer 24 as shown in FIG. 6 may be prepared by applying a coating liquid containing a charge transporting material, a charge generating material, an inorganic filler and a binder resin dispersed in a solvent over a surface to be coated such as a conductive support, and drying the coating. The photoconductive layer 24 in which the concentration of the inorganic filler gradually decreases continuously may be prepared by, for example, a method previously described with reference to the formation of the charge transporting layer 23 of FIG. 10.

The binder resin, charge transporting material, charge generating material and inorganic filler used in the photoconductive layer 24 are the same as those described previously with regard to the charge transporting layer 23 and the charge generation layer 22. The solvents used for the fabrication of the photoconductive layer 24 are the same as those described previously with regard to the charge transporting layer 23. The mix type photoconductive layer 24 may contain additives such as an anti-oxidation agent, a plasticizer, a lubricant, a UV-absorbing agent and a leveling agent, similar to the charge transporting layer 23.

It is preferred that the thickness (depth) of that region of the photoconductive layer 24 which has an outwardly facing surface and which contains the inorganic filler be 0.5 μm or more for reasons of improved durability. When the thickness of the upper region is 2 μm or more, the durability of the photoconductor is fully satisfactory and, therefore, a thickness of the filler-containing region of 2 μm or more is more preferred. Since no additional advantage is obtainable when the thickness of the filler-containing upper region is over 10 μm, this amount represents the preferred upper limit from the standpoint of costs. It is also preferred that the ratio N/P of the thickness (N) of the filler-containing upper region to the thickness (P) of the remainder lower region containing substantially no inorganic filler of the photoconductive layer 24 be in the range of 0.125–1 for reasons of high abrasion resistance and satisfactory electrostatic characteristics.

Description will be next made of the photoconductive layer 24 of a two-layer structure as shown in FIG. 9. The photoconductive layer 24 of FIG. 9 includes an upper region or layer 27 having an outwardly facing surface and containing a charge transporting material, a charge generating material and an inorganic filler including α-alumina, and a lower region or layer 28 contiguous with the upper region or layer 27 and containing a charge transporting material and a charge generating material but having substantially no inorganic filler.

Because the upper layer 27 exhibits charge transporting and charge generating properties comparable to the conventional mix-type photoconductive layer, the upper layer 27 is distinguished from a conventional protecting layer provided on a photoconductive layer. Further, because of its high abrasion resistance, the upper layer 27 is distinguished from the conventional photoconductive layer in which a filler is uniformly dispersed.

The lower layer 28 as shown in FIG. 8 may be prepared by applying a coating liquid containing a charge transporting material, a charge generating material and a binder resin dispersed in a solvent over a surface to be coated such as a conductive support, and drying the coating. The binder resin, charge transporting material and charge generating material used in the lower photoconductive layer 28 are the same as those described previously with regard to the charge transporting layer 23 and the charge generation layer 22. The solvents used for the fabrication of the lower layer 28 are the same as those described previously with regard to the charge transporting layer 23. The lower layer 28 may contain additives such as an anti-oxidation agent, a plasticizer, a lubricant, a UV-absorbing agent and a leveling agent, similar to the charge transporting layer 23.

The upper layer 27 as shown in FIG. 8 may be prepared by applying a coating liquid containing a charge transporting material, a charge generating material, an inorganic filler and a binder resin dispersed in a solvent over the lower layer 28, and drying the coating. The binder resin, inorganic filler charge transporting material and charge generating material used in the upper photoconductive layer 27 are the same as those described previously with regard to the charge transporting layer 23 and the charge generation layer 22. The solvents used for the fabrication of the upper layer 27 are the same as those described previously with regard to the charge transporting layer 23. A coating liquid for the formation of the upper layer 27 may be applied using, for example, an immersion method, a spray coating method, a ring coating method, a roll coating method, a gravure coating method, a nozzle coating method or a screen coating method. A spray coating method is preferably adopted since the aggregation of fillers during coating may be easily prevented.

It is preferred that the thickness of the upper layer 27 be 0.5 μm or more for reasons of improved durability. When the thickness of the upper region is 2 μm or more, the durability of the photoconductor is fully satisfactory and, therefore, a thickness of the filler-containing region of 2 μm or more is more preferred. Since no additional advantage is obtainable when the thickness of the filler-containing upper region is over 10 μm, this amount represents the preferred upper limit from the standpoint of costs. It is also preferred that the ratio N/P of the thickness (N) of the filler-containing upper layer 27 to the thickness (P) of the lower layer 28 containing substantially no inorganic filler be in the range of 0.125–1 for reasons of high abrasion resistance and satisfactory electrostatic characteristics.

An undercoat layer 25 may be interposed between the conductive substrate 21 and the photoconductive layer 24 for the purpose of improving adhesion strength between the photoconductive layer 24 and the support 21, improving the coat-formability of the photoconductive layer 24, decreasing residual potential of the photoconductor and preventing the injection of charges from the conductive support 21. In general, the undercoat layer 25 contains a resin as its main ingredient. Since the photoconductive layer 24 is typically formed by coating a coating liquid including an organic solvent, the resin for use in the undercoat layer 25 preferably has good resistance to generally employed organic solvents. Specific examples of such resins include water-soluble resins such as polyvinyl alcohol, casein, polyacrylic acid sodium salts, and the like; alcohol-soluble resins such as nylon copolymers, methoxymethylated nylon, and the like; and crosslinking resins, which can form a three-dimensional network, such as polyurethane resins, melamine resins, alkyd-melamine resins, epoxy resins, and the like.

In addition, fine powders of metal oxides such as titanium oxide, silica, alumina, zirconium oxide, tin oxide, indium oxide and the like; metal sulfides, and metal nitrides can be added thereto. The undercoat layer 25 can be formed by a coating method using a proper solvent. A metal oxide layer which is formed by a sol-gel method using a coupling agent such as a silane coupling agent, titan coupling agent and a chrome coupling agent can also be used as the undercoat layer 25. In addition, an alumina layer which is formed by an anodizing method, and a layer which is formed by a vacuum deposition method using an organic material such as polyparaxylene (Palylene) or an inorganic material such as silica, tin oxide, ITO or seria. The thickness of the undercoat layer 25 is preferably from 0 to about 5 $\mu$m.

Each of the layers constituting the photoconductor according to the present invention may contain one or more additives such as an anti-oxidation agent, a plasticizer, a lubricant, a UV-absorbing agent and a leveling agent, as described previously. Specific examples of additives are shown below.

Anti-Oxidation Agent:

(a) Phenolic Compounds 2,6-di-t-butyl-p-cresol, 2,4,6-tri-t-butylphenol, n-octadecyl-3-(4'-hydroxy-3',5'-di-t-butylphenol) propionate, styrene-modified phenol, 4-hydroxymethyl-2,6-di-t-butylphenol, 2,5-di-t-butylhydroquinone, 6-ethoxy-2,2,4-trimethyl-1,2-dihydroquinone, cyclohexylphenol, butylhydroxyanisole, 2,2'-methylenebis-(4-methyl-6-t-butylphenol), 2,2'-methylenebis-(4-ethyl-6-t-butylphenol), 4,4'-i-propylidene-bisphenol 1,1-bis(4-hydroxyphenyl)cyclohexane, 4,4'-methylenebis-(2,6-di-t-butylphenol), 2,6-bis(2'hydroxy-3'-t-butyl-5'-methylbenzyl)-4-methylphenol, 1,1,3-tris-(2-methyl-4-hydroxy-5-t-butylphenyl)butane, 1,3,5-trimethyl-2,4,6-tris(3,5-di-t-butyl-4-hydroxybenzyl)benzene, tetrakis-[methylene-3-(3', 5'-di-t-butyl-4'-hydroxyphenyl) propionate]methane, tris(3,5-di-t-butyl-4-hydroxyphenyl)isocyanate, tris[β-(3,5-di-t-butyl-4-hydroxyphenyl)propionyl-oxyethyl]isocyanate, 4,4'-thiobis-(3-methyl-6-t-butylphenol), 2,2'-thiobis-(4-methyl-6-t-butylphenol), 4,4'-thiobis-(4-methyl-6-t-butylphenol).

(b) Amine Compounds phenyl α-naphthylamine, phenyl-β-naphthylamine,

N,N'-diphenyl-p-phenylenediamine,

N,N'-di-β-naphthyl-p-phenylenediamine,

N-cyclohexyl-N'-phenyl-p-phenylenediamine,

N-phenyl-N'-isopropyl-p-phenylenediamine, aldole-α-naphthylamine.

(c) Organic Sulfur-Containing Compounds thiobis(β-naphthol), thiobis(N-phenyl-β-naphthylamine), 2-mercaptobenzothiazole, 2-mercaptobenzimidazole, dodecylmercaptane, tetramethylthiuram monosulfide, tetramethylthiuram disulfide, nickel dibutylthiocarbamate, isopropylxantate, dilauryl-3,3'-thiodipropionate, distearyl-3,3'-thiodipropionate, (d) Organic Phosphorus-Containing Compounds triphenylphosphite, diphenyldecylphosphite, phenylisodecylphosphite, tri(nonylphenyl)phosphite, 4,4'-butylidenebis(3-methyl-6-tbutylphenyl-ditridecylphosphite), 15 distearyl-pentaerythritoldiphosphite, trilauryltrithiophosphite Plasticizer:

(a) Phosphoric Acid Esters triphenyl phosphate, tricresyl phosphate, trioctyl phosphate, octyldiphenyl phosphate, trichloroethyl phosphate, cresyldiphenyl phosphate, tributyl phosphate, tri-2-ethylhexyl phosphate, triphenyl phosphate.

(b) Phthalic Acid Esters dimethyl phthalate, diethyl phthalate, diisobutyl phthalate, dibutyl phthalate, diheptyl phthalate, di-2-ethylhexyl phthalate, diisooctyl phthalate, di-n-octyl phthalate, dinonyl phthalate, diisononyl phthalate, diisodecyl phthalate, diundecyl phthalate, ditridecyl phthalate, dicyclohexyl phthalate, butylbenzyl phthalate, butyllauryl phthalate, methyloleyl phthalate, octyldecyl phthalate, dibutyl fumarate, dioctyl fumarate.

(c) Aromatic Carboxylic Acid Esters trioctyl trimellitate, tri-n-octyl trimellitate, octyl oxybenzoate.

(d) Aliphatic Dibasic Acid Esters dibutyl adipate, di-n-hexyl adipate, di-2-ethylhexyl adipate, d-n-octyl adipate, n-octyl-n-decyl adipate, diisodecyl adipate, dialkyl adipate,
dicapryl adipate,
di-2-etylhexyl azelate,
dimethyl sebacate,
diethyl sebacate,
dibutyl sebacate,
di-n-octyl sebacate,
di-2-ethylhexyl sebacate,
di-2-ethoxyethyl sebacate,
dioctyl succinate,
diisodecyl succinate,
dioctyl tetrahydrophthalate,
di-n-octyl tetrahydrophthalate.
(e) Fatty Acid Ester Derivatives
butyl oleate,
glycerin monooleate,
methyl acetylricinolate,
pentaerythritol esters,
dipentaerythritol hexaesters,
triacetin,
tributyrin.
(f) Oxyacid Esters
methyl acetylricinolate,
butyl acetylricinolate,
butylphthalylbutyl glycolate,
tributyl acetylcitrate.
(g) Epoxy Compounds
epoxydized soybean oil,
epoxydized linseed oil,
butyl epoxystearate,
decyl epoxystearate,
octyl epoxystearate,
benzyl epoxystearate,
dioctyl epoxyhexahydrophthalate,
didecyl epoxyhexahydrophthalate.
(h) Dihydric Alcohol Esters
diethylene glycol dibenzoate,
triethylene glycol di-2-ethylbutyrate.
(i) Chlorine-Containing Compounds
chlorinated paraffin,
chlorinated diphenyl,
methyl ester of chlorinated fatty acids,
methyl ester of methoxychlorinated fatty acid.
(j) Polyester Compounds
polypropylene adipate,
polypropylene sebacate,
acetylated polyesters.
(k) Sulfonic Acid Derivatives
p-toluene sulfonamide,
o-toluene sulfonamide,
p-toluene sulfoneethylamide,
o-toluene sulfoneethylamide,
toluene sulfone-N-ethylamide,
p-toluene sulfone-N-cyclohexylamide.
(1) Citric Acid Derivatives
triethyl citrate,
triethyl acetylcitrate,
tributyl citrate,
tributyl acetylcitrate,
tri-2-ethylhexyl acetylcitrate,
n-octyldecyl acetylcitrate.
(m) Other Compounds
terphenyl,
partially hydrated terphenyl,
camphor,
2-nitro diphenyl,
dinonyl naphthalene,
methyl abietate.

Lubricant:
(a) Hydrocarbons
liquid paraffins,
paraffin waxes,
micro waxes,
low molecular weight polyethylenes.
(b) Fatty Acids
lauric acid,
myristic acid,
palmitic acid,
stearic acid,
arachidic acid,
behenic acid.
(c) Fatty Acid Amides
stearyl amide,
palmityl amide,
oleyl amide,
ethylenebisstearamide,
ethylenebisstearamide.
(d) Ester Compounds
lower alcohol esters of fatty acids,
polyhydric alcohol esters of fatty acids,
polyglycol esters of fatty acids.
(e) Alcohols
cetyl alcohol,
stearyl alcohol,
ethylene glycol,
polyethylene glycol,
polyglycerol.
(f) Metallic Soaps
lead stearate,
cadmium stearate,
barium stearate,
calcium stearate,
zinc stearate,
magnesium stearate.
(g) Natural Waxes
Carnauba wax,
candelilla wax,
beeswax,
spermaceti,
insect wax,
montan wax.
(h) Other Compounds
silicone compounds,
fluorine compounds.

UV Absorbing Agent:
(a) Benzophenone Compounds 2-hydroxybenzophenone, 2,4-dihydroxybenzophenone, 2,2',4-trihydroxybenzophenone, 2,2',4,4'-tetrahydroxybenzophenone, 2,2'-dihydroxy-4-methoxybenzophenone.

(b) Salicylate Compounds phenyl salicylate, 2,4-di-t-butylphenyl-3,5-di-t-butyl-4-hydroxybenzoate.

(c) Benzotriazole compounds (2'-hydroxyphenyl)benzotriazole, (2'-hydroxy-5'-methylphenyl)benzotriazole, (2'-hydroxy-3'-t-butyl-5'-methylphenyl)-5-chlorobenzotriazole.

(d) Cyano Acrylate Compounds ethyl-2-cyano-3,3-diphenyl acrylate, methyl-2-carbomethoxy-3-(paramethoxy) acrylate.

(e) Quenchers (metal complexes)

nickel(2,2'-thiobis(4-t-octyl)phenolate)-n-butylamine, nickeldibutyldithiocarbamate, cobaltdicyclohexyldithiophosphate.

(f) HALS (hindered amines)

bis(2,2,6,6-tetramethyl-4-piperidyl) sebacate, bis(1,2,2,6,6-pentamethyl-4-piperidyl) sebacate, 1-[2-{3-(3,5-di-t-butyl-4-hydroxyphenyl)-propionyloxy}lethyl]-4-{3-(3,5-di-t-butyl-4-hydroxyphenyl) propionyloxy}-2,2,6,6-tetrametylpyridine, 8-benzyl-7,7,9,9-tetramethyl-3-octyl-1,3,8-triazaspiro[4,5]undecane-2,4-dione, 4-benzoyloxy-2,2,6,6-tetramethylpiperidine.

Suitable low molecular weight charge transporting materials for use in each of the layers constituting the photoconductor include those described above in connection with the charge generating layer 22.

The electrophotographic image forming apparatus and the process cartridge according to the present invention will now be explained in detail with reference to FIG. 1

FIG. 1 is a schematic view which shows an example of the image forming apparatus employing the electrophotographic photoconductor according to the present invention.

An electrophotographic photoconductor 11 comprises an electroconductive support, and a photoconductive layer formed thereon and containing a charge generation material, a charge transport material, a filler including α-alumina. The concentration of α-alumina in the photoconductive layer decreases from an outwardly facing surface thereof to the opposite surface thereof. The photoconductor is in the form of a drum as shown in FIG. 1, but may be a sheet or an endless belt.

Disposed around the photoconductor 11 are a charge remover 1A, a charger 12, a light exposing unit 13, a development unit 14 containing a toner 15, an image transfer unit 16 and a cleaning device 17.

The charger 13 may be any conventional one such as a corotron charger, a scorotron charger, a solid state charger, and a charging roller. From the standpoint of reduction of consumption of electric energy, a charger capable of disposed in contact with or in close proximity of the photoconductor is suitably used. For reasons of prevention of fouling of the charger, however, the latter charger is preferably used.

The image transfer unit 16 may include the above charger. It is effective to employ a combination of an image transfer charger with a separating charger.

As the light source for the light exposing unit 13 or the charge remover 1A, there can be employed, for example, a fluorescent tube, tungsten lamp, halogen lamp, mercury vapor lamp, sodium light source, light emitting diode (LED), semiconductor laser (LD), and electroluminescence (EL). Further, a desired wavelength can be obtained by use of various filters such as a sharp-cut filter, bandpass filter, a near infrared cut filter, dichroic filter, interference filter, and color conversion filter.

A toner image formed on the photoconductor 11 using the development unit 14 is transferred to a transfer sheet 18. At the step of image transfer, not all the toner particles deposited on the photoconductor 1 are transferred to the transfer sheet 18. The transferred image is then fixed in a fixing unit 19. Some toner particles remain on the surface of the photoconductor 11. The remaining toner particles are removed from the photoconductor 11 in the cleaning device 17 using a rubber blade or a conventional brush such as a fur brush or a magnetic fur brush.

When the photoconductor 11 is positively charged, and exposed to light images, positively-charged electrostatic latent images are formed on the photoconductor. In the similar manner as in above, when a negatively charged photoconductor is exposed to light images, negative electrostatic latent images are formed. A negatively-chargeable toner and a positively-chargeable toner are respectively used for development of the positive electrostatic images and the negative electrostatic images, thereby obtaining positive images. In contrast to this, when the positive electrostatic images and the negative electrostatic images are respectively developed using a positively-chargeable toner and a negatively-chargeable toner, negative images can be obtained on the surface of the photoconductor 11. Not only such development means, but also the quenching means may employ the conventional manner.

Figure 2:
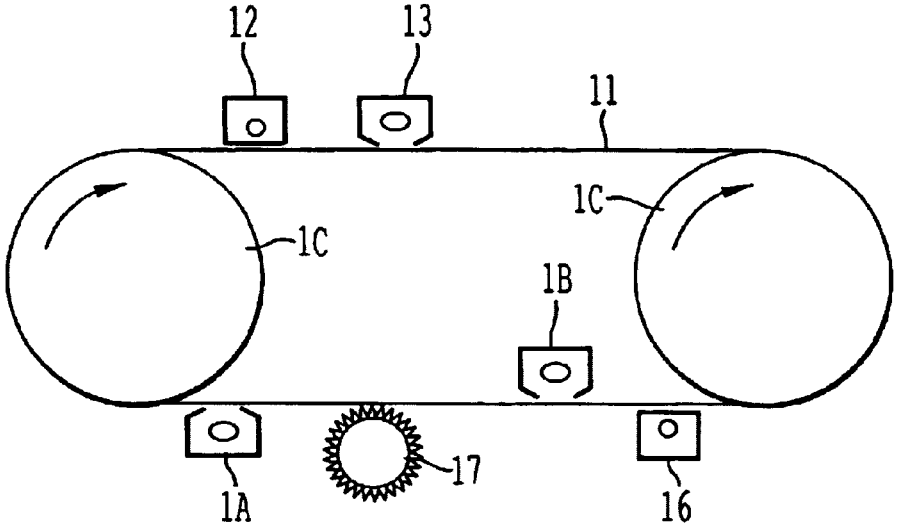
FIG. 2 is a sectional view diagrammatically illustrating another embodiment of anelectrophotographic apparatus according to the present invention.

FIG. 2 is a schematic view which shows another example of the electrophotograhic image forming apparatus according to the present invention.

Designated as 11 is a photoconductor, which comprises an electroconductive support and a photoconductive layer formed thereon. The photoconductive layer contains a charge generation material, a charge transport material, a filler including α-alumina, wherein the concentration of α-alumina in the photoconductive layer decreases from an outwardly facing surface thereof to the opposite surface thereof. The photoconductor is driven by a pair of driving rollers 1C and is successively subjected to charging by a charger 12, exposure by an exposure unit 13, develpment (not shown), image transfer by image transfer means, pre-cleaning light exposure by a pre-cleaning light, physical cleaning by cleaning means 17, and quenching by charge removing means 1A. In FIG. 2, the electroconductive support of the photoconductor 11 has light transmission properties, so that it is possible to apply the pre-cleaning light to the electroconductive support side of the photoconductor. As a matter of course, the photoconductive layer side of the photoconductor 11 may be exposed to the pre-cleaning light. Similarly, the image exposure light and the quenching lamp may be disposed so that light is directed toward the electroconductive support side of the photoconductor 11. The photoconductor 11 is exposed to light using the image exposure light, pre-cleaning light, and the quenching lamp, as illustrated in FIG. 2. In addition to the above, light exposure may be carried out before image transfer, and before image exposure.

The above-discussed units, such as the charging unit, light-exposing unit, development unit, image transfer unit, cleaning unit, and quenching unit may be independently fixed in the copying machine, facsimile machine, or printer.

Alternatively, at least one of those units may be incorporated in the process cartridge together with the photoconductor. To be more specific, the process cartridge holding therein the photoconductor, and at least one of the charging unit, light-exposing unit, development unit, image transfer unit, cleaning unit, and quenching unit may by detachably set in the above-mentioned electrophotographic image forming apparatus.

Figure 3:
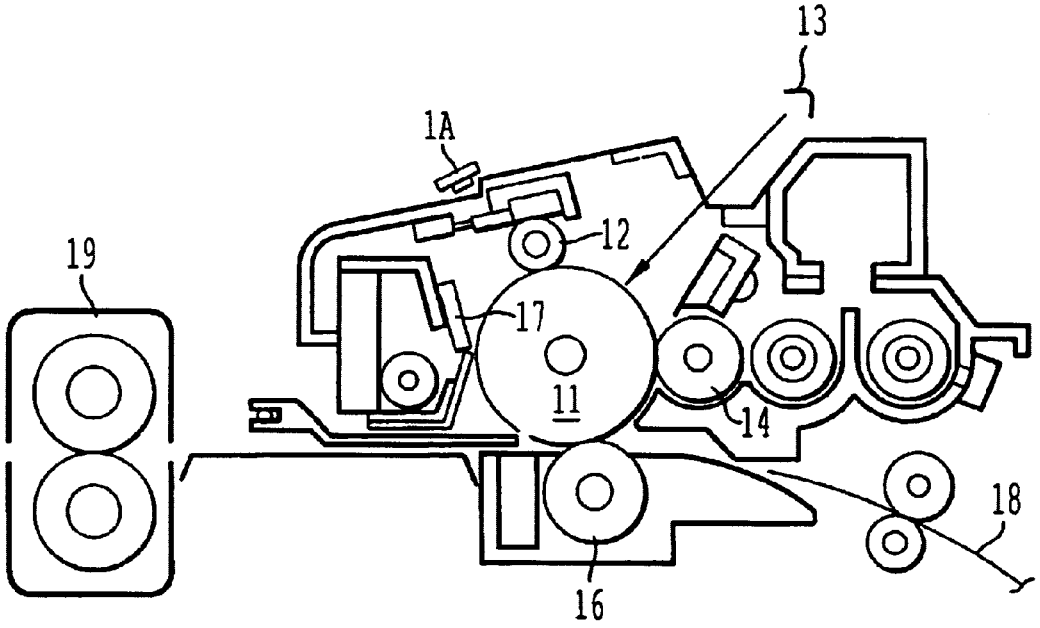
FIG. 3 is a sectional view diagrammatically illustrating a further embodiment of an electrophotographic apparatus according to the present invention.

FIG. 3 is a schematic view which shows one example of the process cartridge according to the present invention. In FIG. 3, the same reference numerals as those in FIG. 1 designate similar component parts. The photoconductor 11 comprises an electroconductive support and a photoconductive layer formed thereon and containing a charge generation material, a charge transport material, a filler including α-alumina, wherein the concentration of α-alumina in the photoconductive layer decreases from an outwardly facing surface thereof to the opposite surface thereof.

Figure 4:
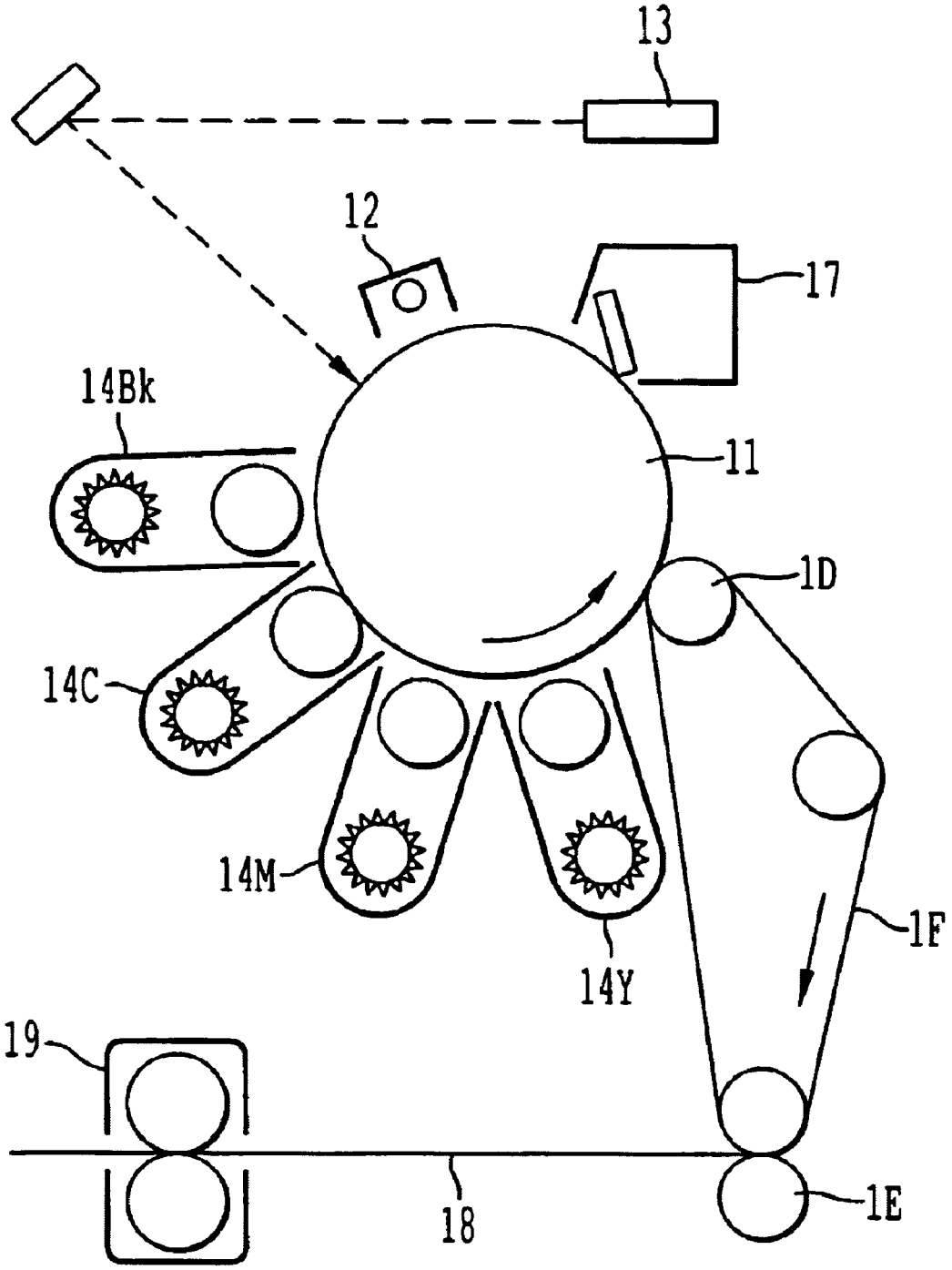
FIG. 4 is a sectional view diagrammatically illustrating a further embodiment of an electrophotographic apparatus according to the present invention.

FIG. 4 depicts a further embodiment of the electrophotographic image forming apparatus according to the present invention. The apparatus includes a photoconductor 11 around which a charger 12, an exposing unit 13, developing units 14Bk, 14C, 14M and 14Y containing black (Bk) toner, cyan (C) toner, magent (M) toner and yellow (Y) toner, respectively, an intermediate transfer belt 1F and a cleaning means 17 are arranged. The photoconductor 11 comprises an electroconductive support and a photoconductive layer formed thereon and containing a charge generation material, a charge transport material, a filler including α-alumina, wherein the concentration of α-alumina in the photoconductive layer decreases from an outwardly facing surface thereof to the opposite surface thereof.

The developing units 14Bk, 14C, 14M and 14Y are controllable independently and are selectively operate according to the desired color to be produced. A toner image on the photoconductor 11 is transferred to the intermediate transfer belt 1F by means of a first transfer means 1D disposed to urge the belt 1F to brought into contact with the photoconductor 11 only at the transfer stage. Without such an intermediate transfer belt 1F, it is impossible to obtain a full color image on a thick rigid paper. The use of the intermediate transfer belt 1F permits full color image forming on any desured paper. The electrophotographic image forming appatuses shown in FIGS. 1–3 may be modified to include such an intermediate transfer belt, if desired.

Figure 5:
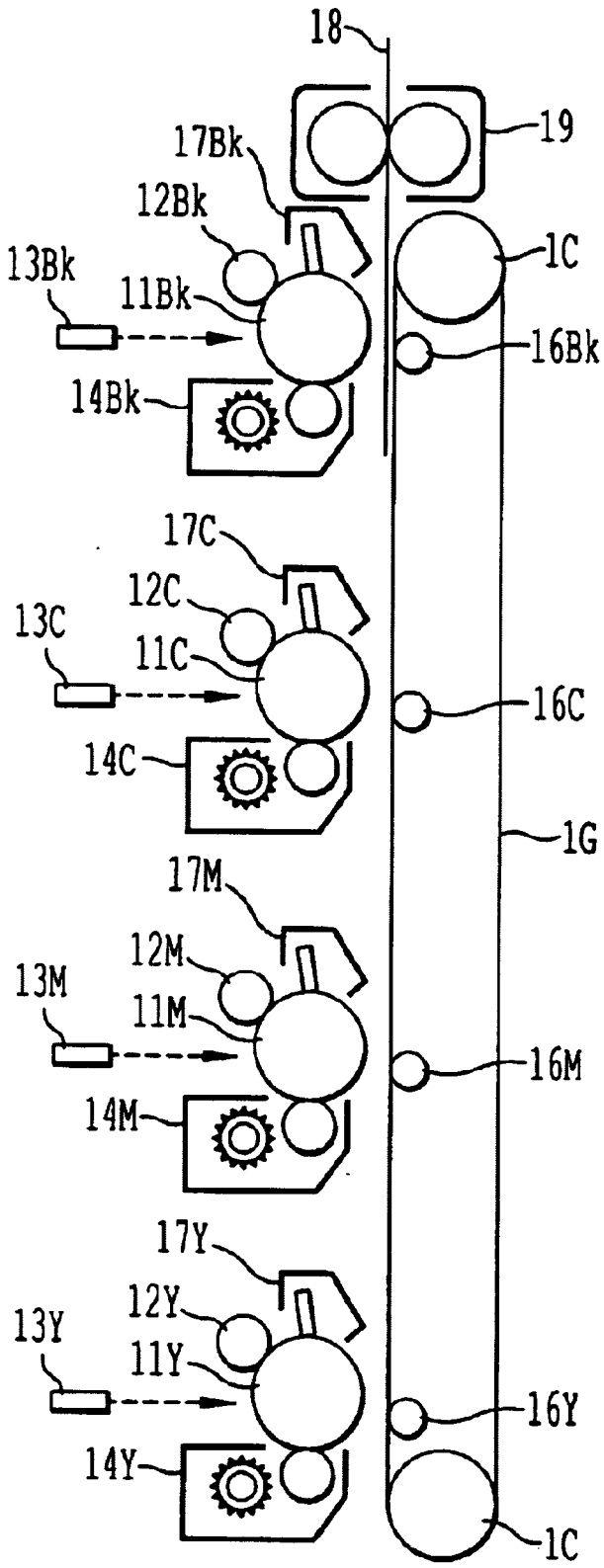
FIG. 5 is a sectional view diagrammatically illustrating a further embodiment of an electrophotographic apparatus according to the present invention.

FIG. 5 illustrate further embodiment of the electrophotographic image forming apparatus according to the present invention in which the same component parts as those in FIG. 1 designate similar reference numerals with characters Bk, C, M and Y being affixed. These characters correspond to the colors of black (Bk) toner, cyan (C) toner, magent (M) toner and yellow (Y) toner. The apparatus includes four photoconductors 11Bk, 11C, 11M and 11Y each having an electroconductive support and a photoconductive layer formed thereon. The photoconductive layers contains a charge generation material, a charge transport material, a filler including α-alumina, wherein the concentration of α-alumina in the photoconductive layer decreases from an outwardly facing surface thereof to the opposite surface thereof.

Each of the photoconductors 11Bk, 11C, 11M and 11Y is provided with a charger 12Bk, 12C, 12M or 12Y, an exposing unit 13Bk, 13C, 13M or 13Y, a developing unit 14Bk, 14C, 14M or 14Y and cleaning means 17Bk, 17C, 17M or 17Y. A transfer belt 1G is supported between a pair of driving rollers 1C and runs for facing respective photoconductors 11Bk, 11C, 11M and 11Y. Transfer means 16Bk, 16C, 16M and 16Y are disposed to urge an image receiving medium or paper 18 supported on the transfer belt 1G to be brought into contact with toner images on respective photoconductors. An intermediate transfer belt may be incorporated into each of the photoconductors, if desired. The electrophotographic full color image forming apparatus of a tandem type shown in FIG. 5 provides high speed image forming as compared with the apparatus shown in FIG. 4.

The following examples will further illustrate the present invention. Parts are by weight.

Test methods employed in the following examples are as follows:

Thickness of Photoconductive Layer:

The thickness of a photoconductive layer was measured with an eddy current type thickness measuring apparatus FISHER SCOPE MMS (manufactured by Fischer Inc.). The thickness was measured a plurality of points of the photoconductive layer spaced at intervals of 1 cm in the longitudinal direction of the photoconductor. The average of the measured values represents the thickness of the photoconductive layer.

Ionization Potential:

Coating liquids for charge transporting layers having the same mixing ratios of a charge transporting material to a binder resin were prepared. Each coating liquid was applied to a surface-smoothed aluminum plate and dried. When two or more charge transporting materials are contained, the mixing ratio of the charge transporting materials to the binder resin was 3:4. Ionization potential was measured in the atmospheric environment with UV photoelectric analyzer AC-1 manufactured by Riken Keiki Co., Ltd.

Charge Mobility:

The charge mobility of a charge transporting material is measured in accordance with the conventional time-of-flight method. A coating liquid for a charge transporting layer was applied onto an aluminum-deposited polyester film to obtain a coating having a thickness of 10 μm. On the coating was then deposited a gold electrode having a thickness of 200 Å to obtain a sample cell. Positive voltage was previously applied to the gold electrode. Nitrogen gas laser was then applied to the sample from the gold electrode side, while recording, with a digital memory, the change of potential with time caused by photocurrent flowing through an inserted resistor disposed between the aluminum electrode and the ground. On the waveform thus obtained, two tangential lines were drawn to determine the transient time t as the intersection of the two lines. On inference of the waveform being in a dispersion type, Logt-LogV plotting was performed from the waveform and two tangential lines were drawn to determine the transient time t as the intersection of the two lines. The mobilities were determined from the conventional expression $$\mu = L^2/V \cdot t,$$

where L is the sample thickness, t is the transient time and V is the applied voltage. The measurement was carried out at 25° C. under 50% relative humidity condition.

Weight Cumulative Particle Size Distribution:

Particle size distribution of an inorganic filler was measured with Sedigraph 5000ET Particle Size Analyzer (Shimadzu-Micromeritrics Inc.).

D/H Ratio:

A D/H ratio of an inorganic filler was obtained as an average of 5 to 10 particles by image analysis of scanning electron microphotograph SEM ("T-300" manufactured by Japan Electron Optics Laboratory Co., Ltd.).

Example 1

The following undercoat layer coating liquid, charge generating layer coating liquid and charge transporting layer coating liquid were coated and dried one by one to overlay an undercoat layer of 3.5 μm thick, a charge generating layer of 0.2 μm thick and a charge transporting layer of 28 μm thick on an aluminum drum having a diameter of 30 mm. A coating liquid for forming an α-alumina filler-containing layer was prepared by grinding a composition shown below with a paint shaker for 2 hours using zirconia beads. The coating liquid was spray-coated onto the charge transporting layer to form an α-alumina filler-containing layer having a thickness of 1.5 μm, thereby obtaining a photoconductor of the present invention.

| [Undercoat layer coating liquid] | |
|---|---|
| Alkyd resin (Beckozol 1307-60-EL, manufactured by Dainippon Ink and Chemicals Inc.) | 6 parts |
| Melamine resin (Super Beckamine G-821-60, manufactured by Dainippon Ink and Chemicals Inc.) | 4 parts |
| Titanium oxide (manufactured by CR-EL Ishihara Sangyo Inc.) | 40 parts |
| Methyl ethyl ketone | 200 parts |
| [Charge generating layer coating liquid] | |
| Oxotitanium phthalocyanine pigment | 2 parts |
| Polyvinyl butyral resin (XYHL, manufactured by Union Carbide Corp.) | 0.25 part |
| Tetrahydrofuran | 50 parts |
| [Filler-free charge transporting layer coating liquid] | |
| Polycarbonate resin (Bisphenol Z-type polycarbonate resin manufactured by Teijin Kasei Inc.; viscosity average molecular weight: 50,000) | 12 parts |
| Charge transporting material having the following formula | 10 parts |

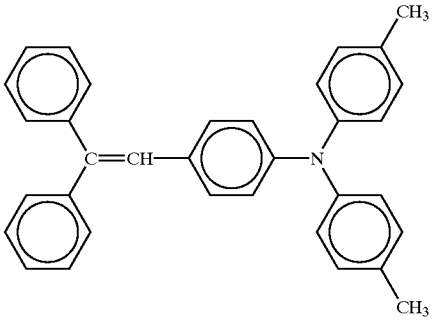

| | |
|---|---|
| Tetrahydrofuran | 100 parts |
| 1% Silicone oil tetrahydrofuran solution (KF50-100CS manufactured by Shin-etsu Chemical Industry Co., Ltd.) | 1 part |
| [Filler-containing charge transporting layer coating liquid] | |
| Polycarbonate resin (Bisphenol Z-type polycarbonate resin manufactured by Teijin Kasei Inc.; viscosity average molecular weight: 50,000) | 4 parts |
| Charge transporting material having the following formula | 3 parts |

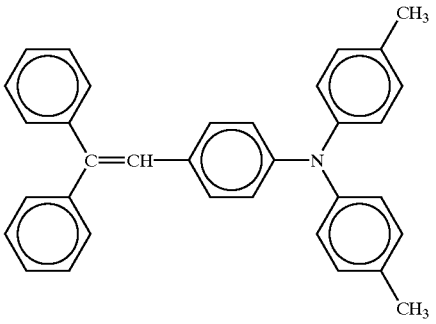

-continued

| | |
|---|---|
| α-Alumina (Sumicorundum AA-03 manufactured by Sumitomo Chemical Company Ltd.) | 0.7 part |
| Cyclohexanone | 80 parts |
| Tetrahydrofuran | 280 parts |

Comparative Example 1

An electrophotoconductor for a comparative purpose was prepared in the same manner as described in Example 1 except that the filler-containing charge transporting layer was not formed.

Comparative Example 2

An electrophotoconductor for a comparative purpose was prepared in the same manner as described in Example 1 except that the filler-containing charge transporting layer coating liquid was substituted by the following protective layer coating liquid.

| [protective layer coating liquid] | |
|---|---|
| Polycarbonate resin (Bisphenol Z-type polycarbonate resin manufactured by Teijin Kasei Inc.; viscosity average molecular weight: 50,000) | 7 parts |
| α-Alumina (Sumicorundum AA-03 manufactured by Sumitomo Chemical Company Ltd.) | 0.7 part |
| Cyclohexanone | 86 parts |
| Tetrahydrofuran | 300 parts |

Comparative Example 3

An electrophotoconductor for a comparative purpose was prepared in the same manner as described in Example 1 except that the filler-containing charge transporting layer was not formed and that the filler-free charge transporting layer coating liquid was substituted by the following filler-containing charge transporting layer coating liquid.

| [Filler-containing charge transporting layer coating liquid] | |
|---|---|
| Polycarbonate resin (Bisphenol Z-type polycarbonate resin manufactured by Teijin Kasei Inc.; viscosity average molecular weight: 50,000) | 11 parts |
| Charge transporting material having the following formula | 10 parts |

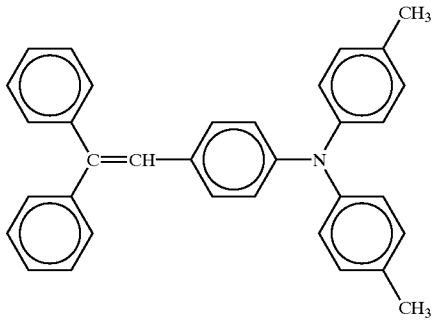

-continued

| [Filler-containing charge transporting layer coating liquid] | |
|---|---|
| α-Alumina (Sumicorundum AA-03 manufactured by Sumitomo Chemical Company Ltd.) | 2 parts |
| Tetrahydrofuran | 100 parts |
| 1% Silicone oil tetrahydrofuran solution (KF50-100CS manufactured by Shin-etsu Chemical Industry Co., Ltd.) | 1 part |

Comparative Example 4

An electrophotoconductor for a comparative purpose was prepared in the same manner as described in Example 1 except that the filler-containing charge transporting layer coating liquid was substituted by the following filler-containing charge transporting layer coating liquid.

| [Filler-containing charge transporting layer coating liquid] | |
|---|---|
| Polycarbonate resin (Bisphenol Z-type polycarbonate resin manufactured by Teijin Kasei Inc.; viscosity average molecular weight: 50,000) | 4 parts |
| Charge transporting material having the following formula | 3 parts |

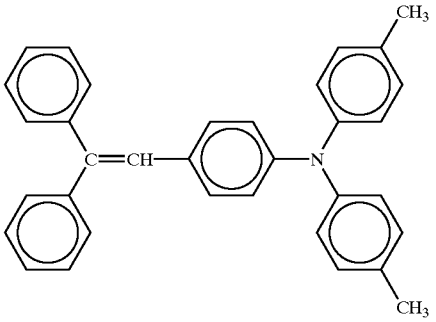

| | |
|---|---|
| Magnesium oxide (Magnesia 500A manufactured by Ube Materials Inc.) | 0.7 part |
| Cyclohexanone | 80 parts |
| Tetrahydrofuran | 280 parts |

Each of the photoconductors obtained in Example 1 and Comparative Examples 1–4 was installed in a modified copier of a copier (IMAGIO MF2200 manufactured by Ricoh Company Ltd.), and images were continuously reproduced for 50000 copies. The environmental conditions were 25° C. and 50% relative humidity. An amount of abrasion of each photoconductive layer was measured. Also, image qualities of the initial copy and the final copy were visually evaluated. The copier used had a process cartridge having a charger, a developing unit, a cleaning unit and a photoconductor. The charger had a charging roller of a contact type. The results are shown in Table 1.

TABLE 1

| Example No. | Abrasion Amount (μm) | Image quality: Initial copy | Image quality: Final copy |
|---|---|---|---|
| Example 1 | 4.0 | good | good |
| Comp. Ex. 1 | 7.0 | good | fogging |
| Comp. Ex. 2 | 0.2 | good | deformation of image |
| Comp. Ex. 3 | 1.0 | reduction of image density | reduction of image density |
| Comp. Ex. 4 | 6.0 | good | poor gradient |

As is evident from the results shown in Table 1, the photoconductor of Example 1 having a photoconductive layer composed of an upper region including an outwardly facing surface and containing α-alumina of a hexagonal close-packed lattice crystal structure as a filler and a lower region contiguous with the upper region and having substantially no α-alumina gives an image having clear contrast and image density and no background fouling (fogging) even after repeated use and, therefore, shows good durability. In contrast, when α-alumina is incorporated into a surface protective layer formed above a photoconductive layer (Comparative Example 2), an abnormal image is formed after production of 50000 copies. Further, when α-alumina is uniformly incorporated into a charge transporting layer (Comparative Example 3), image density is reduced. When magnesium oxide is substituted for α-alumina (Comparative Example 4), the durability is no good.

Example 2

An electrophotoconductor was prepared in the same manner as described in Example 1 except that the following filler-containing charge transporting layer coating liquid was used in lieu of the filler-containing charge transporting layer coating liquid used in Example 1.

| [Filler-containing charge transporting layer coating liquid] | |
|---|---|
| Polycarbonate resin (Bisphenol Z-type polycarbonate resin manufactured by Teijin Kasei Inc.; viscosity average molecular weight: 50,000) | 4 parts |
| Charge transporting material having the following formula | 3 parts |

-continued

[Filler-containing charge transporting layer coating liquid]

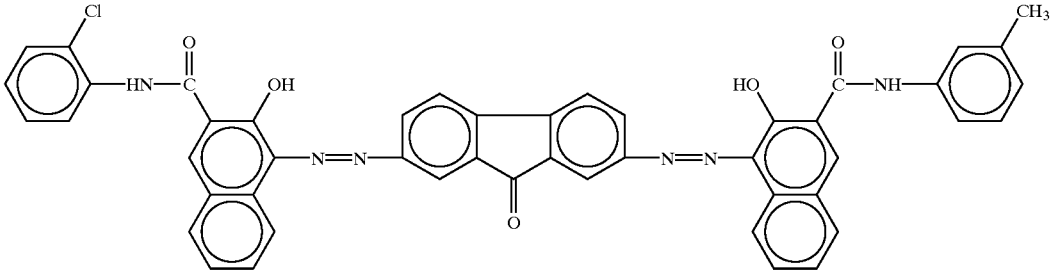

| | |
|---|---|
| α-Alumina (Sumicorundum AA-03 manufactured by Sumitomo Chemical Company Ltd.) | 2 parts |
| Cyclohexanone | 80 parts |
| Tetrahydrofuran | 280 parts |

Example 3

An electrophotoconductor was prepared in the same manner as described in Example 1 except that the following filler-containing charge transporting layer coating liquid was used in lieu of the filler-containing charge transporting layer coating liquid used in Example 1.

[Filler-containing charge transporting layer coating liquid]

| | |
|---|---|
| Polycarbonate resin (Bisphenol Z-type polycarbonate resin manufactured by Teijin Kasei Inc.; viscosity average molecular weight: 50,000) | 4 parts |
| Charge transporting material having the following formula | 3 parts |

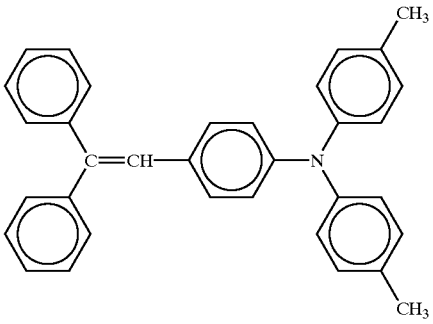

| | |
|---|---|
| α-Alumina (Sumicorundum AA-03 manufactured by Sumitomo Chemical Company Ltd.) | 3 parts |
| Cyclohexanone | 80 parts |
| Tetrahydrofuran | 280 parts |

Each of the photoconductors obtained in Examples 1–3 was installed in a modified copier of a copier (IMAGIO MF2200 manufactured by Ricoh Company Ltd.), and images were continuously reproduced for 100,000 copies. The environmental conditions were 25° C. and 50% relative humidity. An amount of abrasion of each photoconductive layer was measured. Also, image qualities of the initial copy and the final copy were visually evaluated. The copier used had a process cartridge having a charger, a developing unit, a cleaning unit and a photoconductor. The charger had a charging roller of a contact type. The results are shown in Table 2.

TABLE 2

| Example No. | Abrasion Amount (μm) | Image quality | |
|---|---|---|---|
| | | Initial copy | Final copy |
| Example 1 | 8.5 | good | fogging |
| Example 2 | 5.5 | good | good |
| Example 3 | 1.5 | good | good |

As is evident from the results shown in Table 2, the photoconductors of Examples 2 and 3 give an image having clear contrast and image density and no background fouling (fogging) even after production of 100,000 copies and, therefore, show good durability. In the case of the photoconductor of Example 3, amount of abrasion is extremely small and significantly improved durability is obtained.

Example 4

An electrophotoconductor was prepared in the same manner as described in Example 1 except that thickness of the filler-containing charge transporting layer was increased to 2 μm.

Each of the photoconductors obtained in Examples 1 and 4 was installed in a modified copier of a copier (IMAGIO MF2200 manufactured by Ricoh Company Ltd.), and images were continuously reproduced for 100,000 copies. The environmental conditions were 25° C. and 50% relative humidity. An amount of abrasion of each photoconductive layer was measured. Also, image qualities of the initial copy and the final copy were visually evaluated. The copier used had a process cartridge having a charger, a developing unit, a cleaning unit and a photoconductor. The charger had a charging roller of a contact type. The results are shown in Table 3.

TABLE 3

| Example No. | Abrasion Amount (μm) | Image quality | |
|---|---|---|---|
| | | Initial copy | Final copy |
| Example 1 | 8.5 | good | fogging |
| Example 4 | 5.5 | good | good |

As is evident from the results shown in Table 3, the photoconductor of Example 4 gives an image having clear contrast and image density and no background fouling (fogging) even after production of 100,000 copies and, therefore, has excellent durability.

Example 5

An electrophotoconductor was prepared in the same manner as described in Example 3 except that thickness of the filler-containing charge transporting layer was increased to 2 μm.

Each of the photoconductors obtained in Examples 3 and 5 was installed in a modified copier of a copier (IMAGIO MF2200 manufactured by Ricoh Company Ltd.), and images were continuously reproduced for 150,000 copies. The environmental conditions were 25° C. and 50% relative humidity. An amount of abrasion of each photoconductive layer was measured. Also, image qualities of the initial copy and the final copy were visually evaluated. The copier used had a process cartridge having a charger, a developing unit, a cleaning unit and a photoconductor. The charger had a charging roller of a contact type. The results are shown in Table 4.

TABLE 4

| Example No. | Abrasion Amount (μm) | Image quality | |
|---|---|---|---|
| | | Initial copy | Final copy |
| Example 3 | 8.5 | good | fogging |
| Example 5 | 5.5 | good | good |

As is evident from the results shown in Table 4, the photoconductor of Example 5 gives an image having clear contrast and image density and no background fouling (fogging) even after production of 150,000 copies and, therefore, has surprisingly excellent durability.

Example 6

The following undercoat layer coating liquid, charge generating layer coating liquid and charge transporting layer coating liquid were coated and dried one by one to overlay an undercoat layer of 3.5 μm thick, a charge generating layer of 0.2 μm thick and a charge transporting layer of 28 μm thick on an aluminum drum having a diameter of 30 mm. A coating liquid for forming an α-alumina filler-containing layer was prepared by grinding a composition shown below with a paint shaker for 2 hours using zirconia beads. The coating liquid was spray-coated onto the charge transporting layer to form an α-alumina filler-containing layer having a thickness of 1.5 μm, thereby obtaining a photoconductor of the present invention.

[Undercoat layer coating liquid]

| | |
|---|---|
| Alkyd resin (Beckozol 1307-60-EL, manufactured by Dainippon Ink and Chemicals Inc.) | 6 parts |
| Melamine resin (Super Beckamine G-821-60, manufactured by Dainippon Ink and Chemicals Inc.) | 4 parts |
| Titanium oxide (manufactured by CR-EL Ishihara Sangyo Inc.) | 40 parts |
| Methyl ethyl ketone | 200 parts |

[Charge generating layer coating liquid]

Bisazo pigment of the formula shown below 2.5 parts

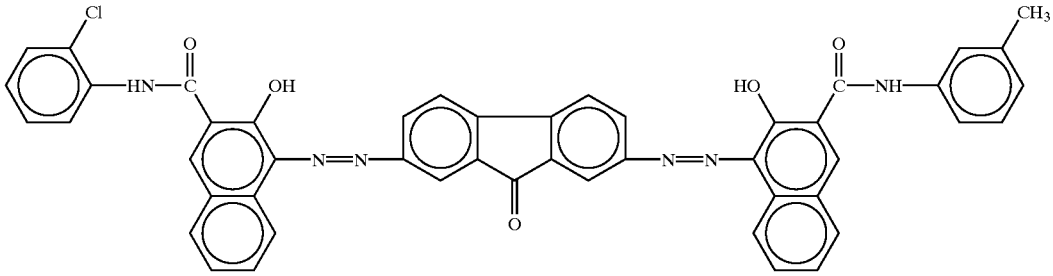

| | |
|---|---|
| Polyvinyl butyral resin (XYHL, manufactured by Union Carbide Corp.) | 0.25 part |
| cyclohexanone | 200 parts |
| Methyl ethyl ketone | 80 parts |

-continued

[Filler-free charge transporting layer coating liquid]

| | |
|---|---|
| Polycarbonate resin (Bisphenol Z-type polycarbonate resin manufactured by Teijin Kasei Inc.; viscosity average molecular weight: 50,000) | 12 parts |
| Charge transporting material having the following formula | 10 parts |

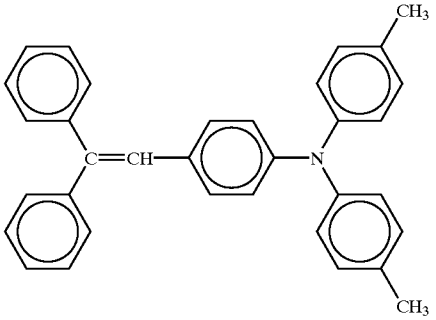

| | |
|---|---|
| Tetrahydrofuran | 100 parts |
| 1% Silicone oil tetrahydrofuran solution (KF50-100CS manufactured by Shin-etsu Chemical Industry Co., Ltd.) | 1 part |

[Filler-containing charge transporting layer coating liquid]

| | |
|---|---|
| Polycarbonate resin (Bisphenol Z-type polycarbonate resin manufactured by Teijin Kasei Inc.; viscosity average molecular weight: 50,000) | 3.7 parts |
| Charge transporting material having the following formula | 2.8 parts |

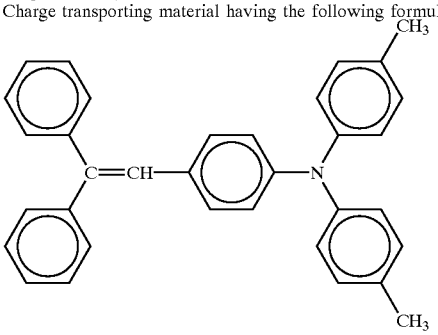

| | |
|---|---|
| α-Alumina (Sumicorundum AA-04 manufactured by Sumitomo Chemical Company Ltd.) | 2.5 parts |
| Cyclohexanone | 80 parts |
| Tetrahydrofuran | 280 parts |

Example 7

An electrophotoconductor was prepared in the same manner as described in Example 6 except that the following filler-containing charge transporting layer coating liquid was used in lieu of the filler-containing charge transporting layer coating liquid used in Example 6.

[Filler-containing charge transporting layer coating liquid]

| | |
|---|---|
| Polycarbonate resin (Bisphenol Z-type polycarbonate resin manufactured by Teijin Kasei Inc.; viscosity average molecular weight: 50,000) | 3.7 parts |
| Charge transporting material having the following formula | 2.8 parts |

-continued

[Filler-containing charge transporting layer coating liquid]

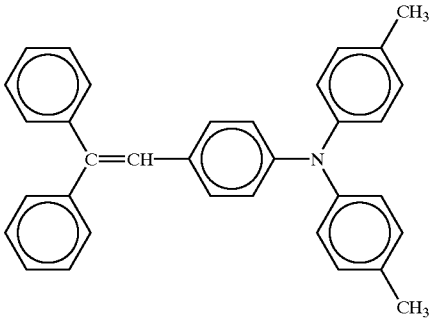

| | |
|---|---|
| α-Alumina (AKP-30 manufactured by Sumitomo Chemical Company Ltd.) | 2 parts |
| Cyclohexanone | 80 parts |
| Tetrahydrofuran | 280 parts |

Example 8

An electrophotoconductor was prepared in the same manner as described in Example 6 except that the following filler-containing charge transporting layer coating liquid was used in lieu of the filler-containing charge transporting layer coating liquid used in Example 6.

| [Filler-containing charge transporting layer coating liquid] | |
|---|---|
| Polycarbonate resin (Bisphenol Z-type polycarbonate resin manufactured by Teijin Kasei Inc.; viscosity average molecular weight: 50,000) | 3.7 parts |
| Charge transporting material having the following formula | 2.8 parts |

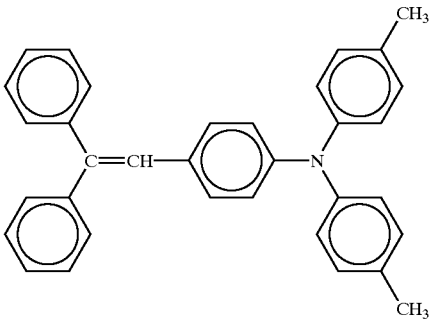

| | |
|---|---|
| α-Alumina (AA-07 manufactured by Sumitomo Chemical Company Ltd.) | 2.5 parts |
| Cyclohexanone | 80 parts |
| Tetrahydrofuran | 280 parts |

Each of the photoconductors obtained in Examples 6–8 was installed in a modified copier of a copier (IMAGIO MF2200 manufactured by Ricoh Company Ltd.), and images were continuously reproduced for 150,000 copies. The environmental conditions were 25° C. and 50% relative humidity. Image qualities of the final copies were visually evaluated. The copier used had a process cartridge having a charger, a developing unit, a cleaning unit and a photoconductor. The charger had a charging roller of a contact type. The results are shown in Table 5.

TABLE 5

| Example No. | Average particle diameter of α-alumina (μm) | D/H | Db/Da | Image quality of final copy |
|---|---|---|---|---|
| Example 6 | 0.4 | 1.0 | 4.8 | good |
| Example 7 | 0.4 | 3.2 | 5.1 | slight scars |
| Example 8 | 0.7 | 1.0 | 3.6 | slight scars |

The photoconductors of Examples 6–8 give an image having clear contrast and image density and no background fouling (fogging) even after production of 150,000 copies and, therefore, has surprisingly excellent durability. While the photoconductor of Example 6 has smooth surface, those of Examples 7 and 8 are slightly rough in touch. The reasons for this would be that the α-alumina used in Example 7 has inferior packing characteristics as compared with that of Example 6 and that large α-alumina particles of Example 8 protrude from the outwardly facing surface of the charge transporting layer. The results shown in Table 5 suggest that surface smoothness has an influence upon quality of images.

Example 9

The following undercoat layer coating liquid and photoconductive layer coating liquid were coated and dried one by one to overlay an undercoat layer of 3.5 μm thick and a filler-free photoconductive layer of 30 μm thick on an aluminum drum having a diameter of 30 mm. A coating liquid for forming an α-alumina filler-containing layer was prepared by dispersing a composition shown below with a ball mill for 24 hours using alumina balls. The coating liquid was spray-coated onto the photoconductive layer to form an α-alumina filler-containing photoconductive layer having a thickness of 1.5 μm, thereby obtaining a photoconductor of the present invention.

| [Undercoat layer coating liquid] | |
|---|---|
| Alkyd resin (Beckozol 1307-60-EL, manufactured by Dainippon Ink and Chemicals Inc.) | 6 parts |
| Melamine resin (Super Beckamine G-821-60, manufactured by Dainippon Ink and Chemicals Inc.) | 4 parts |
| Titanium oxide (manufactured by CR-EL Ishihara Sangyo Inc.) | 40 parts |
| Methyl ethyl ketone | 200 parts |
| [Filler-free photoconductive layer coating liquid] | |
| Polycarbonate resin (Bisphenol Z-type polycarbonate resin manufactured by Teijin Kasei Inc.; viscosity average molecular weight: 50,000) | 10 parts |
| Metal-free phthalocyanin (manufactured by Ricoh Company Ltd.) | 0.2 part |
| Charge transporting material having the following formula | 6 parts |

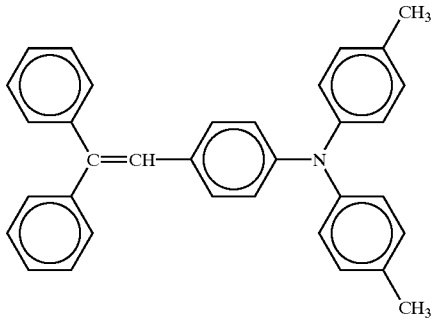

| | |
|---|---|
| Charge transporting material having the following formula | 4 parts |

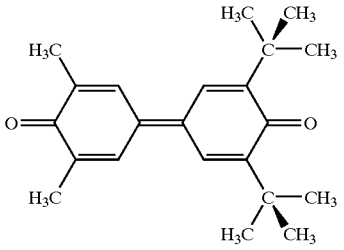

| | |
|---|---|
| Tetrahydrofuran | 100 parts |
| 1% Silicone oil tetrahydrofuran solution (KF50-100CS manufactured by Shin-etsu Chemical Industry Co., Ltd.) | 1 part |
| [Filler-containing photoconductive layer coating liquid] | |
| Polycarbonate resin (Bisphenol Z-type polycarbonate resin manufactured by Teijin Kasei Inc.; viscosity average molecular weight: 50,000) | 9 parts |
| Metal-free phthalocyanin (manufactured by Ricoh Company Ltd.) | 0.2 part |
| Charge transporting material having the following formula | 5.4 parts |

-continued

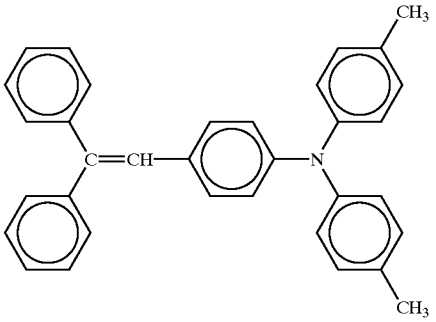

Charge transporting material having the following formula 3.6 parts

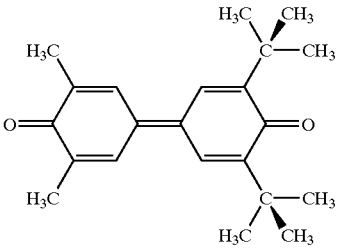

| | |
|---|---|
| α-Alumina (Sumicorundum AA-03 manufactured by Sumitomo Chemical Company Ltd.) | 2 parts |
| Cyclohexanone | 80 parts |
| Tetrahydrofuran | 280 parts |

Comparative Example 5

An electrophotoconductor for a comparative purpose was prepared in the same manner as described in Example 9 except that the filler-containing photoconductive layer was not formed.

Comparative Example 6

An electrophotoconductor for a comparative purpose was prepared in the same manner as described in Example 9 except that the filler-containing photoconductive layer coating liquid was substituted by the following protective layer coating liquid.

| [Protective layer coating liquid] | |
|---|---|
| Polycarbonate resin (Bisphenol Z-type polycarbonate resin manufactured by Teijin Kasei Inc.; viscosity average molecular weight: 50,000) | 18.2 parts |
| α-Alumina (Sumicorundum AA-03 manufactured by Sumitomo Chemical Company Ltd.) | 2 parts |
| Cyclohexanone | 80 parts |
| Tetrahydrofuran | 280 parts |

Comparative Example 7

An electrophotoconductor for a comparative purpose was prepared in the same manner as described in Example 9 except that the filler-containing photoconductive layer was not formed and that the filler-free photoconductive layer coating liquid was substituted by the following filler-containing photoconductive layer coating liquid.

| [Filler-containing photoconductive layer coating liquid] | |
|---|---|
| Polycarbonate resin (Bisphenol Z-type polycarbonate resin manufactured by Teijin Kasei Inc.; viscosity average molecular weight: 50,000) | 10 parts |
| Metal-free phthalocyanin (manufactured by Ricoh Company Ltd.) | 0.2 part |
| Charge transporting material having the following formula | 5.4 parts |

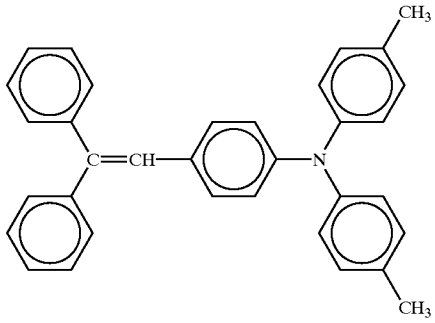

Charge transporting material having the following formula 3.6 parts

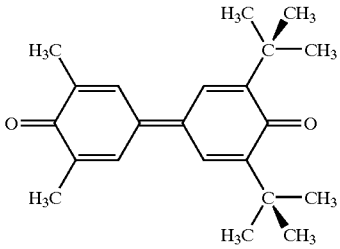

| | |
|---|---|
| α-Alumina (Sumicorundum AA-03 manufactured by Sumitomo Chemical Company Ltd.) | 2 parts |
| Tetrahydrofuran | 100 parts |
| 1% Silicone oil tetrahydrofuran solution (KF50-100 CS manufactured by Shin-etsu Chemical Industry Co., Ltd.) | 1 part |

Each of the photoconductors obtained in Example 9 and Comparative Examples 5–7 was installed in a modified copier of a copier (IMAGIO MF2200 manufactured by Ricoh Company Ltd.), and images were continuously reproduced for 50000 copies. The environmental conditions were 25° C. and 50% relative humidity. An amount of abrasion of each photoconductive layer was measured. Also, image qualities of the initial copy and the final copy were visually evaluated. The copier used had a process cartridge having a charger, a developing unit, a cleaning unit and a photoconductor. The charger had a charging roller of a contact type. The results are shown in Table 6.

TABLE 6

| Example No. | Abrasion Amount (μm) | Image quality Initial copy | Image quality Final copy |
|---|---|---|---|
| Example 9 | 4.9 | good | good |
| Comp. Ex. 5 | 8.1 | good | fogging |
| Comp. Ex. 6 | 2.3 | good | deformation of image |
| Comp. Ex. 7 | 3.3 | reduction of image density | reduction of imagedensity |

As is evident from the results shown in Table 6, the photoconductor of Example 1 having a photoconductive layer having an upper region including an outwardly facing surface and containing α-alumina of a hexagonal close-packed lattice crystal structure as a filler and a lower region contiguous with the upper region and having substantially no α-alumina gives an image having clear contrast and image density and no background fouling (fogging) even after repeated use and, therefore, shows good durability. In contrast, when α-alumina is incorporated into a surface protective layer formed above a photoconductive layer (Comparative Example 6), an abnormal image is formed after production of 50000 copies. Further, when α-alumina is uniformly incorporated into a photoconductive layer (Comparative Example 7), image density is reduced.

Example 10

The following undercoat layer coating liquid, charge generating layer coating liquid and charge transporting layer coating liquid were coated and dried one by one to overlay an undercoat layer of 3.5 μm thick, a charge generating layer of 0.2 μm thick and a charge transporting layer of 30 μm thick on an aluminum drum having a diameter of 30 mm. A coating liquid for forming an α-alumina filler-containing layer was prepared by dispersing a composition shown below with a ball mill for 24 hours using alumina balls. The coating liquid was spray-coated onto the charge transporting layer to form an α-alumina filler-containing layer having a thickness of 1.5 μm, thereby obtaining a photoconductor of the present invention.

[Undercoat layer coating liquid]

| | |
|---|---|
| Alkyd resin (Beckozol 1307-60-EL, manufactured by Dainippon Ink and Chemicals Inc.) | 6 parts |
| Melamine resin (Super Beckamine G-821-60, manufactured by Dainippon Ink and Chemicals, Inc.) | 4 parts |
| Titanium oxide (manufactured by CR-EL Ishihara Sangyo Inc.) | 40 parts |
| Methyl ethyl ketone | 200 parts |

[Charge generating layer coating liquid]

Bisazo pigment of the following formula — 2.5 parts

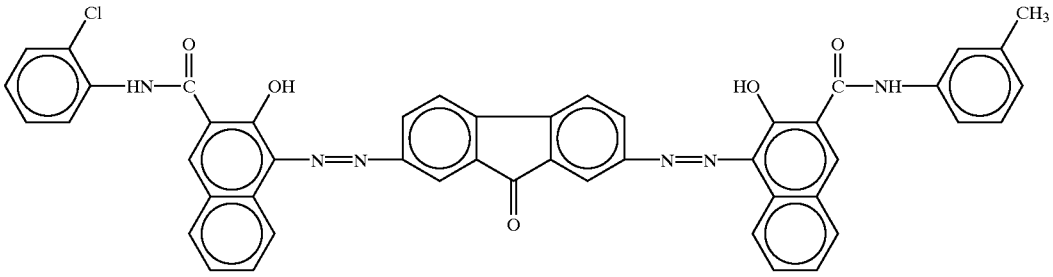

| | |
|---|---|
| Polyvinyl butyral resin (XYHL, manufactured by Union Carbide Corp.) | 0.25 part |
| Cyclohexanone | 200 parts |
| Methyl ethyl ketone | 80 parts |

[Filler-free charge transporting layer coating liquid]

| | |
|---|---|
| Polycarbonate resin (Bisphenol z-type polycarbonate resin manufactured by Teijin Kasei Inc.; viscosity average molecular weight: 50,000) | 12 parts |
| Charge transporting material having the following formula | 10 parts |

-continued

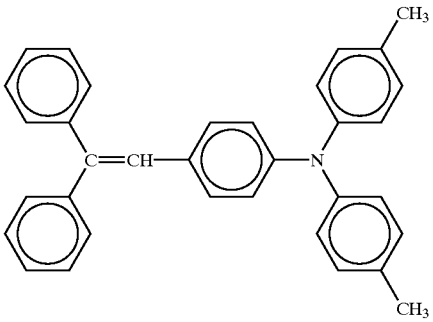

| | |
|---|---|
| Tetrahydrofuran | 100 parts |
| 1% Silicone oil tetrahydrofuran solution (KF50-100 CS manufactured by Shin-etsu Chemical Industry Co., Ltd.) | 1 part |

[Filler-containing charge transporting layer coating liquid]

| | |
|---|---|
| Polycarbonate resin (Bisphenol Z-type polycarbonate resin manufactured by Teijin Kasei Inc.; viscosity average molecular weight: 50,000) | 3.5 parts |
| Charge transporting material having the following formula | 2.45 parts |

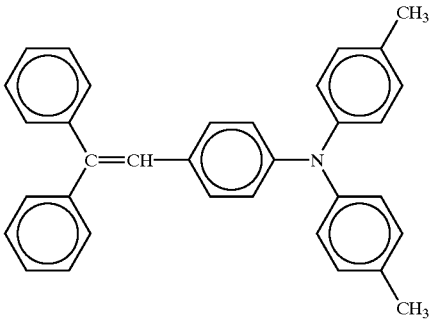

| | |
|---|---|
| α-Alumina (Sumicorundum AA-04 manufactured by Sumitomo Chemical Company Ltd.) | 1.5 parts |
| Cyclohexanone | 80 parts |
| Tetrahydrofuran | 280 parts |

Example 11

An electrophotoconductor was prepared in the same manner as described in Example 10 except that the charge transporting material used in the filler-containing charge transporting layer coating liquid in Example 10 was substituted by 2.45 parts of the following charge transporting material.

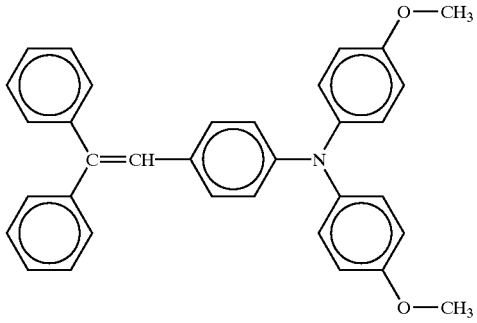

Example 12

An electrophotoconductor was prepared in the same manner as described in Example 10 except that the charge transporting material used in the filler-containing charge transporting layer coating liquid in Example 10 was substituted by 2.45 parts of the following charge transporting material.

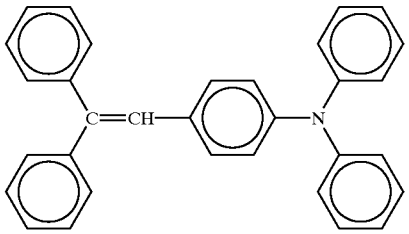

Each of the photoconductors obtained in Examples 10–12 was installed in a modified copier of a copier (IMAGIO MF2200 manufactured by Ricoh Company Ltd.), and images were continuously reproduced for 50000 copies. The environmental conditions were 27° C. and 62% relative humidity. Image qualities of the final copy were visually evaluated. Also measured was the electric potential of the light-exposed region after the test. The copier used had a process cartridge having a charger, a developing unit, a cleaning unit and a photoconductor. The charger had a charging roller of a contact type. The results are shown in Table 7 together with the ionization potential of the charge transporting material contained in the filler-containing charge transporting layer.

TABLE 7

| Example No. | Ionization potential (eV) | Image quality | Electric potential after test (−V) |
|---|---|---|---|
| Example 10 | 5.45 | good | 60 |
| Example 11 | 5.31 | good | 110 |
| Example 12 | 5.56 | good | 60 |

The ionization potential contained in the filler-free charge transporting layer was 5.48 eV. Thus, the difference in ionization potential between the charge transporting material contained in the filler-containing charge transporting layer is 0.03 eV in the case of Example 10, 0.17 eV in the case of Example 11 and 0.08 eV in the case of Example 12. From the results shown in Table 7, it will be appreciated that, when the charge transporting material in the filler-free charge transporting layer differs from that in the filler-containing charge transporting layer, the difference in ionization potential therebetween is desired for obtaining photoconductors having excellent electrostatic characteristics.

Example 13

An electrophotoconductor was prepared in the same manner as described in Example 10 except the filler-free charge transporting layer coating liquid used in Example 10 was substituted by the following filler-free charge transporting layer coating liquid.

[Filler-free charge transporting layer coating liquid]

Charge transporting polymer material having the following structure (weight average molecular weight: $9.8 \times 10^4$) — 12 parts

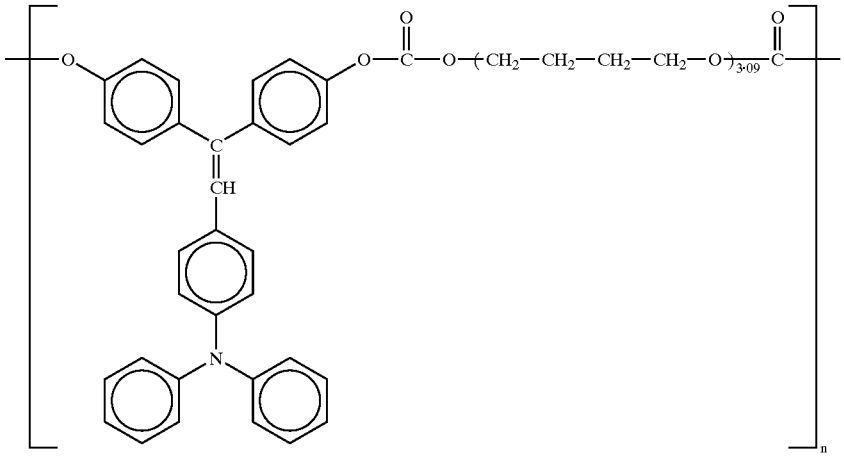

Low molecular weight charge transporting material having the following formula — 3 parts -continued

[Filler-free charge transporting layer coating liquid]

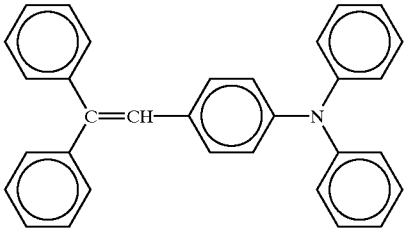

| | |
|---|---|
| Tetrahydrofuran | 180 parts |
| 1% Silicone oil tetrahydrofuran solution (KF50-100CS manufactured by Shin-etsu Chemical Industry Co., Ltd.) | 1 part |

Example 14

An electrophotoconductor was prepared in the same manner as described in Example 13 except that 3 parts of the following low molecular weight charge transporting material was used in lieu of the low molecular weight charge transporting material used in Example 13 in the filler-free charge transporting layer coating liquid.

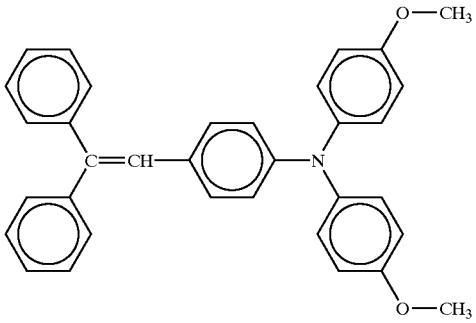

Example 15

An electrophotoconductor was prepared in the same manner as described in Example 10 except that the following filler-free charge transporting layer coating liquid was used in lieu of the filler-free charge transporting layer coating liquid in Example 10.

[Filler-free charge transporting layer coating liquid]

| | |
|---|---|
| Charge transporting polymer material having the following structure (weight average molecular weight: $9.8 \times 10^4$) | 15 parts |

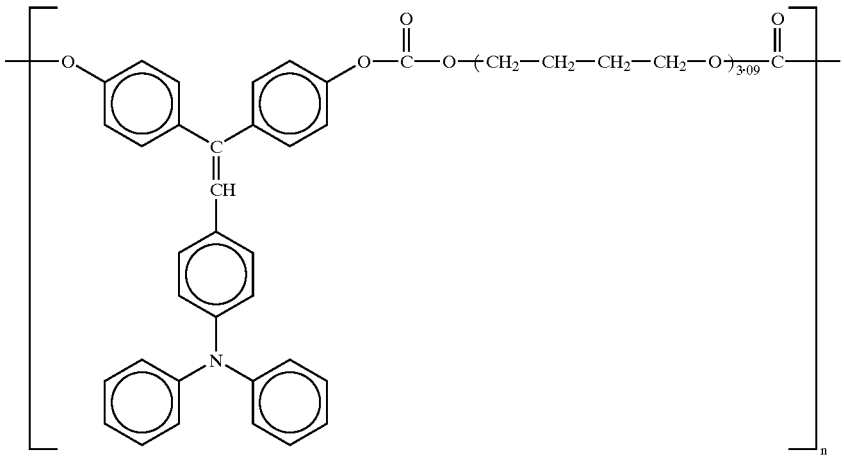

| | |
|---|---|
| Tetrahydrofuran | 180 parts |
| 1% Silicone oil tetrahydrofuran solution (KF50-100CS manufactured by Shin-etsu Chemical Industry Co., Ltd.) | 1 part |

Each of the photoconductors obtained in Examples 13–14 was installed in a modified copier of a copier (IMAGIO MF2200 manufactured by Ricoh Company Ltd.), and images were continuously reproduced for 50000 copies. The environmental conditions were 26° C. and 53% relative humidity. Image qualities of the final copy were visually evaluated. Also measured was the electric potential of the light-exposed region after the test. The copier used had a process cartridge having a charger, a developing unit, a cleaning unit and a photoconductor. The charger had a charging roller of a contact type. The results are shown in Table 8 together with the ionization potential of the charge transporting material contained in the filler-containing charge transporting layer.

TABLE 8

| Example No. | Ionization potential of charge transporting material (eV) | Image quality | Electric potential after test (−V) |
|---|---|---|---|
| Example 13 | 5.48 (polymer)<br>5.56 (low molecular weight) | good | 55 |
| Example 14 | 5.48 (polymer)<br>5.31 (low molecular weight) | good | 100 |
| Example 15 | 5.48 (polymer) | good | 60 |

The difference in ionization potential between the two charge transporting materials contained in the filler-free charge transporting layer is 0.8 eV in Example 13 and 0.17 eV in Example 14. The electric potential after the 50000 copying test in Example 13 is lower than that in Example 15 in which only one charge transporting material is used. In Example 14, however, the electric potential after the 50000 copying test is much higher than that in Example 15. From the results shown in Table 8, it will be appreciated that, when two charge transporting materials are used in a filler-free charge transporting layer, the difference in ionization potential therebetween is desired to be small for obtaining photoconductors having excellent electrostatic characteristics.

Example 16

The following undercoat layer coating liquid, charge generating layer coating liquid and charge transporting layer coating liquid were coated and dried one by one to overlay an undercoat layer of 3.5 μm thick, a charge generating layer of 0.2 μm thick and a charge transporting layer of 22 μm thick on an aluminum drum having a diameter of 30 mm. A coating liquid for forming an α-alumina filler-containing layer was prepared by dispersing a composition shown below with a ball mill for 24 hours using alumina balls. The binder resin and the charge transporting material were mixed with the α-alumina before the start of the dispersing with the ball mill. The coating liquid was spray-coated onto the charge transporting layer to form an α-alumina filler-containing layer having a thickness of 2.5 μm, thereby obtaining a photoconductor of the present invention.

[Undercoat layer coating liquid]

| | |
|---|---|
| Alkyd resin<br>(Beckozol 1307-60-EL, manufactured by Dainippon Ink and Chemicals Inc.) | 6 parts |
| Melamine resin<br>(Super Beckamine G-821-60, manufactured by Dainippon Ink and Chemicals Inc.) | 4 parts |
| Titanium oxide<br>(manufactured by CR-EL Ishihara Sangyo Inc.) | 40 parts |
| Methyl ethyl ketone | 200 parts |

[Charge generating layer coating liquid]

Bisazo pigment of the following formula 2.5 parts

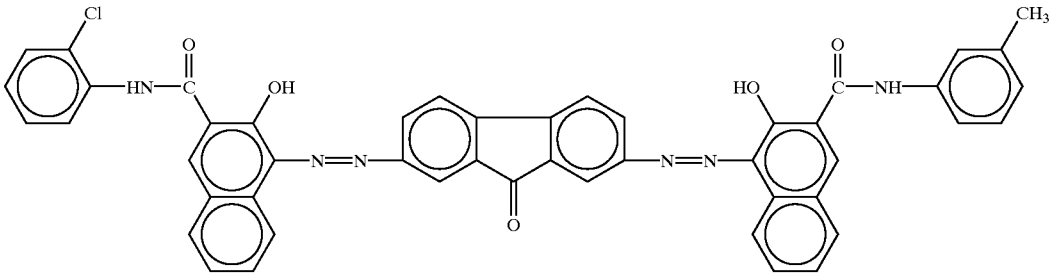

| | |
|---|---|
| Polyvinyl butyral resin<br>(XYHL, manufactured by Union Carbide Corp.) | 0.25 part |
| Cyclohexanone | 200 parts |
| Methyl ethyl ketone | 80 parts |

[Filler-free charge transporting layer coating liquid]

| | |
|---|---|
| Polycarbonate resin<br>(Bisphenol Z-type polycarbonate resin manufactured by Teijin Kasei Inc.; | 10 parts |

-continued

| | |
|---|---|
| viscosity average molecular weight: 50,000) | |
| Charge transporting material having the following formula | 7 parts |

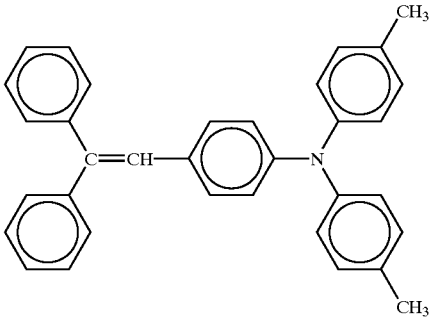

| | |
|---|---|
| Tetrahydrofuran | 100 parts |
| 1% Silicone oil tetrahydrofuran solution (KF50-100 CS manufactured by Shin-etsu Chemical Industry Co., Ltd.) | 1 part |

[Filler-containing charge transporting layer coating liquid]

| | |
|---|---|
| Polycarbonate resin (Bisphenol Z-type polycarbonate resin manufactured by Teijin Kasei Inc.; viscosity average molecular weight: 50,000) | 3.5 parts |
| Charge transporting material having the following formula | 2.45 parts |

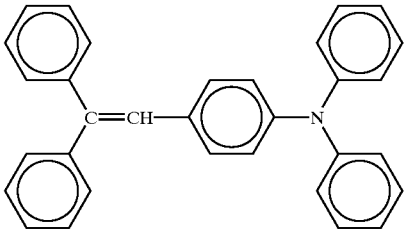

| | |
|---|---|
| α-Alumina (Sumicorundum AA-05 manufactured by Sumitomo Chemical Company Ltd.) | 1.5 parts |
| Cyclohexanone | 80 parts |
| Tetrahydrofuran | 280 parts |

Example 17

An electrophotoconductor was prepared in the same manner as described in Example 16 except the filler-free charge transporting layer coating liquid used in Example 16 was substituted by the following filler-free charge transporting layer coating liquid.

[Filler-free charge transporting layer coating liquid]

| | |
|---|---|
| Polycarbonate resin (Bisphenol Z-type polycarbonate resin manufactured by Teijin Kasei Inc.; viscosity average molecular weight: 50,000) | 10 parts |
| Low molecular weight charge transporting material having the following formula | 9 parts |

-continued

[Filler-free charge transporting layer coating liquid]

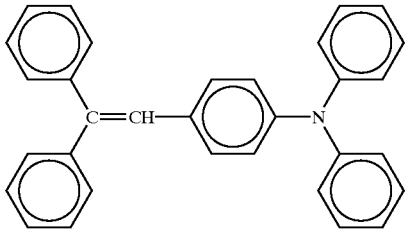

| | |
|---|---|
| Tetrahydrofuran | 100 parts |
| 1% Silicone oil tetrahydrofuran solution (KF50-100 CS manufactured by Shin-etsu Chemical Industry Co., Ltd.) | 1 part |

Example 18

An electrophotoconductor was prepared in the same manner as described in Example 16 except the filler-free charge transporting layer coating liquid used in Example 16 was substituted by the following filler-free charge transporting layer coating liquid.

| [Filler-free charge transporting layer coating liquid] | |
|---|---|
| Charge transporting polymer material having the following structure (weight average molecular weight: $9.8 \times 10^4$) | 15 parts |
| Tetrahydrofuran | 180 parts |
| 1% Silicone Oil tetrahydrofuran solution (KF50-100 CS manufactured by Shin-etsu Chemical Industry Co., Ltd.) | 1 part |

Example 19

An electrophotoconductor was prepared in the same manner as described in Example 16 except the filler-free charge transporting layer coating liquid used in Example 16 was substituted by the following filler-free charge transporting layer coating liquid.

| [Filler-free charge transporting layer coating liquid] | |
|---|---|
| Polycarbonate resin (Bisphenol Z-type polycarbonate resin manufactured by Teijin Kasei Inc.; viscosity average molecular weight: 50,000) | 10 parts |
| Low molecular weight charge transporting material having the following formula | 7 parts |

-continued

| [Filler-free charge transporting layer coating liquid] | |
|---|---|
| Tetrahydrofuran | 100 parts |
| 1% Silicone oil tetrahydrofuran solution (KF50-100 CS manufactured by Shin-etsu Chemical Industry Co., Ltd.) | 1 part |

Each of the photoconductors obtained in Examples 16–19 was installed in a modified copier of a copier (IMAGIO MF2200 manufactured by Ricoh Company Ltd.), and images were continuously reproduced for 50000 copies. The environmental conditions were 27° C. and 60% relative humidity. Image qualities with respect to resolution of the final copy were visually evaluated. The copier used had a process cartridge having a charger, a developing unit, a cleaning unit and a photoconductor. The charger had a charging roller of a contact type. The results are shown in Table 9 together with the charge mobility $\mu$ (electric field intensity: $4\times10^5$ V/cm) and electric field dependency $\beta$ ($=\log(\mu/E^{1/2})$ of the charge mobility the charge transporting layer.

TABLE 9

| Example No. | Charge mobility × $10^{-5}$ $cm^2/V \cdot sec$ | Electric field dependency × $10^{-3}$ | Evaluation of resolution |
|---|---|---|---|
| 16 | 1.6 | 1.1 | clear line images of 80 μm width and 100 μm width |
| 17 | 1.5 | 1.0 | clear line images of 80 μm width and 100 μm width |
| 18 | 2.9 | 1.4 | clear line images of 80 μm width and 100 μm width |
| 19 | 0.36 | 1.0 | clear line images of 100 μm width; line images of 80 μm width are slightly broadened |

The photoconductors of Examples 16–18 provide higher charge mobility and higher image resolution as compared with Example 19. Thus, photoconductors having a photoconductive layer showing high charge mobility can contribute to improving image forming speed and reducing the diameter of the photoconductor drum. A photoconductor in which the electric field dependency of the charge mobility is small can contribute to a reduction of residual potential and can permit reduction of charging potential while retaining good responsibility.

Example 20

The following undercoat layer coating liquid, charge generating layer coating liquid and charge transporting layer coating liquid were coated and dried one by one to overlay an undercoat layer of 3.5 μm thick, a charge generating layer of 0.2 μm thick and a charge transporting layer of 20 μm thick on an aluminum drum having a diameter of 30 mm. A coating liquid for forming an α-alumina filler-containing layer was prepared by dispersing a composition shown below with a ball mill for 24 hours using alumina balls. The coating liquid was spray-coated onto the charge transporting layer to form an α-alumina filler-containing layer having a thickness of 4.5 μm, thereby obtaining a photoconductor of the present invention.

[Undercoat layer coating liquid]

| | |
|---|---|
| Alkyd resin (Beckozol 1307-60-EL, manufactured by Dainippon Ink and Chemicals Inc.) | 6 parts |
| Melamine resin (Super Beckamine G-821-60, manufactured by Dainippon Ink and Chemicals Inc.) | 4 parts |
| Titanium oxide (manufactured by CR-EL Ishihara Sangyo Inc.) | 40 parts |
| Methyl ethyl ketone | 200 parts |

[Charge generating layer coating liquid]

Bisazo pigment of the following formula — 2.5 parts

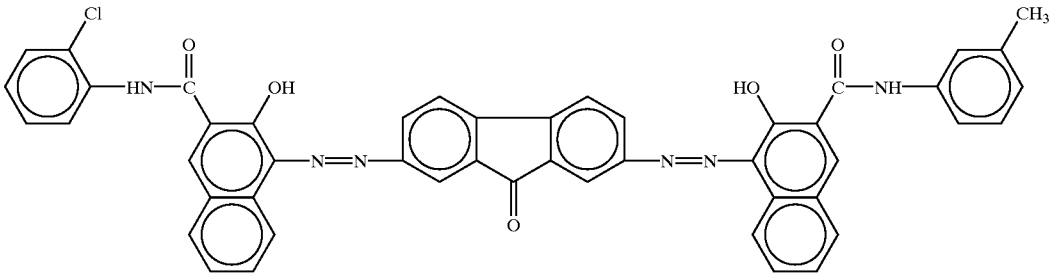

| | |
|---|---|
| Polyvinyl butyral resin (XYHL, manufactured by Union Carbide Corp.) | 0.25 part |
| Cyclohexanone | 200 parts |
| Methyl ethyl ketone | 80 parts |

[Filler-free charge transporting layer coating liquid]

| | |
|---|---|
| Polycarbonate resin (Bisphenol Z-type polycarbonate resin manufactured by Teijin Kasei Inc.; viscosity average molecular weight: 50,000) | 10 parts |
| Charge transporting material having the following formula | 10 parts |

-continued

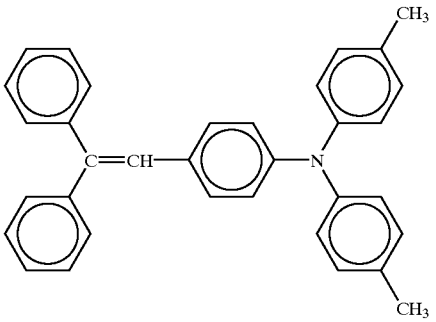

| | |
|---|---|
| Tetrahydrofuran | 100 parts |
| 1% Silicone oil tetrahydrofuran solution (KF50-100 CS manufactured by Shin-etsu Chemical Industry Co., Ltd.) | 1 part |

[Filler-containing charge transporting layer coating liquid]

| | |
|---|---|
| Polycarbonate resin (Bisphenol Z-type polycarbonate resin manufactured by Teijin Kasei Inc.; viscosity average molecular weight: 50,000) | 3.5 parts |
| Charge transporting material having the following formula | 2.45 parts |

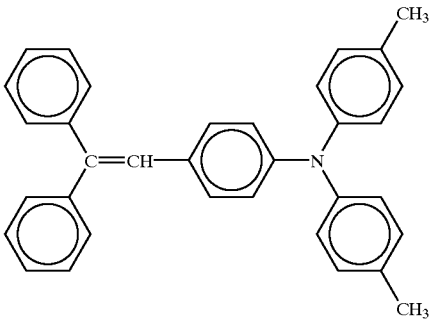

| | |
|---|---|
| α-Alumina (Sumicorundum AA-05 manufactured by Sumitomo Chemical Company Ltd.) | 1.5 parts |
| Electric resistance reducing agent (BYK-P105 manufactured by Bigchemi Inc.) | 0.015 part |
| Cyclohexanone | 80 parts |
| Tetrahydrofuran | 280 parts |

The thus obtained photoconductor was installed in a modified copier of a copier (IMAGIO MF2200 manufactured by Ricoh Company Ltd.), and images were continuously reproduced for 100,000 copies. The environmental conditions were 23° C. and 67% relative humidity. Image qualities of the final copy were visually evaluated. The copier used had a scorotron charger. Practically acceptable quality images were obtained, though slight background steins were observed.

Example 21

Example 20 was repeated in the same manner as described except that a charger roller was substituted for the scorotron charger. The charger roller was disposed for rolling contact with the photoconductor. The charging was performed at a DC voltage of −1500 V. Good quality images were obtained up to about 50000 copies. Slight background steins (attributed to fouling of the charger roller by toner filming) began occurring when the copy number increased more than 50000. Odors attributed to the generation of ozone were much reduced as compared with Example 20.

Example 22

Example 21 was repeated in the same manner as described except that the charger roller was provided with a pair of spacer rings each made of an insulation tape having a thickness of 50 μm and a width of 5 mm and attached to opposite ends of the roller, so that a gap of 50 μm was defined between the photoconductor surface and the charger roller surface. No background steins attributed to the fouling of the charger roller were observed. However, slightly non-uniform images were produced in half tone images when the copy number exceeded 50000.

Example 23

Example 22 was repeated in the same manner as described except that the charging was performed at a DC voltage of −850 V while superimposing AC voltage of 1.7 kV (voltage between peaks) with a frequency of 2 kHz. Good quality images were obtained in the 50000th copy. Neither fouling of the charger roller nor half tone steins were observed.

Each of the photoconductors obtained in Examples 1–8 and 10–23 (which had a filler-containing charge transporting layer) was measured for SEM photographs at 2000 magnification. The thickness was measured at 20 different locations spaced equidistant from each other with an equidistance spacing of 5 μm on the SEM photograph of a cross-section of the photoconductive layer. The average thickness which represents the depth or thickness of the filler-containing charge transporting layer and the andard deviation of measured thickness values relative the average are shown in Table 10. Each of the filler-ntaining charge transporting layer coating liquids for the above photoconductors was measured for the weight W1 a coating of the coating liquid 1 hour after completion the coating and the weight Wd of the coating after ing completely dried with heating. The W1/Wd was found satisfy the following relationship:

$$1.2<W1/Wd<2.0.$$

drying was at 150° C. for 30 minutes. The conditions under which the coatings were allowed stand were 23° C., 35% relative humidity and in the dark.

TABLE 10

| Example No. | Average (μm) | Standard deviation | W1/Wd |
|---|---|---|---|
| 1 | 1.5 | 0.15 | 1.7 |
| 2 | 1.5 | 0.15 | 1.7 |
| 3 | 1.5 | 0.15 | 1.7 |
| 4 | 2.0 | 0.21 | 1.8 |
| 5 | 2.0 | 0.21 | 1.8 |
| 6 | 1.5 | 0.15 | 1.7 |
| 7 | 1.5 | 0.29 | 1.6 |
| 8 | 1.5 | 0.29 | 1.7 |

TABLE 10-continued

| Example No. | Average (μm) | Standard deviation | W1/Wd |
|---|---|---|---|
| 10 | 1.5 | 0.21 | 1.7 |
| 11 | 1.5 | 0.21 | 1.7 |
| 12 | 1.5 | 0.21 | 1.7 |
| 13 | 1.5 | 0.18 | 1.7 |
| 14 | 1.5 | 0.21 | 1.6 |
| 15 | 1.5 | 0.16 | 1.8 |
| 16 | 2.5 | 0.38 | 1.8 |
| 17 | 2.5 | 0.38 | 1.8 |
| 18 | 2.5 | 0.35 | 1.8 |
| 19 | 2.5 | 0.38 | 1.8 |
| 20 | 4.5 | 0.60 | 1.8 |
| 21 | 4.5 | 0.60 | 1.8 |
| 22 | 4.5 | 0.60 | 1.8 |
| 23 | 4.5 | 0.60 | 1.8 |

The filler-containing charge transporting layers of the photoconductors of the above examples and comparative examples have uniform thickness. No delamination of the filler-containing charge transporting layer was observed during the repeated copying tests.

Example 24

The following undercoat layer coating liquid, charge generating layer coating liquid and charge transporting layer coating liquid were coated and dried one by one to overlay an undercoat layer of 3.5 μm thick, a charge generating layer of 0.2 μm thick and a charge transporting layer of 22 μm thick on an aluminum drum having a diameter of 90 mm. A coating liquid for forming an α-alumina filler-containing layer was prepared by dispersing a composition shown below with a ball mill for 24 hours using alumina balls. The coating liquid was spray-coated onto the charge transporting layer to form an α-alumina filler-containing layer having a thickness of 4.0 μm, thereby obtaining a photoconductor of the present invention.

| | |
|---|---|
| [Undercoat layer coating liquid] | |
| Alkyd resin (Beckozol 1307-60-EL, manufactured by Dainippon Ink and Chemicals Inc.) | 6 parts |
| Melamine resin (Super Beckamine G-821-60, manufactured by Dainippon Ink and Chemicals Inc.) | 4 parts |
| Titanium oxide (manufactured by CR-EL Ishihara Sangyo Inc.) | 40 parts |
| Methyl ethyl ketone | 200 parts |
| [Charge generating layer coating liquid] | |
| Trisazo pigment having a structure shown below | 2.5 parts |

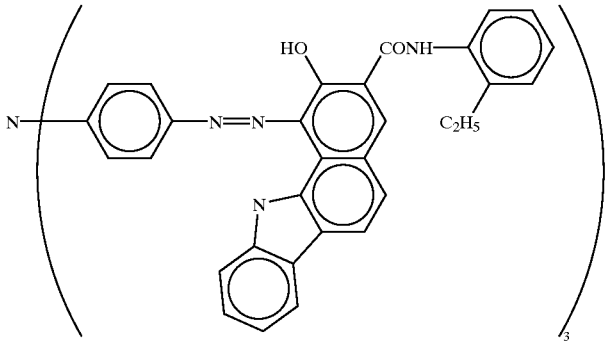

-continued

| | |
|---|---|
| Polyvinyl butyral resin (XYHL, manufactured by Union Carbide Corp.) | 0.25 part |
| Cyclohexanone | 200 parts |
| Methyl ethyl ketone | 80 parts |
| [Filler-free charge transporting layer coating liquid] | |
| Polycarbonate resin (Bisphenol Z-type polycarbonate resin manufactured by Teijin Kasei Inc.; viscosity average molecular weight: 50,000) | 10 parts |
| Charge transporting material having the following formula | 10 parts |

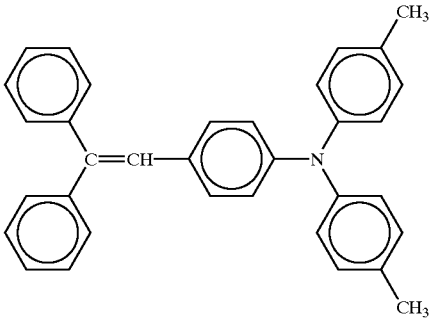

| | |
|---|---|
| Tetrahydrofuran | 100 parts |
| 1% Silicone oil tetrahydrofuran solution (KF50-100CS manufactured by Shin-etsu Chemical Industry Co., Ltd.) | 1 part |
| [Filler-containing charge transporting layer coating liquid] | |
| Polycarbonate resin (Bisphenol Z-type polycarbonate resin manufactured by Teijin Kasei Inc.; viscosity average molecular weight: 40,000) | 4 parts |
| Charge transporting material having the following formula | 3 parts |

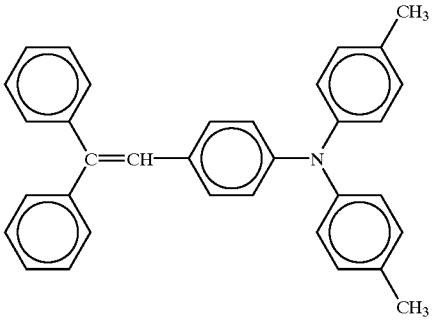

| | |
|---|---|
| α-Alumina (Sumicorundum AA-03 manufactured by Sumitomo Chemical Company Ltd.) | 0.7 part |
| Cyclohexanone | 80 parts |
| Tetrahydrofuran | 280 parts |

Comparative Example 8

An electrophotoconductor for a comparative purpose was prepared in the same manner as described in Example 24 except that the filler-containing charge transporting layer was not formed.

Comparative Example 9

An electrophotoconductor for a comparative purpose was prepared in the same manner as described in Example 24 except that the filler-containing charge transporting layer coating liquid was substituted by the following protective layer coating liquid.

| [Protective layer coating liquid] | |
|---|---|
| Polycarbonate resin (Bisphenol Z-type polycarbonate resin manufactured by Teijin Kasei Inc.; viscosity average molecular weight: 50,000) | 7 parts |
| α-Alumina (Sumicorundum AA-03 manufactured by Sumitomo Chemical Company Ltd.) | 0.7 part |
| Cyclohexanone | 86 parts |
| Tetrahydrofuran | 300 parts |

Comparative Example 10

An electrophotoconductor for a comparative purpose was prepared in the same manner as described in Example 24 except that the filler-containing charge transporting layer was not formed and that the filler-free charge transporting layer coating liquid was substituted by the following filler-containing charge transporting layer coating liquid.

| [Filler-containing charge transporting layer coating liquid] | |
|---|---|
| Polycarbonate resin (Bisphenol Z-type polycarbonate resin manufactured by Teijin Kasei Inc.; viscosity average molecular weight: 50,000) | 11 parts |
| Charge transporting material having the following formula | 10 parts |

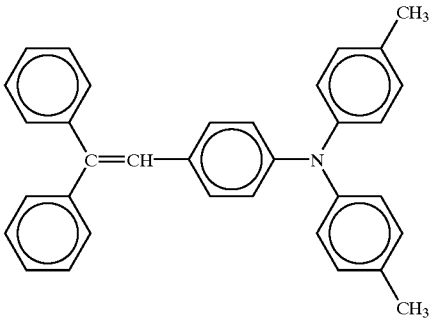

| | |
|---|---|
| α-Alumina (Sumicorundum AA-03 manufactured by Sumitomo Chemical Company Ltd.) | 2 parts |
| Tetrahydrofuran | 100 parts |
| 1% Silicone oil tetrahydrofuran solution (KF50-100CS manufactured by Shin-etsu Chemical Industry Co., Ltd.) | 1 part |

Comparative Example 11

An electrophotoconductor for a comparative purpose was prepared in the same manner as described in Example 24 except that the filler-containing charge transporting layer coating liquid was substituted by the following filler-containing charge transporting layer coating liquid.

| [Filler-containing charge transporting layer coating liquid] | |
|---|---|
| Polycarbonate resin (Bisphenol Z-type polycarbonate resin manufactured by Teijin Kasei Inc.; viscosity average molecular weight: 50,000) | 4 parts |
| Charge transporting material having the following formula | 3 parts |

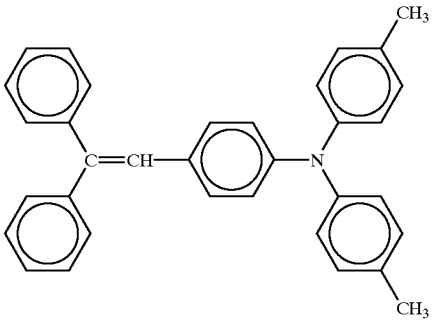

| | |
|---|---|
| θ-Alumina (AKP-G008 manufactured by Sumitomo Chemical Company Ltd.) | 0.7 part |
| Cyclohexanone | 80 parts |
| Tetrahydrofuran | 280 parts |

Each of the photoconductors obtained in Example 24 and Comparative Examples 8–11 was installed in a modified copier of a copier (IMAGIO COLOR 4000 manufactured by Ricoh Company Ltd.), and images of yellow, magenta and cyan colors each occupying 5% of the area were continuously reproduced for 50000 copies. The environmental conditions were 30° C. and 65% relative humidity. The copier had a charger roller provided with a pair of spacer rings each made of an insulation tape having a thickness of 50 μm and a width of 5 mm and attached to opposite ends of the roller, so that a gap of 50 μm was defined between the photoconductor surface and the charger roller surface. The charging was performed at a DC voltage of −700 V while superimposing AC voltage of 1.5 kV (voltage between peaks) with a frequency of 2 kHz. The final copy was evaluated for image quality with respect to resolution and absence of abnormal images. Also measured were amount of abrasion and appearance of the photoconductive layer after termination of the test. The results are summarized in Table 11.

TABLE 11

| Example No. | Abrasion Amount (μm) | Resolution | Abnormal image | Appearance of photo-conductor |
|---|---|---|---|---|
| Example 24 | 3.16 | clear line image of line width of 30 μm in all colors | almost no abnormity | no abnormity |
| Comp. Ex. 8 | 5.1 | clear line image of line width of 30 μm in all colors, but many noises exist | abnormal images and background stains of cyan and magenta | streaks of scars throughout the surface |
| Comp. Ex. 9 | 0.60 | clear line image of line width of only 60 μm or more in all colors | unclear half tone dott images and abnormal images | toner filming |
| Comp. Ex. 10 | 1.13 | clear line image of line width of 30 μm in all colors | low image density | no abnormity |
| Comp. Ex. 11 | 3.90 | clear line image of line width of only 60 μm or more in all colors | unclear half tone dott images, abnormal images and low image density | streaks of scars throughout the surface |

As is evident from the results shown in Table 11, the photoconductor of Example 24 having a photoconductive layer composed of an upper region including an outwardly facing surface and containing α-alumina and a lower region contiguous with the upper region and having substantially no α-alumina gives an image having clear contrast and image density and no fogging even after repeated use and, therefore, shows good durability. In contrast, no filler is present (Comparative Example 8), the abrasion of the photoconductive layer is so significant that considerable fogging and formation of abnormal images are caused. Since background steins occur with every color, degradation of images is much more significant in color images than monochromatic images. When α-alumina is incorporated into a surface protective layer formed above a photoconductive layer (Comparative Example 9), an abnormal image is formed after production of 50000 copies. Further, when α-alumina is uniformly incorporated into a charge transporting layer (Comparative Example 10), image density is reduced. When θ-alumina is substituted for α-alumina (Comparative Example 10), the durability is no good.

Example 25

The following undercoat layer coating liquid, charge generating layer coating liquid and charge transporting layer coating liquid were coated and dried one by one to overlay an undercoat layer of 3.5 μm thick, a charge generating layer of 0.2 μm thick and a charge transporting layer of 22 μm thick on an aluminum drum having a diameter of 60 mm. A coating liquid for forming an α-alumina filler-containing layer was prepared by dispersing a composition shown below with a ball mill for 24 hours using alumina balls. The coating liquid was spray-coated onto the charge transporting layer to form an α-alumina filler-containing layer having a thickness of 4.5 μm, thereby obtaining a photoconductor of the present invention.

[Undercoat layer coating liquid]

| | |
|---|---|
| Alkyd resin (Beckozol 1307-60-EL, manufactured by Dainippon Ink and Chemicals Inc.) | 6 parts |
| Melamine resin (Super Beckamine G-821-60, manufactured by Dainippon Ink and Chemicals Inc.) | 4 parts |
| Titanium oxide (manufactured by CR-EL Ishihara Sangyo Inc.) | 40 parts |
| Methyl ethyl ketone | 200 parts |

[Charge generating layer coating liquid]

| | |
|---|---|
| Trisazo pigment having a structure shown below | 2.5 parts |

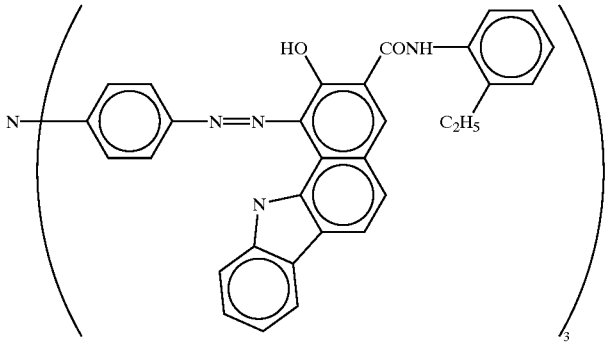

| | |
|---|---|
| Polyvinyl butyral resin (XYHL, manufactured by Union Carbide Corp.) | 0.25 part |
| Cyclohexanone | 200 parts |
| Methyl ethyl ketone | 80 parts |

[Filler-free charge transporting layer coating liquid]

| | |
|---|---|
| Polycarbonate resin (Bisphenol Z-type polycarbonate resin manufactured by Teijin Kasei Inc.; viscosity average molecular weight: 40,000) | 10 parts |
| Charge transporting material having the following formula | 10 parts |

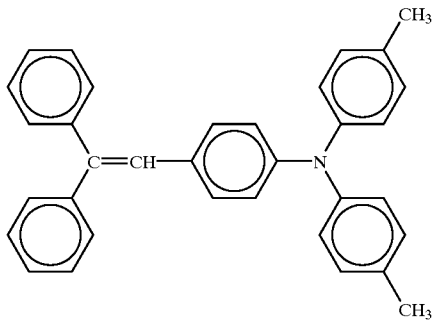

| | |
|---|---|
| Tetrahydrofuran | 100 parts |
| 1% Silicone oil tetrahydrofuran solution (KF50-100CS manufactured by Shin-etsu Chemical Industry Co., Ltd.) | 1 part |

[Filler-containing charge transporting layer coating liquid]

| | |
|---|---|
| Polycarbonate resin (Bisphenol Z-type polycarbonate resin manufactured by Teijin Kasei Inc.; viscosity average molecular weight: 40,000) | 4 parts |
| Charge transporting material having the following formula | 3 parts |

-continued

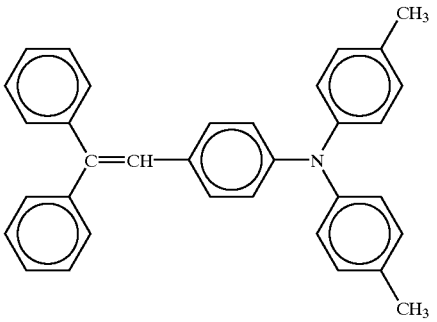

| | |
|---|---|
| α-Alumina (Sumicorundum AA-03 manufactured by Sumitomo Chemical Company Ltd.) | 0.7 part |
| Cyclohexanone | 80 parts |
| Tetrahydrofuran | 280 parts |

Comparative Example 12

An electrophotoconductor for a comparative purpose was prepared in the same manner as described in Example 25 except that the filler-containing charge transporting layer was not formed.

Comparative Example 13

An electrophotoconductor for a comparative purpose was prepared in the same manner as described in Example 25 except that the filler-containing charge transporting layer coating liquid was substituted by the following protective layer coating liquid.

| [Protective layer coating liquid] | |
|---|---|
| Polycarbonate resin (Bisphenol Z-type polycarbonate resin manufactured by Teijin Kasei Inc.; viscosity average molecular weight: 50,000) | 7 parts |
| α-Alumina (Sumicorundum AA-04 manufactured by Sumitomo Chemical Company Ltd.) | 0.7 part |
| Cyclohexanone | 86 parts |
| Tetrahydrofuran | 300 parts |

Comparative Example 14

An electrophotoconductor for a comparative purpose was prepared in the same manner as described in Example 25 except that the filler-containing charge transporting layer was not formed and that the filler-free charge transporting layer coating liquid was substituted by the following filler-containing charge transporting layer coating liquid.

| [Filler-containing charge transporting layer coating liquid] | |
|---|---|
| Polycarbonate resin (Bisphenol Z-type polycarbonate resin manufactured by Teijin Kasei Inc.; viscosity average molecular weight: 50,000) | 11 parts |
| Charge transporting material having the following formula | 10 parts |

-continued

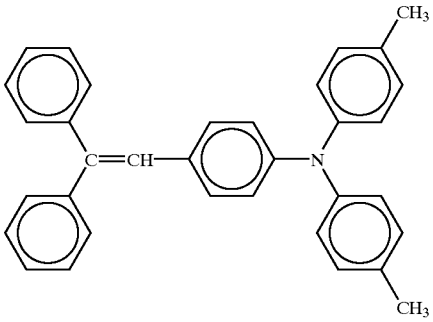

| | |
|---|---|
| α-Alumina (Sumicorundum AA-03 manufactured by Sumitomo Chemical Company Ltd.) | 2 parts |
| Tetrahydrofuran | 100 parts |
| 1% Silicone oil tetrahydrofuran solution (KF50-100CS manufactured by Shin-etsu Chemical Industry Co., Ltd.) | 1 part |

Comparative Example 15

An electrophotoconductor for a comparative purpose was prepared in the same manner as described in Example 25 except that the filler-containing charge transporting layer coating liquid was substituted by the following filler-containing charge transporting layer coating liquid.

| [Filler-containing charge transporting layer coating liquid] | |
|---|---|
| Polycarbonate resin (Bisphenol Z-type polycarbonate resin manufactured by Teijin Kasei Inc.; viscosity average molecular weight: 50,000) | 4 parts |
| Charge transporting material having the following formula | 3 parts |

-continued

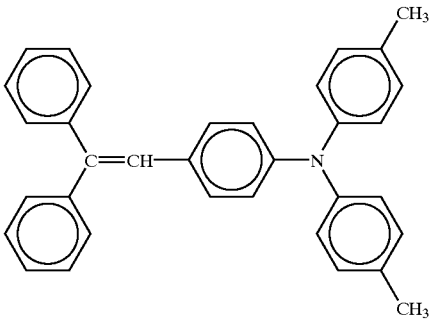

| | |
|---|---|
| γ-Alumina (AKP-G015 manufactured by Sumitomo Chemical Company Ltd.) | 0.7 part |
| Cyclohexanone | 80 parts |
| Tetrahydrofuran | 280 parts |

Each of the photoconductors obtained in Example 25 and Comparative Examples 12–15 was installed in each of the black, yellow, magenta and cyan stations of a modified copier of a tandem-type copier (PRETER 750 manufactured by Ricoh Company Ltd.), and images of black, yellow, magenta and cyan colors each occupying 5% of the area were continuously reproduced for 200,000 copies. The environmental conditions were 30° C. and 65% relative humidity. The copier had a charger roller provided with a pair of spacer rings each made of an insulation tape having a thickness of 50 μm and a width of 5 mm and attached to opposite ends of the roller, so that a gap of 50 μm was defined between the photoconductor surface and the charger roller surface. The charging was performed at a DC voltage of −700 V while superimposing AC voltage of 1.5 kV (voltage between peaks) with a frequency of 2 kHz. The final copy was evaluated for image quality with respect to resolution and absence of abnormal images. Also measured were amount of abrasion and appearance of the photoconductive layer used in the magenta station after termination of the test. The results are summarized in Table 12.

TABLE 12

| Example No. | Abrasion Amount (μm) | Resolution | Abnormal image | Appearance of photo-conductor |
|---|---|---|---|---|
| Example 25 | 3.50 | clear line image of line width of 30 μm in all colors | almost no abnormity | no abnormity |
| Comp. Ex. 12 | 6.00 | clear line image of line width of 30 μm in all colors, but many noises exist | abnormal images and background stains of black, cyan and magenta | streaks of scars throughout the surface |
| Comp. Ex. 13 | 1.00 | clear line image of line width of only 60 μm or more in all colors | unclear half tone dott images and abnormal images | toner filming |

TABLE 12-continued

| Example No. | Abrasion Amount (μm) | Resolution | Abnormal image | Appearance of photo-conductor |
|---|---|---|---|---|
| Comp. Ex. 14 | 1.66 | clear line image of line width of 30 μm in all colors | low image density | no abnormity |
| Comp. Ex. 15 | 4.50 | clear line image of line width of only 60 μm or more in all colors | unclear half tone dott images, abnormal images and low image density | streaks of scars throughout the surface |

As is evident from the results shown in Table 12, the photoconductor of Example 25 having a photoconductive layer composed of an upper region including an outwardly facing surface and containing α-alumina and a lower region contiguous with the upper region and having substantially no α-alumina gives an image having clear contrast and image density and no fogging even after repeated use and, therefore, shows good durability. In contrast, no filler is present (Comparative Example 12), the abrasion of the photoconductive layer is so significant that considerable fogging and formation of abnormal images are caused. Since background steins occur with every color, degradation of images is much more significant in color images than monochromatic images. When α-alumina is incorporated into a surface protective layer formed above a photoconductive layer (Comparative Example 13), an abnormal image is formed after production of 50000 copies. Further, when α-alumina is uniformly incorporated into a charge transporting layer (Comparative Example 14), image density is reduced. When γ-alumina is substituted for α-alumina (Comparative Example 14), the durability is no good.

Example 26

The following undercoat layer coating liquid, charge generating layer coating liquid and charge transporting layer coating liquid were coated and dried one by one to overlay an undercoat layer of 3.5 μm thick, a charge generating layer of 0.2 μm thick and a charge transporting layer of 23 μm thick on an aluminum drum having a diameter of 60 mm. A coating liquid for forming an α-alumina filler-containing layer was prepared by dispersing a composition shown below with a ball mill for 24 hours using alumina balls. The coating liquid was spray-coated onto the charge transporting layer to form an α-alumina filler-containing layer having a thickness of 4.5 μm, thereby obtaining a photoconductor of the present invention.

[Undercoat layer coating liquid]

| | |
|---|---|
| Alkyd resin (Beckozol 1307-60-EL, manufactured by Dainippon Ink and Chemicals Inc.) | 6 parts |
| Melamine resin (Super Beckamine G-821-60, manufactured by Dainippon Ink and Chemicals Inc.) | 4 parts |
| Titanium oxide (manufactured by CR-EL Ishihara Sangyo Inc.) | 40 parts |
| Methyl ethyl ketone | 200 parts |

[Charge generating layer coating liquid]

Bisazo pigment of the following formula 2.5 parts

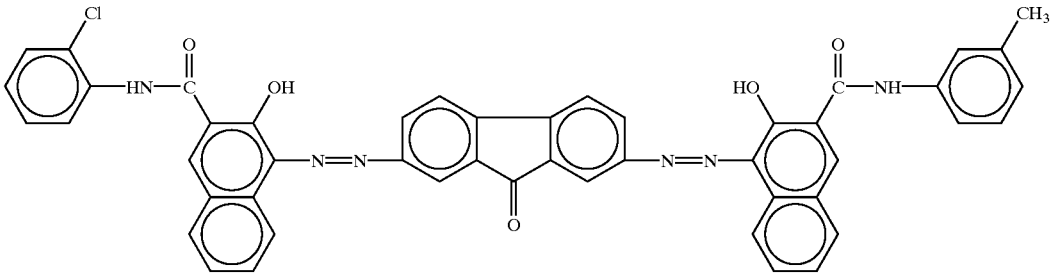

| | |
|---|---|
| Polyvinyl butyral resin (XYHL, manufactured by Union Carbide Corp.) | 0.25 part |
| Cyclohexanone | 200 parts |
| Methyl ethyl ketone | 80 parts |

[Filler-free charge transporting layer coating liquid]

| | |
|---|---|
| Polycarbonate resin (Bisphenol Z-type polycarbonate resin manufactured by Teijin Kasei Inc.; viscosity average molecular weight: 50,000) | 12 parts |
| Charge transporting material having the following formula | 10 parts |

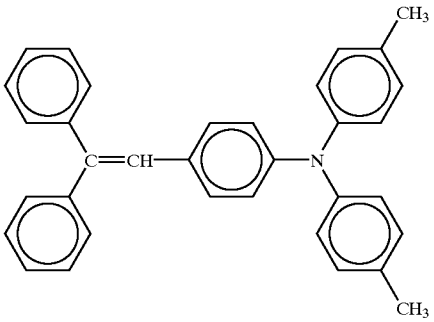

| | |
|---|---|
| Tetrahydrofuran | 100 parts |
| 1% Silicone oil tetrahydrofuran solution (KF50-100CS manufactured by Shin-etsu Chemical Industry Co., Ltd.) | 1 part |

[Filler-containing charge transporting layer coating liquid]

| | |
|---|---|
| Polycarbonate resin (Bisphenol Z-type polycarbonate resin manufactured by Teijin Kasei Inc.; viscosity average molecular weight: 50,000) | 3.5 parts |
| Charge transporting material having the following formula | 2.45 parts |

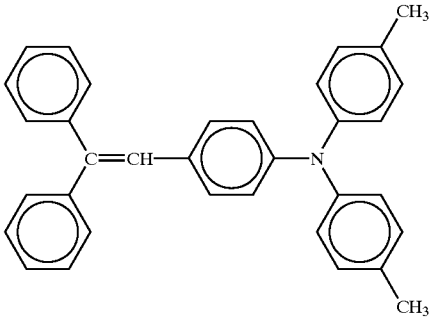

| | |
|---|---|
| α-Alumina (Sumicorundum AA-05 manufactured by Sumitomo Chemical Company Ltd.) | 1.5 parts |
| Cyclohexanone | 80 parts |
| Tetrahydrofuran | 280 parts |

Example 27

An electrophotoconductor was prepared in the same manner as described in Example 26 except that the charge transporting material used in the filler-containing charge transporting layer coating liquid in Example 10 was substituted by 2.45 parts of the following charge transporting material.

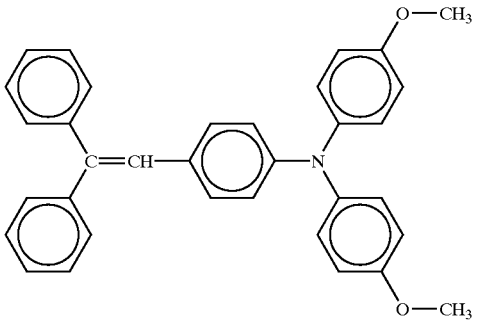

Example 28

An electrophotoconductor was prepared in the same manner as described in Example 26 except that the charge transporting material used in the filler-containing charge transporting layer coating liquid in Example 28 was substituted by 2.45 parts of the following charge transporting material.

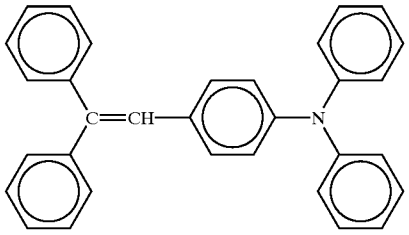

Each of the photoconductors obtained in Examples 26–28 was installed in each of the black, yellow, magenta and cyan stations of a modified copier of a tandem-type copier (PRETER 750 manufactured by Ricoh Company Ltd.), and images of black, yellow, magenta and cyan colors each occupying 5% of the area were continuously reproduced for 200,000 copies. The environmental conditions were 24° C. and 50% relative humidity. The copier had a charger roller provided with a pair of spacer rings each made of an insulation tape having a thickness of 50 μm and a width of 5 mm and attached to opposite ends of the roller, so that a gap of 50 μm was defined between the photoconductor surface and the charger roller surface. The charging was performed at a DC voltage of −700 V while superimposing AC voltage of 1.5 kV (voltage between peaks) with a frequency of 2 kHz. An LD unit of 655 nm was used in an exposure unit. Electric potential of the light-exposed region of the photoconductor used in the magenta station before and after the test was measured. Also measured was ionization potential of the photoconductive material contained in the filler-free and filler-containing charge transporting layers. The results are shown in Table 13.

TABLE 13

| Example No. | Ionization potential (eV) | Electric potential before test (-V) | Electric potential after test (-V) |
|---|---|---|---|
| 26 | 5.45 | 65 | 90 |
| 27 | 5.31 | 110 | 140 |
| 28 | 5.56 | 60 | 90 |

The ionization potential contained in the filler-free charge transporting layer was 5.48 eV. Thus, the difference in ionization potential between the charge transporting material contained in the filler-containing charge transporting layer is 0.03 eV in the case of Example 26, 0.17 eV in the case of Example 27 and 0.08 eV in the case of Example 28. From the results shown in Table 13, it will be appreciated that, when the charge transporting material in the filler-free charge transporting layer differs from that in the filler-containing charge transporting layer, the difference in ionization potential therebetween is desired for obtaining photoconductors having excellent electrostatic characteristics.

Example 29

An electrophotoconductor was prepared in the same manner as described in Example 26 except the filler-containing charge transporting layer coating liquid used in Example 26 was substituted by the following filler-containing charge transporting layer coating liquid.

[Filler-containing charge transporting layer coating liquid]

| | |
|---|---|
| Charge transporting polymer material having the following structure (weight average molecular weight: $9.8 \times 10^4$) | 3.5 parts |

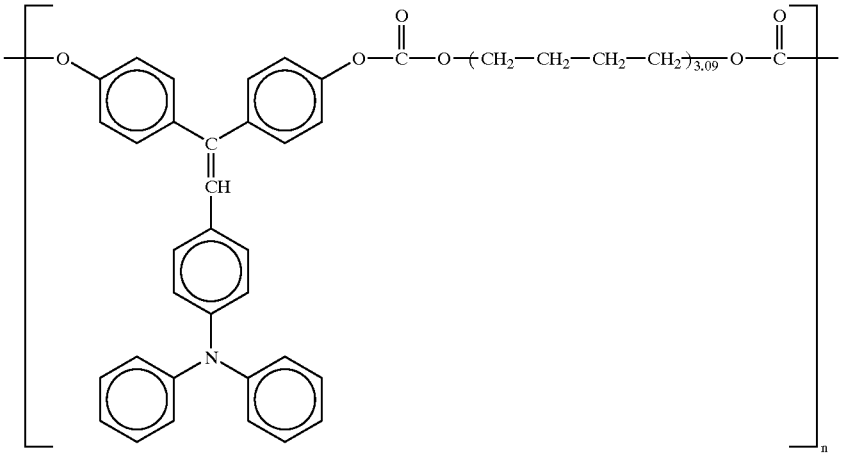

| | |
|---|---|
| Low molecular weight charge transporting material having the following formula | 2.45 parts |

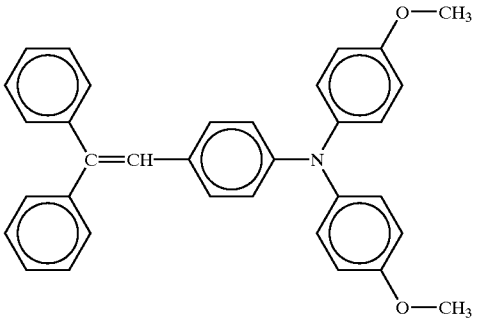

| | |
|---|---|
| α-Alumina (Sumicorundum AA-05 manufactured by Sumitomo Chemical Company Ltd.) | 1.5 parts |
| Cyclohexanone | 80 parts |
| Tetrahydrofuran | 280 parts |

Example 30

An electrophotoconductor was prepared in the same manner as described in Example 26 except that the following charge transporting layer coating liquid was used in lieu of the filler-containing charge transporting layer coating liquid used in Example 26.

[Filler-containing charge transporting layer coating liquid]

| | |
|---|---|
| Charge transporting polymer material having the following structure (weight average molecular weight: $9.8 \times 10^4$) | 3.5 parts |

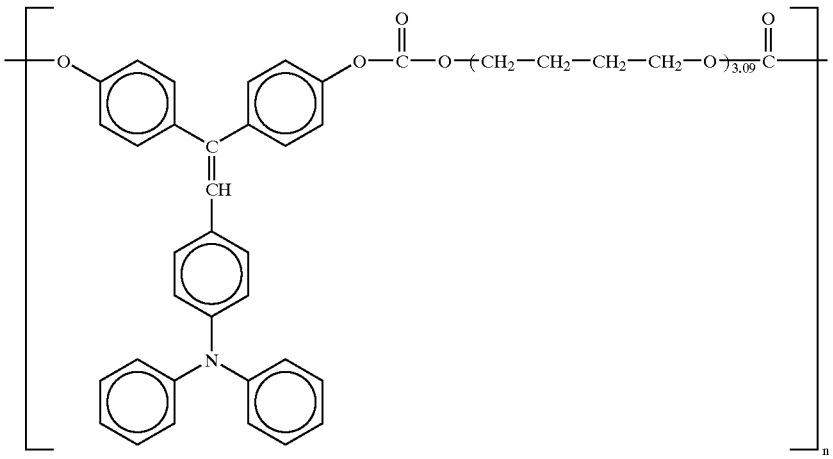

| | |
|---|---|
| Low molecular weight charge transporting material having the following formula | 2.45 parts |

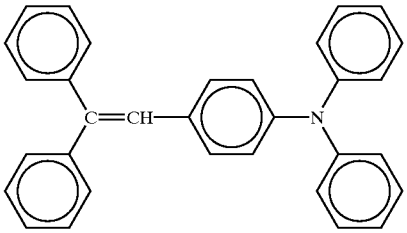

| | |
|---|---|
| α-Alumina (Sumicorundum AA-05 manufactured by Sumitomo Chemical Company Ltd.) | 1.5 parts |
| Cyclohexanone | 80 parts |
| Tetrahydrofuran | 280 parts |

Example 31

An electrophotoconductor was prepared in the same man ner as described in Example 26 except that the following filler-containing charge transporting layer coating liquid was used in lieu of the filler-containing charge transporting layer coating liquid in Example 26.

[Filler-containing charge transporting layer coating liquid]

Charge transporting polymer material having the following structure (weight average molecular weight: $9.8 \times 10^4$) 5.95 parts

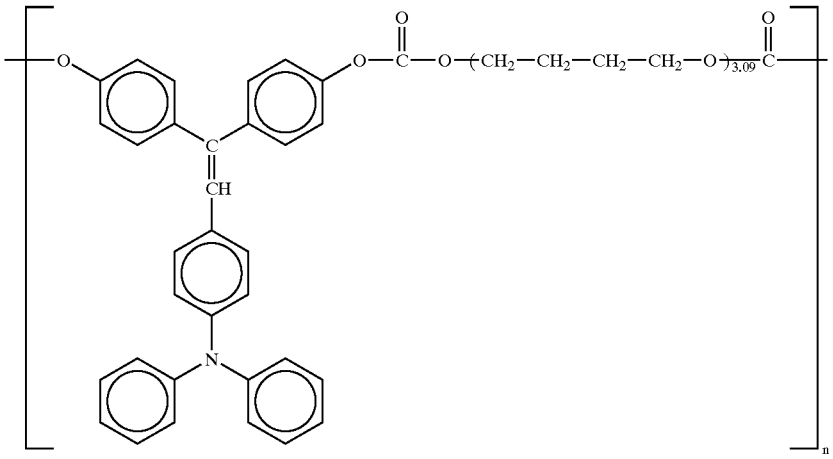

| | |
|---|---|
| α-Alumina (Sumicorundum AA-05 manufactured by Sumitomo Chemical Company Ltd.) | 1.5 parts |
| Cyclohexanone | 80 parts |
| Tetrahydrofuran | 280 parts |

Each of the photoconductors obtained in Examples 29–31 was installed in each of the black, yellow, magenta and cyan stations of a modified copier of a tandem-type copier (PRETER 750 manufactured by Ricoh Company Ltd.), and images of black, yellow, magenta and cyan colors each occupying 5% of the area were continuously reproduced for 200,000 copies. The environmental conditions were 24° C. and 50% relative humidity. The copier had a charger roller provided with a pair of spacer rings each made of an insulation tape having a thickness of 50 μm and a width of 5 mm and attached to opposite ends of the roller, so that a gap of 50 μm was defined between the photoconductor surface and the charger roller surface. The charging was performed at a DC voltage of −700 V while superimposing AC voltage of 1.5 kV (voltage between peaks) with a frequency of 2 kHz. An LD unit of 655 nm was used in an exposure unit. Electric potential of the light-exposed region of the photoconductor used in the magenta station before and after the test was measured. Also measured was ionization potential of the photoconductive material contained in the filler-containing charge transporting layers. The results are shown in Table 14.

TABLE 14

| Example No. | Ionization potential (eV) | Electric potential before test (-V) | Electric potential after test (-V) |
|---|---|---|---|
| 29 | 5.48 (polymer) 5.56 (low molecular weight) | 30 | 40 |
| 30 | 5.48 (polymer) 5.31 (low molecular weight) | 50 | 90 |
| 31 | 5.48 (polymer) | 40 | 50 |

The difference in ionization potential between the two charge transporting materials contained in the filler-containing charge transporting layer is 0.8 eV in Example 29 and 0.17 eV in Example 30. The electric potential after the 200,000 copying test in Example 29 is lower than that in Example 31 in which only one charge transporting material is used. In Example 30, however, the electric potential after the 200,000 copying test is much higher than that in Example 31. From the results shown in Table 14, it will be appreciated that, when two charge transporting materials are used in a filler-containing charge transporting layer, the difference in ionization potential therebetween is desired to be small for obtaining photoconductors having excellent electrostatic characteristics.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

The teachings of Japanese Patent Application No. 2001-290162, filed Sep. 21, 2001, inclusive of the specification, claims and drawings, are hereby incorporated by reference herein.

What is claimed is:

1. An electrophotographic photoconductor comprising an electroconductive support, and a photoconductive layer formed on said support, said photoconductive layer including a charge transporting material, a charge generating material and an inorganic filler comprising α-alumina, wherein the α-alumina is in the form of particles having (a) a polyhedral shape, (b) a hexagonal close-packed lattice crystal structure and (c) a DIH ratio of from 0.5–5.0 wherein D represents a maximum particle diameter parallel to a hexagonal lattice plane of said hexagonal close-packed lattice and H represents a diameter perpendicular to said hexagonal lattice plane.

2. An electrophotographic photoconductor as claimed in claim 1, wherein the α-alumina particles have a volume average particle diameter of at least 0.1 μm but less than 0.7 μm and a Db/Da ratio of 5 or less wherein Da and Db represent a cumulative 10% diameter and a cumulative 90% diameter, respectively, of a cumulative distribution depicted from the small diameter side.

3. An image forming process comprising charging an electrophotographic photoconductor according to claim 1, exposing imagewise the charged photoconductor to form a latent image, developing said latent image to form a toner image, and transferring said toner image to a transfer sheet.

4. An image forming apparatus comprising an electrophotographic photoconductor according to claim 1, means for charging the photoconductor, means for exposing imagewise the charged photoconductor to form a latent image, means for developing said latent image to form a toner image, and means for transferring said toner image to a receiving medium.

5. An image forming apparatus as claimed in claim 4, wherein said charging means comprises a charging roller.

6. An image forming apparatus as claimed in claim 5, wherein said charging means further comprises means for applying DC voltage superimposed by AC voltage to said photoconductor.

7. An image forming apparatus as claimed in claim 3, wherein said charging means comprises a charging roller maintained in non-contact with said photoconductor.

8. An image forming apparatus as claimed in claim 7, wherein said charging means further comprises means for applying DC voltage superimposed by AC voltage to said photoconductor.

9. A process cartridge freely detachable from an electrophotographic image forming apparatus, comprising an electrophotographic photoconductor according to claim 1, and at least one means selected from the group consisting of charging means, image exposure means, developing means, image transfer means, and cleaning means.

10. An image forming apparatus as claimed in claim 9, wherein said at least one means comprises charging means including means for applying DC voltage superimposed by AC voltage to said photoconductor.

11. A full color electrophotographic apparatus, comprising an electrophotographic photoconductor according to claim 1, means for charging the photoconductor, means for exposing imagewise the charged photoconductor to form a latent image, means for developing said latent image to form a toner image, first means for transferring said toner image to an intermediate transfer member to form a transferred image thereon, said intermediate transfer member being adapted to successively receive a plurality of transferred images having different colors from said first means to form thereon superimposed images, and second means for transferring the superimposed images to a receiving medium.

12. A full color electrophotographic apparatus, comprising a plurality of electrophotographic photoconductors according to claim 1 arranged in tandem, means for charging each photoconductor, means for exposing imagewise each charged photoconductor to form a latent image thereon, means for developing each latent image to form a toner image thereon, and means for transferring toner images on respective photoconductors to a receiving medium.

* * * * *